US006297624B1

(12) United States Patent
Mitsui et al.

(10) Patent No.: US 6,297,624 B1
(45) Date of Patent: Oct. 2, 2001

(54) SEMICONDUCTOR DEVICE HAVING AN INTERNAL VOLTAGE GENERATING CIRCUIT

(75) Inventors: Katsuyoshi Mitsui; Kiyohiro Furutani; Takashi Kono, all of Hyogo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/258,159

(22) Filed: Feb. 26, 1999

(30) Foreign Application Priority Data

Jun. 26, 1998 (JP) ..... 10-181125

(51) Int. Cl.[7] ..... G05F 3/16
(52) U.S. Cl. ..... 323/316; 323/314; 365/226
(58) Field of Search ..... 323/312, 313, 323/314, 315, 316; 327/52, 53, 54; 365/226

(56) References Cited

U.S. PATENT DOCUMENTS 5,249,155 * 9/1993 Arimoto et al. ..... 365/226 X
5,594,695 * 1/1997 Yim et al. ..... 327/54 X
5,831,421 * 11/1998 Taira et al. ..... 323/314

FOREIGN PATENT DOCUMENTS 6-215571 8/1994 (JP) .
6-325568 11/1994 (JP) .

* cited by examiner

*Primary Examiner*—Jessica Han
(74) *Attorney, Agent, or Firm*—McDermott, Will & Emery

(57) ABSTRACT

An internal power supply circuit produces an internal power supply voltage from an external power supply voltage. A voltage level control circuit controls a voltage level and a temperature characteristic of the internal power supply voltage generated by the internal power supply circuit. The internal power supply circuit produces the internal power supply voltage having a negative or zero temperature characteristic in a low temperature region and a positive temperature characteristic in a high temperature region. The voltage level control circuit includes a structure optimizing a capacitance value of a sense power supply line stabilizing capacitance for driving a sense amplifier circuit, a level converting circuit determining the lowest operable region of the external power supply voltage of the internal power supply circuit, or a structure forcedly operating the internal voltage down converter upon power-on. The internal power supply voltage at a desired level is stably produced with a small occupied area and a low current consumption.

15 Claims, 25 Drawing Sheets

SEMICONDUCTOR DEVICE HAVING AN INTERNAL VOLTAGE GENERATING CIRCUIT

BACKGROUND OF THE INVENTION

1. Field of the Invention

The present invention relates to a semiconductor device, and particularly to a structure of an internal voltage generating circuit for internally generating a voltage at a desired level.

2. Description of the Background Art

FIG. 47 schematically shows a whole structure of a conventional semiconductor memory device. In FIG. 47, the semiconductor memory device includes a memory cell array 100 having a plurality of memory cells MC arranged in rows and columns. In memory cell array 100, word lines WL are arranged corresponding to the rows of memory cells MC, respectively, and bit line pairs BLP are arranged corresponding to the columns of memory cells MC, respectively. Memory cells MC are arranged corresponding to crossings between bit line pairs BLP and word lines WL, respectively.

The semiconductor memory device further includes an address input buffer 200 which takes in an externally supplied address signal ADD to produce an internal address signal, a row select circuit 250 which drives a word line WL corresponding to an addressed row in memory cell array 100 to the selected state in accordance with an internal row address signal from address input buffer 200, a sense amplifier circuit 300 which senses, amplifies and latches data of the memory cells connected to the selected row, a column select circuit 350 which selects an addressed column in memory cell array 100 in accordance with an internal column address signal from address input buffer 200, and an I/O circuit 400 which transmits data to and from the memory cell in the column selected by column select circuit 350.

Row select circuit 250 includes a row decoder for decoding the internal row address signal from address input buffer 200, and a word line drive circuit for driving the word line by the output signal of the row decoder to the selected state. The column select circuit 350 includes a column decoder for decoding the internal column address signal from address input buffer 200, and an I/O gate circuit for connecting the addressed column in the memory cell array to an internal data bus (not clearly shown) in accordance with a column select signal from the column decoder. Sense amplifier circuit 300 includes sense amplifiers which are provided corresponding to bit line pairs BLP, and differentially amplify potentials on the corresponding bit line pairs when made active, respectively.

Semiconductor memory device further includes an internal power supply circuit 500 which down-converts an externally supplied power supply voltage Vext to produce internal power supply voltages Vccp and Vccs. Internal power supply voltage Vccp produced by internal power supply circuit 500 is supplied to peripheral circuits, i.e., address input circuit 200, row select circuit 250, column select circuit 350 and I/O circuit 400. Internal power supply voltage Vccs is supplied to sense amplifier circuit 300.

Internal power supply voltage Vccp is at a level higher than or equal to that of internal power supply voltage Vccs. By applying high internal power supply voltage Vccp to the peripheral circuits, the peripheral circuits are operated fast. Meanwhile, by applying internal power supply voltage Vccs lower than internal power supply voltage Vccp to sense amplifier circuit 300, a charge/discharge current of the bit line is reduced and the bit line signal amplitude is also reduced, whereby a fast access operation is achieved. If the device is a DRAM (Dynamic Random Access Memory), memory cell MC is formed of an access transistor and a capacitor. In this case, application of a high voltage to an insulating film of this capacitor is prevented so that the reliability of capacitor insulating film can be assured. Further, it is possible to ensure a reliability of the word lines subjected to a 1.5 times higher voltage than voltage Vccs.

In address input buffer 200 and I/O circuit 400, external power supply voltage Vext is used for portions interfaced to an external device, although not shown in FIG. 47.

As a storage capacity of the semiconductor memory device increases, MOS transistors as the components are miniaturized accordingly. However, external devices such as a processor and a logic have not been highly miniaturized compared with the semiconductor memory devices, and therefore relatively high operation power supply voltages are used for maintaining intended operation speeds. It is necessary to maintain compatibility in the power supply voltage with previous-generation semiconductor memory devices. Accordingly, external power supply voltage Vext is lowered by internal power supply circuit 500 to produce internal power supply voltages Vccp and Vccs so that the compatibility of the system power supply voltage is maintained while maintaining the compatibility with previous-generation semiconductor memory devices.

FIG. 48 schematically shows a structure of internal power supply circuit 500 shown in FIG. 47. In FIG. 48, internal power supply circuit 500 includes a reference voltage generating circuit 502*s* generating a reference voltage Vrefs, a reference voltage generating circuit 502*p* generating a reference voltage Vrefp, a voltage down converter 504*s* which is supplied with a current from a node receiving external power supply voltage Vext and adjusting a voltage level of internal (sense) power supply voltage Vccs in accordance with a difference between internal power supply voltage Vccs and reference voltage Vrefs, and a voltage down converter 504*p* which is supplied with a current from a node receiving external power supply voltage Vext and adjusting a voltage level of internal power supply voltage Vccp in accordance with a difference between internal power supply voltage Vccp and reference voltage Vrefp. Reference voltage generating circuit 502*s* and voltage down converter 504*s* form a sense power supply circuit producing an internal power supply voltage for the sense amplifiers. Reference voltage generating circuit 502*p* and voltage down converter 504*p* form a peripheral power supply circuit producing internal power supply voltage Vccp for the peripheral circuits. The sense power supply circuit and the peripheral power supply circuit are made independent from each other for the following reasons.

During an operation of sense amplifier circuit 300 shown in FIG. 47, bit line pairs BLP connected to a selected word line WL are charged and discharged. The charge/discharge current during the operation of the sense amplifiers is relatively large, and voltage down converter 504*s* of the sense power supply circuit is required to have a large current drive capability for compensating for this large current consumption. However, only the charging and discharging of the bit line pair BLP are required, and fast recovering of internal power supply voltage (which will be referred to as a "sense power supply voltage") Vccs to the initial state is not required. Therefore, a significantly fast responsibility is not required in voltage down converter 504*s*. In contrast, a sufficiently fast responsibility is required in voltage down converter 504*p* of the peripheral power supply circuit because fast compensation must be made for a variation in internal power supply voltage (which will be referred to as a "peripheral power supply voltage") Vccp so as to achieve fast and stable operation of the peripheral circuits. Meanwhile, the peripheral circuits in operation consume a current smaller than that in the operation of the sense amplifier. Accordingly, voltage down converter 504*p* of the peripheral power supply circuit is required to have a fast responsibility although the required drive current is relatively small. For satisfying these different required characteristics, the sense power supply circuit and the peripheral power supply circuit are arranged independently of each other.

The semiconductor memory device includes the independent power supply circuits for the peripheral circuit and for the sense amplifier circuit. Since sense power supply voltage Vccs and peripheral power supply voltage Vccp are different in voltage level from each other, reference voltages Vrefs and Vrefp which determine the voltage levels of power supply voltages Vccs and Vccp are generated from independent reference voltage generating circuits 502*s* and 502*p*, respectively. This results in a problem that the reference voltage generating circuits occupy a large area in internal power supply circuit 500, and the occupied area cannot be reduced. Due to provision of independent reference voltage generating circuits 502*s* and 502*p*, trimming of the voltage levels of reference voltages Vrefs and Vrefp must be performed independently of each other, and the voltage trimming requires a long time.

FIG. 49 shows the structure of voltage down converters 504*s* and 504*p* shown in FIG. 48. Sense voltage down converter 504*s* generating power supply voltage Vccs and peripheral voltage down converter 504*p* generating peripheral power supply voltage Vccp have the same structure, and therefore FIG. 49 representatively shows voltage down converter 504.

In FIG. 49, voltage down converter 504 includes a comparator 505*a* which compares internal power supply voltage Vcc on an internal power supply line 505*d* with reference voltage Vref, a current drive circuit 505*b* which is formed of an n channel MOS transistor and supplies a current from the external power supply node receiving external power supply voltage Vext to internal power supply line 505*d* in accordance with the output signal of comparator 505*a*, and a reset transistor 505*c* which is formed of a p channel MOS transistor and transmits external power supply voltage Vext to internal power supply line 505*d* in response to a power-on detection signal /POR after power-on. Power-on detection signal /POR is kept active at L-level until external power supply voltage Vext reaches predetermined voltage level or a stable state after the power-on, and is used for initialization of internal circuit nodes.

Comparator 505*a* is typically formed of a differential amplifier, and receives internal power supply voltage Vcc and reference voltage Vref on its positive and negative inputs, respectively. When internal power supply voltage Vcc is higher than reference voltage Vref, comparator 505*a* generates the output signal at H-level, and current drive transistor 505*b* keeps the off state. When internal power supply voltage Vcc is lower than reference voltage Vref, comparator 505*a* generate the output signal at a low level corresponding to a difference between these voltages Vcc and Vref, and a conductance of current drive transistor 505*b* increases. Thereby, a current is increasingly supplied from the external power supply node to internal power supply line 505*d*, and the voltage level of internal power supply voltage Vcc rises. In the structure of voltage down converter 504 shown in FIG. 49, therefore, internal power supply voltage Vcc is maintained substantially at the voltage level of reference voltage Vref.

FIG. 50 shows a relationship between internal power supply voltage Vcc, reference voltage Vref and external power supply voltage Vext. In FIG. 50, the abscissa gives the voltage level of external power supply voltage Vext, and the ordinate gives the respective voltages. Reference voltage Vref is produced from external power supply voltage Vext. Reference voltage Vref is generally produced by a constant current source and a resistance circuit. The voltage level of reference voltage Vref rises in accordance with the level of external power supply voltage Vext when the level of external power supply voltage Vext is low. When external power supply voltage Vext reaches or exceeds a predetermined voltage level, reference voltage Vref maintains a constant level of a voltage Va independently of the voltage level of external power supply voltage Vext. Internal power supply voltage Vcc is produced based on a comparison between reference voltage Vref and the voltage on internal power supply line 505*d*. The voltage level of internal power supply voltage Vcc is substantially equal to the voltage level of reference voltage Vref, but is slightly lower than the voltage level of reference voltage Vref due to a channel resistance of current drive transistor 505*b*.

When power supply voltage Vext is made on, the voltage level of external power supply voltage Vext rises, and correspondingly the voltage level of reference voltage Vref rises. Comparator 505*a* and current drive transistor 505*b* adjusts the voltage level of internal power supply voltage Vcc in accordance with a result of comparison between the voltage on internal power supply line 505*d* and reference voltage Vref Therefore, the voltage level of internal power supply voltage Vcc rises corresponding to rising of the voltage level of reference voltage Vref caused in accordance with power-on and subsequent rise of the voltage level of external power supply voltage Vext. When reference voltage Vref reaches the constant voltage level and attains the stable state, internal power supply voltage Vcc also reaches a stable voltage level. Thus, the voltage level of internal power supply voltage Vcc is stabilized after the voltage level of reference voltage Vref is stabilized, and therefore it is impossible to rapidly stabilize internal power supply voltage Vcc after starting of supply of external power supply voltage Vext. Accordingly, reset transistor 505*c* is used for raising the voltage level on internal power supply line 504 in accordance with the voltage level of external power supply voltage Vext for a predetermined period after the power-on.

FIG. 51 shows a change in internal power supply voltage upon power-on. In FIG. 51, the power is on at time t0 and the voltage level of external power supply voltage Vext rises. In this state, power-on detection signal /POR maintains the L-level. Therefore, reset transistor 505*c* is turned on, and voltage Vcc on internal power supply line 505*d* changes in accordance with the voltage level of external power supply voltage Vext.

At time t1, external power supply voltage Vext attains a level of a predetermined voltage Vb so that power-on detection signal /POR attains the inactive state of H-level, and reset transistor 505*c* is turned off. Thereafter, comparing circuit 505*a* and current drive transistor 505*b* drive internal power supply voltage Vcc to the level of reference voltage Vref.

Owing to provision of reset transistor 505*c*, the voltage level of internal power supply voltage Vcc on internal power supply line 505*d* can be rapidly raised after the power-on, and can be stabilized at the predetermined voltage level (i.e., level of reference voltage Vref) at an early time.

In the above case, internal power supply line 505*d* is coupled to the node receiving the external power supply voltage until power-on detection signal /POR attains the inactive state of H-level after the power-on. Therefore, an unnecessarily high voltage is applied to internal power supply line 505*d* due to, e.g., noises, which may result in instantaneous breakdown, i.e., breakdown of circuits utilizing internal power supply voltage Vcc on internal power supply line 505*d* and/or degradation of the reliability thereof (due to application of large voltage stresses upon each power-on). Particularly, if voltage down converter 504 is activated only when the internal circuits operate, voltage Vcc on internal power supply line 505*d* must be driven to the predetermined level in accordance with an independent standby voltage down converter which has a small current drive capability and normally operates. For rapidly stabilizing internal power supply voltage Vcc, complicated adjustment of timing of power-on detection signal /POR is required, and therefore it is difficult to ensure a reliability of the internal circuits. Further, if power-on detection signal /POR is held in the active state at L-level for a long period as shown by broken line in FIG. 51, internal power supply voltage Vcc is driven to a voltage level higher than reference voltage Vref so that unnecessarily high voltages is applied to the internal circuits, resulting in deterioration of element characteristics or breakdown of circuit elements.

FIG. 52 shows temperature dependency of reference voltage Vref and internal power supply voltage Vcc. In FIG. 52, the abscissa give a temperature T, and the ordinate gives a voltage V. As shown in FIG. 52, the reference voltage Vref and internal power supply voltage Vcc have positive temperature characteristics, and rise with increasing of temperature T. The purposes of these characteristics are to prevent deterioration of element characteristics due to trap of produced hot carriers in gate insulating film of insulated gate field effect transistors (MOS transistors) included in the internal circuits in a low temperature operating region, and to compensate for lowering in operation speed in operation at a high temperature, due to reduction in drain current by the increased channel-resistance by hot carriers. However, the positive temperature characteristics of internal power supply voltage Vcc causes the following problem in a low temperature region. The absolute value of the threshold voltage of MOS transistor increases in a low temperature region. Therefore, when the gate voltage of the MOS transistor lowers in the low temperature region, an effective gate-source voltage of the MOS transistor decreases in absolute value, so that the MOS transistor cannot operate fast or may malfunction (may not be turned on completely). Particularly, a sense amplifier included in the sense amplifier circuit amplifies a difference between the bit line voltage at an intermediate level and the sense power supply voltage Vccs. Therefore, the gate-source voltage of the MOS transistor forming the sense amplifier takes the maximum value of (Vccs−Vccs/2) when the operation starts, and therefore the sense amplifier is remarkably affected by increase in absolute value of the threshold voltage of the MOS transistor and decrease in sense power supply voltage Vccs. If the sense power supply voltage Vccs is optimized for the low temperature region, sense power supply voltage Vccs becomes excessively high in the high temperature operation so that breakdown or deterioration of the gate insulating film may occur.

For fast operation of the sense amplifier circuit, it can be considered that the level of sense power supply voltage Vccs applied to the sense amplifier circuit may be raised at the start of the sensing operation. In this case, the sense amplifier power supply voltage for the sense amplifier circuit is raised to the level of peripheral power supply voltage Vccp, and the raised voltage is stored in a capacitor. In the sensing operation, charges accumulated in the capacitor are utilized for the sensing operation, whereby the sensing operation can be performed fast. In this case, however, the capacitor for raising the voltage must be arranged on the sense power supply line supplying sense amplifier power supply voltage Vccs. If the capacitance value of this capacitor is determined with a margin, the capacitor occupies an unnecessarily large area, resulting in disadvantageous increase in chip area.

For reducing a current consumption of the whole system, external power supply voltage Vext is set to a low level. If the voltage level of external power supply voltage Vext is lowered to a level near a voltage Va shown in FIG. 50 and if a difference between external power supply voltage Vext and internal power supply voltage Vcc decreases, the source-drain voltage of current drive transistor 505*b* shown in FIG. 49 decreases, and the current supply capability of current drive transistor 505*b* decreases so that it is impossible to compensate for lowering of internal power supply voltage Vcc when internal power supply voltage Vcc changes, and internal power supply voltage Vcc cannot be stably held at the predetermined voltage level. As described below, the output signal of the comparator forms another cause of reduction of the quantity of current supplied from the external power supply node to the internal power supply line when external power supply voltage Vext lowers.

FIG. 53 shows a structure of comparator 505*a* shown in FIG. 49. In FIG. 53, comparator 505*a* includes a p channel MOS transistor PQ1 which is connected between the external power supply node and a node NDA and has a gate connected to a node NDB, a p channel MOS transistor PQ2 which is connected between the external power supply node and node NDB and has a gate connected to node NDB, an n channel MOS transistor NQ1 which is connected between nodes NDA and NDC and has a gate receiving reference voltage Vref, an n channel MOS transistor NQ2 which is connected between nodes NDB and NDC and has a gate receiving internal power supply voltage Vcc, and an n channel MOS transistor NQ3 which is connected between node NDC and a ground node and has a gate receiving an activating signal ACT. Node NDA is connected to the gate of current drive transistor 505*b*.

MOS transistors PQ1 and PQ2 form a current mirror circuit, and transmit the currents of the same magnitude to MOS transistors NQ1 and NQ2, respectively. MOS transistor NQ3 is a current source transistor, and restricts the operating current of comparator 505*a*. Activating signal ACT is activated when circuitry connected to internal power supply line 505*d* operates to consume internal power supply voltage Vcc.

In the structure of comparator 505*a* shown in FIG. 53, the voltage level on node NDC is higher than the ground voltage level due to the channel resistance of MOS transistor NQ3. If the back gates of MOS transistors NQ1 and NQ2 are connected to the ground voltage level, the back gate effect of MOS transistors NQ1 and NQ2 increases when the voltage level on node NDC rises so that the threshold voltages of MOS transistors NQ1 and NQ2 increase to reduce the drive currents thereof. The lowest attainable potential on node NDA is equal to the voltage level on node NDC, and is higher than the ground voltage level. Node NDA is connected to the gate of current drive transistor 505*b*. Therefore, as the voltage level of external power supply voltage Vext lowers, the gate-source voltage of current drive transistor 505*b* further decreases, and the current supply capability of current drive transistor 505*b* reduces. Accordingly, as the difference between the external power supply voltage Vext and the internal power supply voltage Vcc decreases, the source-drain voltage and the gate-source voltage of current drive transistor 505*b* decrease so that the current supply capability of current drive transistor 505*b* further reduces. For increasing the current supply capability of current drive transistor 505*b*, a gate width W thereof must be set to several millimeters, resulting in disadvantageous increase in area occupied by the element.

Activating signal ACT must be activated in consumption of internal power supply voltage Vcc on internal power supply line 505*d*. It is necessary to make an area occupied by the circuit producing the activating signal ACT as small as possible.

Instead of the voltage down converter which is selectively activated in response to activating signal ACT as shown in FIG. 53, such a voltage down converter may be employed that operates even during standby to compensate for a leak current during standby. In this structure, a bias voltage at a constant voltage level is used instead of activating signal ACT. In this case, the voltage level on node NDC further increases (because the conductance of the current source transistor decreases), and such a problem becomes more remarkable that the current supply capability of the current drive transistor is reduced if external power supply voltage Vext is low. Accordingly, it is necessary to employ a current drive transistor occupying a large area for compensating for a leak current during standby.

In the conventional internal power supply circuit, as described above, it is impossible to produce stably an internal power supply voltage over wide ranges of operation parameters (the operation temperature and the power supply voltage) with a small area and a small current consumption.

SUMMARY OF THE INVENTION

An object of the invention is to provide an internal power supply circuit which can produce an internal power supply voltage for stably operating internal circuits.

Another object of the invention is to provide an internal power supply circuit which occupies a small area and can stably produce an internal power supply voltage at a desired level.

Still another object of the invention is to provide a circuit element employable in an internal power supply circuit, which in turn occupies a small area and can operate with a lower current consumption to produce an internal power supply voltage allowing stable operation of internal circuits over wide operation parameter ranges.

According to a first aspect, a semiconductor device includes an internal power supply circuit for producing an internal power supply voltage from an external power supply voltage, an internal circuit utilizing the internal power supply voltage supplied from the internal power supply circuit, a capacitance element coupled to an internal power supply line transmitting the internal power supply voltage, and a circuit for adjusting a capacitance value of the capacitance element.

According to a second aspect, a semiconductor device includes a circuit for producing a reference voltage having a negative or zero temperature characteristic in a first temperature region and a positive temperature characteristic in a second temperature region higher than the first temperature region, and a circuit for producing an internal power supply voltage based on the reference voltage.

According to a third aspect, a semiconductor device includes a plurality of insulated gate field effect transistors of the same conductivity type connected in series between first and second nodes. Each of the plurality of insulated gate field effect transistors has a gate connected to an inter-transistor connection node spaced by an adjacent transistor from the gate. Each of the connection nodes forms a node supplying a voltage produced by dividing a voltage between the first and second nodes.

According to a fourth aspect, a semiconductor device includes a constant current source, a reference voltage generating circuit including a plurality of resistance elements connected in series, receiving a current from the constant current source and generating first and second reference voltages, a voltage down converter for producing first and second internal power supply voltages from an external power supply voltage in accordance with the first and second reference voltages, respectively, a memory array having a plurality of memory cells arranged in rows and columns, a plurality of sense amplifiers arranged corresponding to the columns of memory cells, utilizing the first internal power supply voltage and operating to sense and amplify data of the memory cells in the corresponding columns when made active, respectively, and a peripheral circuit using the second internal power supply voltage to perform a memory cell select operation.

According to a fifth aspect, a semiconductor device includes a delay chain including a plurality of delay stages connected in series and receiving an operation mode instructing signal, a decode circuit for decoding signals on a plurality of predetermined nodes on the delay chain to produce an activating signal, and a voltage down converter activated in response to activation of the activating signal from the decode circuit, and thereby adjusting a level of the internal power supply voltage in accordance with a difference between the internal power supply voltage and the reference voltage. The voltage down converter includes a comparator circuit making a comparison between voltages corresponding to the internal power supply voltage and the reference voltage, respectively.

According to a sixth aspect, a semiconductor device includes a current drive transistor coupled between an external power supply node receiving an external power supply voltage and an internal power supply line, a comparing circuit for making a comparison between voltages corresponding to a reference voltage and an internal power supply voltage on the internal power supply line when made active, and controlling a conductance of the current drive transistor in accordance with the result of comparison, and an activating circuit for activating the comparing circuit in accordance with a level of the internal power supply voltage.

By adjusting a capacitance value of a capacitance element, the internal power supply voltage at a desired voltage level can be stably transmitted to the internal circuit. Since the capacitance value of the capacitance element is adjustable, an area occupied by the capacitance element can be minimized.

The reference voltage providing the reference for the internal power supply voltage has the negative or zero temperature characteristic in the first temperature range, and has the positive temperature characteristic in the second temperature range. Thus, the level of the internal power supply voltage can be optimized in both the low and high temperature ranges, and the field effect transistors of the internal circuit can operate fast and stably.

The reference voltage and the internal power supply voltage are compared with each other after shifting the levels thereof. Thus, the operation region of the comparator can be optimized so that the voltage down converter can have an excellent response characteristic even when the external power supply voltage lowers.

The gate of each of the MOS transistors connected in series is connected to the connection node of the transistor spaced therefrom by the transistor, whereby an influence by the threshold voltage can be reduced and the MOS transistors can operate stably in the resistance mode to produce an internal voltage at a desired level.

A reference voltage generating circuit generates first and second reference voltages. Thus, an area occupied by the reference voltage generating circuit can be reduced.

An activating signal is produced by decoding a delay signal. Thus, an area occupied by the control circuit can be reduced.

The comparing circuit in the voltage down converter is selectively activated in accordance with the level of the internal power supply voltage, whereby the voltage down converter can operate in accordance with the level of the internal power supply voltage even upon power-on. Accordingly, it is possible to prevent application of an excessively high voltage to the internal power supply line and prevent destruction of the internal circuit.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

[Whole Structure]

Figure 1:
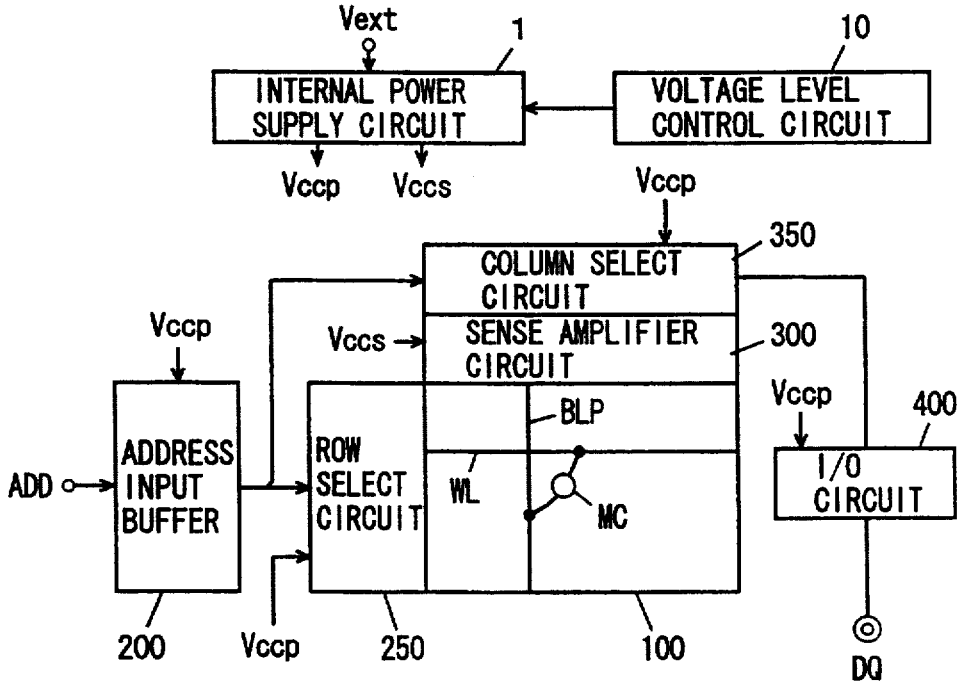
FIG. 1 schematically shows a whole structure of a semiconductor memory device to which the invention is applied.

FIG. 1 schematically shows a whole structure of a semiconductor memory device to which the invention is applied. In FIG. 1, the semiconductor memory device includes a memory cell array 100, an address input buffer 200, a row select circuit 250, a sense amplifier circuit 300, a column select circuit 350 and an I/O circuit 400 similarly to the conventional device. Each of address input circuit 200, row select circuit 250, column select circuit 350 and I/O circuit 400 receives a peripheral power supply voltage Vccp as one operation power supply voltage. Sense amplifier circuit 300 receives a sense power supply voltage Vccs.

The semiconductor memory device further includes an internal power supply circuit 1 which produces peripheral power supply voltage Vccp and sense power supply voltage Vccs from an external power supply voltage Vext, and a voltage level control circuit 10 which controls levels of power supply voltages Vccp and Vccs produced by internal power supply circuit 1 in accordance with an operation mode. Internal power supply circuit 1, of which specific structure will be described later, occupies a small area, and stably produces power supply voltages Vccp and Vccs over a wide external power supply voltage range and a wide temperature range. Voltage level control circuit 10 controls and stabilizes the voltage level(s) of power supply voltages Vccp and/or Vccs supplied from internal power supply circuit 1 at the time of power-on or during operation of sense amplifiers of the semiconductor memory device. Internal power supply circuit 1 and voltage level control circuit 10, which occupy only a small area, can stably produce the internal power supply voltage, and can ensure stable operation of internal circuits of the semiconductor memory device.

Internal power supply circuit 1 adjusts the voltage level of the internal power supply voltage in accordance with a result of comparison between a reference voltage generated by an internal reference voltage generating circuit and internal power supply voltage Vcc (Vccp or Vccs).

EMBODIMENT 1

Reference Voltage Generating Circuit 1

Figure 2:
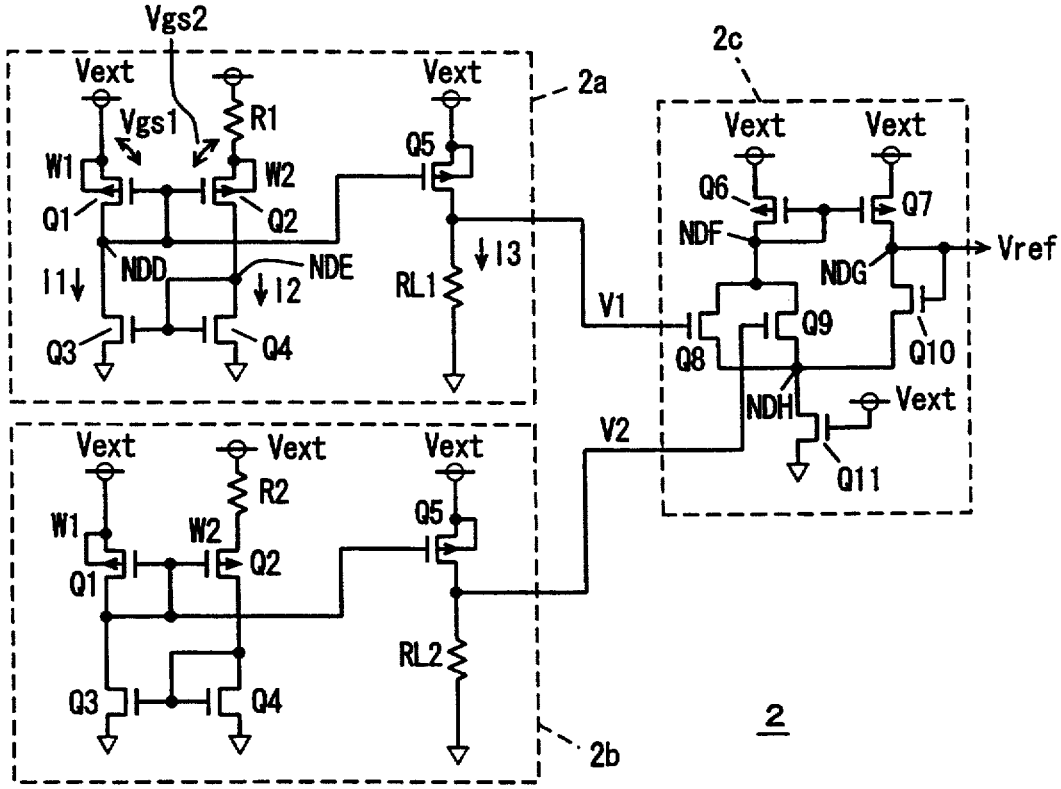
FIG. 2 shows a structure of a main portion of a semiconductor memory device according to an embodiment 1 of the invention.

FIG. 2 shows a structure of the reference voltage generating circuit according to the embodiment 1 of the invention. In FIG. 2, reference voltage generating circuit 2 includes a first voltage generating circuit 2*a* generating a first voltage V1 having a positive temperature characteristic that the voltage level thereof rises with increasing of temperature, a second voltage generating circuit 2*b* generating a second voltage V2 having a negative of zero temperature characteristic that the voltage level lowers or is kept constant with increasing of temperature, and an OR circuit 2*c* for selecting a voltage at a higher voltage level between first and second voltages V1 and V2, for generation as reference voltage Vref.

First voltage generating circuit 2*a* includes a p channel MOS transistor Q1 which is connected between an external power supply node and a node NDD and has a gate connected to node NDD, a p channel MOS transistor Q2 which has a source connected to an external power supply node via a resistance element R1, a drain connected to a node NDE and a gate connected to node NDD, an n channel MOS transistor Q3 which is connected between node NDD and a ground node and has a gate connected to node NDE, an n channel MOS transistor Q4 which is connected between node NDE and the ground node, and has a gate connected to node NDE, a p channel MOS transistor Q5 which supplies a current from the external power supply node in accordance with the voltage level on node NDD, and a resistance element RL1 which converts a current I3 supplied from MOS transistor Q5 into a voltage to produce a first voltage V1. MOS transistor Q1 has a channel width W1 smaller than a channel width W2 of MOS transistor Q2. MOS transistors Q3 and Q4 form a current mirror circuit, and MOS transistors Q1 and Q5 form a current mirror circuit. Resistance elements R1 and RL1 are made of the same material.

Second voltage generating circuit 2*b* has a structure similar to that of first voltage generating circuit 2*a*. In second voltage generating circuit 2*b*, however, resistance elements R2 and RL2 are formed of different materials, respectively. Other structures are the same as those of first voltage generating circuit 2*a*, and corresponding portions bear the same reference numerals or characters. MOS transistors Q1–Q5 in first voltage generating circuit 2*a* satisfy the same relationship in size (ratio of a channel width to a channel length) as that of MOS transistors Q1–Q5 in second voltage generating circuit 2*b*.

OR circuit 2*c* includes a p channel MOS transistor Q6 which is connected between the external power supply node and a node NDF and has a gate connected to node NDF, a p channel MOS transistor Q7 which is connected between the external power supply node and a node NDG and has a gate connected to node NDF, an n channel MOS transistor Q8 which is connected between nodes NDF and NDH and has a gate receiving first voltage V1, an n channel MOS transistor Q9 which is connected between nodes NDF and NDH and has a gate receiving second voltage V2, an n channel MOS transistor Q10 which is connected between nodes NDG and NDH and has a gate connected to node NDG, and an n channel MOS transistor Q11 which is connected between node NDH and the ground node and has a gate receiving external power supply voltage Vext. MOS transistors Q6 and Q7 form a current mirror circuit, and MOS transistors Q8, Q9 and Q10 form a source coupled logic. Operation will now be described below.

First, the operation of first voltage generating circuit 2*a* will be described below. MOS transistors Q3 and Q4 form a current mirror circuit, and have the same size (ratio of the channel width to the channel length) so that currents of the same magnitude (I1=I2) flow through MOS transistors Q1 and Q2. MOS transistors Q1 and Q2 have different channel widths. Resistance element R1 has a sufficiently large resistance value. The currents flowing through MOS transistors Q1 and Q2 are extremely small, and MOS transistors Q1 and Q2 operate in a sub-threshold region. It is assumed that a voltage Vgs1 is a gate-source voltage of MOS transistor Q1, and a voltage Vgs2 is a gate-source voltage of MOS transistor Q2. MOS transistors Q1 and Q2 operate in the sub-threshold region, and currents I1 and I2 are equal to each other owing to the current mirror circuits Q3 and Q4, so that the following formula holds.

$$I0\cdot W1\cdot\exp(q\cdot Vgs1/n\cdot k\cdot T)=I0\cdot W2\cdot\exp(q\cdot Vgs2/n\cdot k\cdot T)$$

where I0 represents quantity per channel width of currents flowing in MOS transistors Q1 and Q2, and n is a coefficient represented by a function of a depletion layer capacitance. T represents a temperature, q represents a quantity of charges of electron, and k represents Boltzmann's constant. The following formula can be derived from the above formula:

$$Vgs1-Vgs2=(n\cdot k\cdot T/q)\ln(W2/W1)$$

Since the gate potentials of MOS transistors Q1 and Q2 are equal to each other, a voltage Vr1 applied across resistance element R1 takes the value of (Vgs1−Vgs2). Therefore, the current flowing through resistance element R1 and, in other words, currents I1 and I2 flowing through MOS transistors Q1 and Q2 are expressed by the following formula:

$$I1=I2=(Vgs1-Vgs2)/R1=(n\cdot k\cdot T/q)\ln(W2/W1)\cdot 1/R1$$

MOS transistors Q1 and Q5 form the current mirror circuit, and have the same size so that currents I1 and I3 are equal in magnitude to each other. Therefore, first voltage V1 produced by resistance element RL1 is expressed by the following formula:

$$V1=(n\cdot k\cdot T/q)\ln(W2/W1)\cdot RL1/R1$$

Second voltage generating circuit **2*b* has the same circuit structure as that of first voltage generating circuit 2*a*, and includes MOS transistors Q1–Q5 of which size ratios are equal to those in first voltage generating circuit 2*a***. Therefore, second voltage V2 can be expressed by the following formula:

$$V2=(n\cdot k\cdot T/q)\ln(W2/W1)\cdot RL2/R2$$

In OR circuit **2*c***, MOS transistors Q8 and Q9 receive voltages V1 and V2 on their gates, respectively. MOS transistors Q8–Q10 have sources coupled to node NDH, and operate in a source follower mode. If reference voltage Vref is higher than voltages V1 and V2, the voltage level on node NDH goes to (Vref−Vth), and MOS transistors Q8 and Q9 are turned off. In this state, a current does not flow through MOS transistor Q6, and therefore a current does not flow through MOS transistor Q7 so that the voltage level of reference voltage Vref from node NDG lowers (it is discharged by MOS transistor Q11).

If reference voltage Vref lies between first and second voltages V1 and V2, one of MOS transistors Q8 and Q9 is turned on. It is now assumed that first voltage V1 is higher than second voltage V2. In this state, MOS transistor Q8 is on, and MOS transistor Q9 is off so that a current flows to MOS transistor Q11 through MOS transistors Q6 and Q8. A current of the same magnitude as the current flowing through MOS transistors Q6 flows to MOS transistor Q10 through MOS transistor Q7. Since reference voltage Vref is lower than first voltage V1, MOS transistor Q10 is off so that the voltage level on node NDG rises, and the voltage level of reference voltage Vref rises.

If reference voltage Vref is lower than voltages V1 and V2, one of MOS transistors Q8 and Q9 is turned while the other is turned off on depending on the relation between the voltage levels of voltages V1 and V2, so that the voltage level of reference voltage Vref rises. Therefore, reference voltage Vref is held at the voltage level equal to a higher voltage level of voltages V1 and V2.

Figure 3:
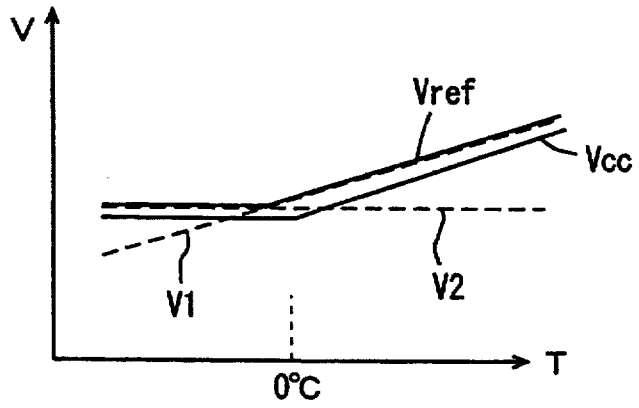
FIG. 3 shows a temperature characteristic of a reference voltage shown in FIG. 2.

FIG. 3 shows a temperature characteristic of reference voltage Vref. Resistance elements R1 and RL1 are made of the same material. In this case, the temperature dependency of resistance elements R1 and RL1 is canceled in the term (RL1/R1) of the foregoing formula. Therefore, the voltage level of first voltage V1 rises in proportion to temperature T. Meanwhile, resistance element RL2 is made of a high melting point metal silicide (refractory metal silicide) such as tungsten silicide, and resistance element R2 is made of a P+ diffusion resistance. The temperature dependency of P+ diffusion resistance is larger than that of the refractory metal silicide such as tungsten silicide, and the resistance value of resistance element R2 is higher than that of resistance element RL2 in a high temperature region. Accordingly, RL2/R2 is substantially proportional to 1/T so that second voltage V2 exhibits the temperature characteristics, that the temperature coefficient is maintained nearly at 0 according to the foregoing formula, and substantially maintains a constant voltage level over the whole temperature range. Reference voltage Vref is at the voltage level substantially equal to higher voltage level of voltages V1 and V2. Accordingly, as shown in FIG. 3, reference voltage Vref is equal to second voltage V2 in the low temperature region and substantially has the zero temperature characteristic. In the high temperature region, reference voltage Vref is equal to first voltage V1, and has the positive temperature characteristic. Internal power supply voltage Vcc is produced according to reference voltage Vref. Accordingly, produced internal power supply voltage Vcc has the positive temperature characteristic in the high temperature region, and has the substantially zero temperature characteristic in the low temperature region. If there is a possibility that the operation speed of a MOS transistor lowers in the high temperature region, the internal power supply voltage Vcc can be set to a high voltage level, whereby the MOS transistor has the gate voltage raised and the operates fast operation can be performed. If there is a possibility that the absolute value of the threshold voltage of the MOS transistor increases in the low temperature region, lowering of the voltage level of internal power supply voltage Vcc can be suppressed, whereby the MOS transistor can be reliably driven to the on state, and a malfunction can be prevented.

[Modification]

Figure 4A:
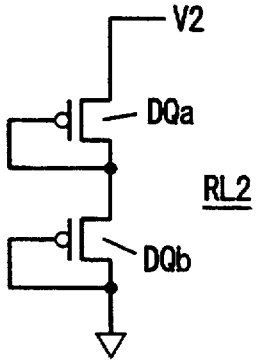
FIG. 4A shows a first modification of the embodiment 1 of the invention.

FIG. 4A shows a structure of a modification of the embodiment 1 of the invention. More specifically, FIG. 4A shows a structure of resistance element RL2 included in second voltage generating circuit **2*b* shown in FIG. 2. Others structures are the same as those shown in FIG. 2. In FIG. 4A**, resistance element RL2 includes diode-connected p channel MOS transistors DQa and DQb. In the structure utilizing diode-connected MOS transistors DQa and DQb, the absolute value of the threshold voltage thereof is ensmalled with increasing temperature. Lowering in absolute value of the threshold voltage promotes flowing of the current through MOS transistors DQa and DQb, and equivalently corresponds to reduction in resistance value. Accordingly, in the case where an impurity diffusion resistance having a positive temperature characteristic is used as resistance element R2 and resistance element RL2 shown in FIG. 4A is used, the voltage level of second voltage V2 lowers with increasing temperature (RL2/R2 $1/T^2$). Thus, second voltage V2 has a negative temperature characteristic. Meanwhile, first voltage V1 has a positive temperature characteristic. Therefore, reference voltage Vref has a negative temperature characteristic in the low temperature region, and has a positive temperature characteristic in the high temperature region. Since internal power supply voltage Vcc is produced in accordance with reference voltage Vref having such characteristics, internal power supply voltage Vcc has a positive temperature characteristic in the high temperature region and a negative temperature characteristic in the low temperature region. Accordingly, in the case where the drain current of the MOS transistor decreases (due to the channel resistance) and the operation speed may slow down slowing of the operation speed of the MOS transistor can be suppressed by increasing the level of power supply voltage Vcc. Also, in the low temperature region, the voltage level of internal power supply voltage Vcc is raised, whereby the MOS transistor can be reliably turned on and operated even when the threshold voltage of the MOS transistor is high.

In the above structure, the MOS transistor may be resistance-connected with the gate potential of the MOS transistor fixed at a constant voltage level of the power supply voltage or the ground voltage. In this structure, the channel resistance increases with increasing temperature, and thus has a positive temperature characteristic. Therefore, an appropriate combination of the resistance elements can be used in accordance with characteristics of the respective resistance elements and the temperature characteristic of internal power supply voltage Vcc (Vccp or Vccs) required in the semiconductor memory device. First voltage V1 having a positive temperature characteristic can be produced by employing resistance-connected MOS transistors of the same material or the same structure. Second voltage V2 having a negative or zero temperature characteristic can be produced by employing resistance elements of different materials or different structures.

According to the embodiment 1 of the invention, as described above, the reference voltage has the zero or negative temperature characteristic in the low temperature region and the positive temperature characteristic in the high temperature region, and therefore the internal power supply voltage can have similar temperature characteristics. Accordingly, the circuits utilizing the internal power supply voltage produced based on the reference voltage can operate stably and fast over the whole temperature range.

In FIG. 4A, the p channel MOS transistors are used. The temperature coefficient of the absolute value of the threshold voltage of the p channel MOS transistor is about −2 mV/° C., and the temperature coefficient of the threshold voltage of the n channel MOS transistor is about −1.5 mV/° C. Therefore, diode-connected n channel MOS transistors may be used as resistance element RL2. The impurity diffusion resistance may be formed of an N+ diffusion resistance doped with N-type impurity.

Figure 4B:
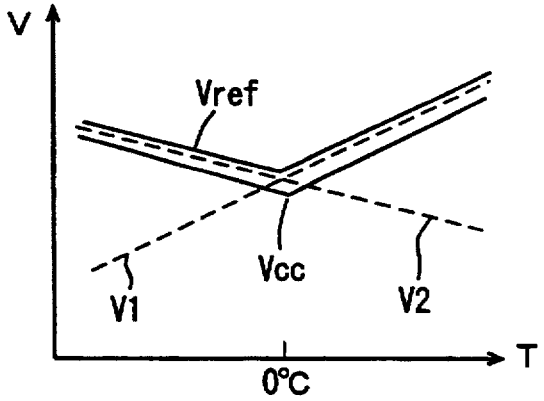
FIG. 4B shows a temperature dependency of the reference voltage exhibited when a resistance element shown in FIG. 4A is employed.

In FIGS. 3 and 4B, a boundary region (temperature at which the temperature characteristic changes) between the low and high temperature regions is set to a temperature near 0° C. However, this boundary temperature may be set to an appropriate value in accordance with the operation temperature region in which the reference voltage generating circuit or the semiconductor memory device operates.

EMBODIMENT 2

Figure 5:
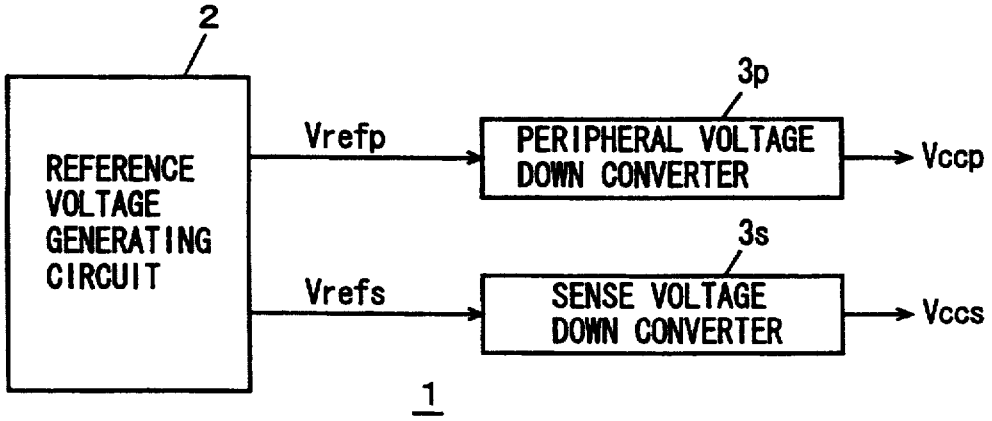
FIG. 5 shows a structure of a main portion of a semiconductor memory device according to an embodiment 2 of the invention.

FIG. 5 shows a structure of a main portion of a semiconductor memory device according to an embodiment 2 of the invention. FIG. 5 schematically shows a structure of the internal power supply circuit 1 shown in FIG. 1. In internal power supply circuit 1 shown in FIG. 5, a peripheral voltage down converter 3*p* producing peripheral power supply voltage Vccp and a sense voltage down converter 3*s* producing sense power supply voltage Vccs are supplied with peripheral reference voltages (i.e., reference voltage for peripheral circuits) Vrefp and Vrefs commonly from reference voltage generating circuit 2. Since single reference voltage generating circuit 2 is used for producing peripheral reference voltage Vrefp and sense reference voltage Vrefs, a circuit occupation area and a current consumption can be reduced. Further, reference voltages Vrefp and Vrefs can have the same temperature characteristics, and the temperature characteristics and voltage levels of internal power supply voltages Vccp and Vccs can be held constant over a wide temperature range so that the internal circuits (peripheral circuits and sense amplifier circuit) can operate stably.

Figure 6:
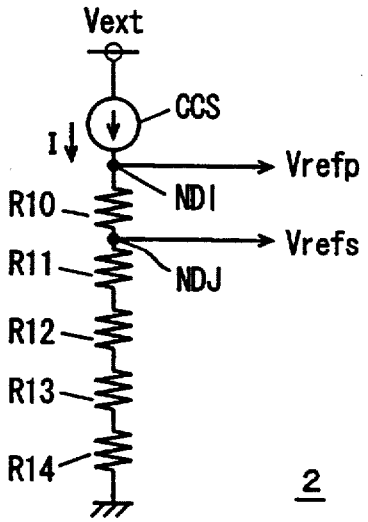
FIG. 6 shows a structure of a reference voltage generating circuit shown in FIG. 5.

FIG. 6 shows a structure of reference voltage generating circuit 2 shown in FIG. 5. In FIG. 6, reference voltage generating circuit 2 includes a constant current source CCS which is connected between an external power supply node and a node NDI and supplies a constant current I, and resistance elements R10–R14 connected in series between node NDI and the ground node. Peripheral reference voltage Vref is generated from node NDI between constant current source CCS and resistance element R10, and sense reference voltage Vrefs is generated from a node NDJ between resistance elements R10 and R11. Reference voltages Vrefp and Vrefs are expressed by the following equations;

$$Vrefp=I\cdot 5\cdot R$$

$$Vrefs=I\cdot 4\cdot R$$

where R represents a resistance value of each of resistance elements R10–R14. Accordingly, reference voltages Vrefp and Vrefs satisfy the following relationship:

$$Vrefs=4Vrefp/5$$

Accordingly, a constant relationship can be maintained between these reference voltages Vrefp and Vrefs over the whole temperature range. Since peripheral power supply voltage Vccp and sense power supply voltage Vccs are produced in accordance with reference voltages Vrefp and Vrefs, these internal power supply voltages Vccp and Vccs likewise maintain a constant relationship over the whole temperature range, and the semiconductor memory device can operate stably. If the ratio in this relationship shifts from a constant value, changes occur, e.g., in operation speed and operating margin of the circuit portion of the peripheral circuit for performing writing/reading of the memory cell data, and a timing mismatch between the sense start timing and column select timing occurs so that a stable operation of the internal circuits cannot be ensured.

Figure 7:
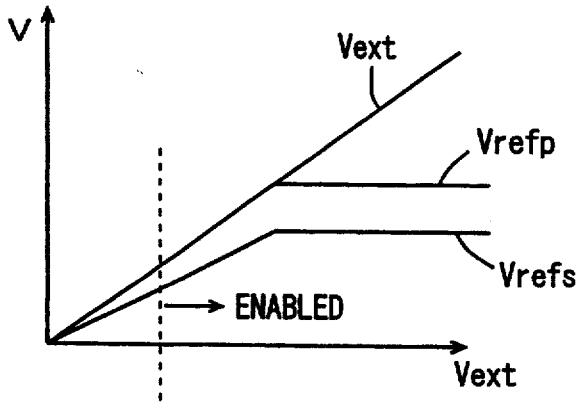
FIG. 7 shows external voltage dependency of a reference voltage supplied from the reference voltage generating circuit shown in FIG. 6.

FIG. 7 shows a relationship between the external power supply voltage and the reference voltage. In FIG. 7, as external power supply voltage Vext rises, the voltage levels of reference voltages Vrefp and Vrefs rise. After constant current source CCS starts to supply current I, the ratio of magnitudes of reference voltages Vrefp and Vrefs become a constant ratio of 4/5. Therefore, even if external power supply voltage Vext is low, the internal operation can be started when the MOS transistors the internal circuit components are enabled. Therefore, the operating margin of the semiconductor memory device in the lower side region of external power supply voltage Vext can be improved.

Since the resistance elements connected in series are used for producing peripheral reference voltage Vrefp and sense reference voltage Vrefs, the peripheral reference voltage Vrefp can always be held at the voltage level exceeding sense reference voltage Vrefs. Compared with the case where independent reference voltage generating circuits are used for producing these reference voltages, respectively, the values of these voltages can be adjusted more easily. More specifically, by adjusting the voltage level of peripheral reference voltage Vrefp, the voltage level of sense reference voltage Vrefs is automatically and correspondingly adjusted.

In the above structure, reference voltages Vrefp and Vrefs may have a relationship of 5:3 in magnitude.

Figure 8:
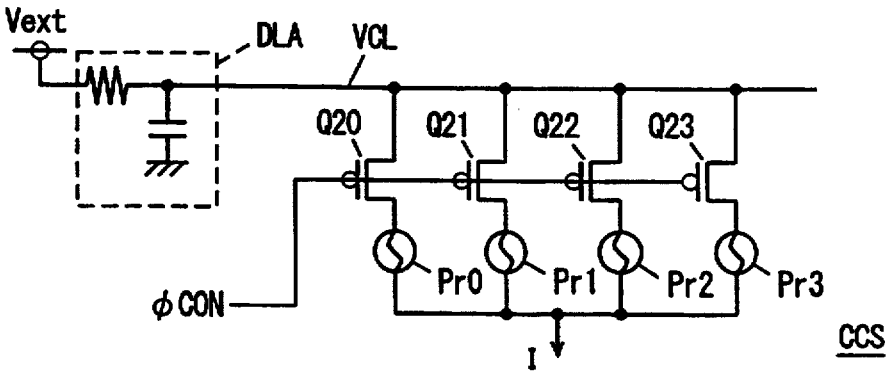
FIG. 8 shows a structure of a constant current source shown in FIG. 6.

FIG. 8 shows an example of a structure of constant current source CCS shown in FIG. 6. In FIG. 8, constant current source CCS includes p channel MOS transistors Q20–Q23 which are connected in parallel to a power supply line VCL transmitting external power supply voltage Vext and each receive on its gate a bias voltage ϕCOM, and program elements Pr0–Pr3 which are connected in series to MOS transistors Q20–Q23, respectively. Program elements Pr0–Pr3 are commonly connected to an output node. Power supply line VCL is also provided with a delay circuit DLA, which in turn functions as a low pass filter for preventing a rapid change in voltage on power supply line VCL at the time of, e.g., power-on. Delay circuit DIA is formed of a resistance and a capacitor.

Program elements Pr0–Pr3 are formed of switching transistors, fuse elements or combinations thereof. In a test step, the voltage level of reference voltage Vrefp is measured, and program elements Pr0–Pr3 are programmed (e.g., by blowing fuses, if employed) to set the voltage level to the optimum or designed value.

Bias voltage ϕCON is generated from a circuit having a structure similar to those of the constant current generating portions included in voltage generating circuits 2*a* and 2*b* shown in FIG. 2, and is in level equal to the voltage supplied to the gate of transistor Q5. MOS transistors Q20–Q23 have the same size and the same current supply capability. By programming (selectively connecting and disconnecting) program elements Pr0–Pr3, current I supplied from constant current source CCS can be set to the optimum value. If the voltage difference between external power supply voltage Vext and bias voltage ϕCON exceeds the absolute values of the threshold voltages of MOS transistors Q20–Q23, constant current source CCS operates to supply constant current I.

When current I flows, reference voltages Vrefp and Vrefs change while keeping a constant ratio in magnitude. Reference voltage Vrefp and Vrefs changes in accordance with external power supply voltage Vext as shown in FIG. 7, and this change occurs because bias voltage ϕCON changes in accordance with rising of the voltage level of external power supply voltage Vext (see the structure of the voltage generating circuit in FIG. 2).

Thus, reference voltages Vrefp and Vrefs at the desired levels can be easily produced, and the steps for trimming the voltage levels of these reference voltages can be simplified.

In the above description, resistance elements R10–R14 have the same resistance value. However, resistance elements R10–R14 may have different resistance values, so that the ratio between reference voltages Vrefp and Vrefs can be arbitrarily set.

[Modification]

Figure 9:
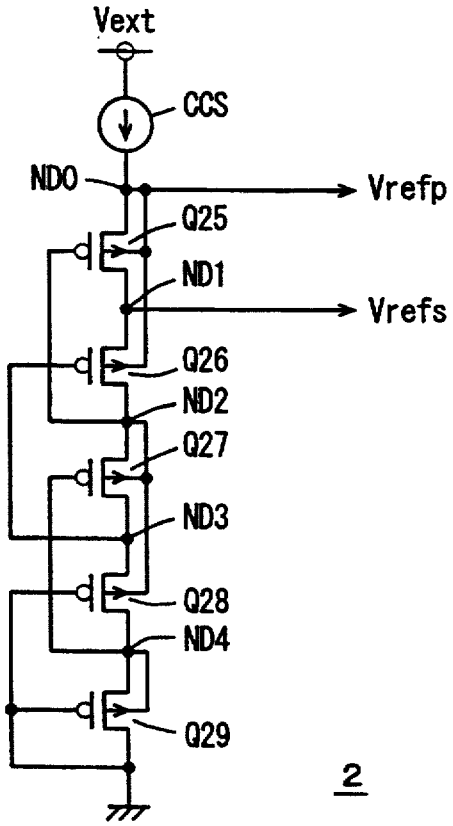
FIG. 9 shows a structure of a modification of the reference voltage generating circuit shown in FIG. 5.

FIG. 9 shows a modification of the embodiment 2 of the invention. In FIG. 9, reference voltage generating circuit 2 includes constant current source CCS connected between the external power supply node and a node ND0, and p channel MOS transistors Q25–Q29 which are connected in series between node ND0 and the ground node and have the same size and the same threshold voltage. These MOS transistors Q25–Q29 each have a gate, (except for the gate of transistor Q29 connected to the ground node) connected to a drain with one transistor interposed in this selial connection. Thus, the gate of MOS transistor Q25 is connected to a node ND2 between MOS transistors Q26 and Q27, and the gate of MOS transistor Q26 is connected to a node ND3 between MOS transistors Q27 and Q28. The gate of MOS transistor Q27 is connected to a node ND4 between MOS transistors Q28 and Q29. The gate of MOS transistor Q29 is connected to the ground node.

The back gates (substrate regions) of MOS transistors Q25–Q29 are connected to the connection nodes such that these MOS transistors are grouped into pairs and the back gates of the two transistors in each pair are commonly connected to a source node at a higher potential of the MOS transistors. More specifically, the back gates of MOS transistors Q25 and Q26 are connected to node ND0, and the back gates of MOS transistors Q27 and Q28 are connected to node ND2. The back gate of MOS transistor Q29 is connected to node ND4. Operation will now be described below.

Before power-on, all nodes ND0–ND4 are at the ground voltage level of L-level. When the power is on and the voltage level of external power supply voltage Vext rises, constant current source CCS first supplies the current so that the voltage level on node ND0 rises. When the voltage level on node ND0 increases to or above the absolute value of threshold voltage of MOS transistor Q25, MOS transistor Q25 is turned on to supply the current to node ND1 while MOS transistor Q26 is still off and connection node ND2 is at the ground voltage level. When the voltage level on node ND1 exceeds the absolute value of threshold voltage of MOS transistor Q26, MOS transistor Q26 is turned on. The current is then supplied to node ND2. When the voltage level on node ND2 exceeds the absolute value of threshold voltage of MOS transistor Q27, MOS transistor Q27 is turned on to supply the current to node ND3. At this time, node ND0 must be at the voltage level of 2·Vthp or higher for turning on MOS transistor Q25, where Vthp is an absolute value of threshold voltage of each of MOS transistors Q25–Q29.

When the voltage level on node ND3 exceeds the absolute value of threshold voltage of MOS transistor Q28, MOS transistor Q28 is turned on to supply the current to node ND4. When the voltage level on node ND4 exceeds the absolute value of threshold voltage of MOS transistor Q29, MOS transistor Q29 is turned on so that a current path from node ND0 to the ground node is formed.

In the structure of reference voltage generating circuit 2 shown in FIG. 9, therefore, all MOS transistors Q25–Q29 are turned on when the voltage across the succcessive three nodes among four nodes ND0–ND4 exceeds the absolute values of threshold voltages of MOS transistors Q25–Q29. If the voltage on node ND0 is at least 3·Vthp, this circuit can operate (a voltage across two adjacent MOS transistors is 2·Vthp). After MOS transistors Q25–Q29 are turned on, the voltage levels of reference voltages Vrefp and Vrefs are determined depending on channel resistances of MOS transistors Q25–Q29. In this case, all MOS transistors Q25–Q29 operate in the same operation region, and provide the substantially equal channel resistance so that reference voltages Vrefp and Vrefs satisfy the following relationship:

$$Vrefp=4\cdot Vrefs/5$$

The reason for which MOS transistors Q25–Q29 operate in the same operation region is as follows. The gate of each of MOS transistors Q25–Q29 is connected to the connection node spaced by an adjacent transistor. Therefore, the gate-source voltage of each of MOS transistors Q25–Q28 is equal to the voltage lowered by two MOS transistors (and the gate-source voltage of MOS transistor Q29 is equal to the voltage lowered by MOS transistor Q29). Meanwhile, the back gates of MOS transistors Q25–Q28 are grouped into units each including two adjacent MOS transistors, and each of the back gates are interconnected to the other back gate in the same unit. The back gates in each unit are commonly connected to an adjacent connection node at a higher potential. As for the back gate bias, an influence of voltage drop in one MOS transistor at most is exerted on the pair of adjacent transistors. Meanwhile, the back gate bias effect is determined by a function of a square root of an absolute value of a voltage VBS of the back gate based on the source, and therefore is sufficiently small. Accordingly, MOS transistors Q25–Q29 can operate in substantially the same operation region, and can be set to provide the substantially equal channel resistance for voltage dividing the reference voltage Vrefp to produce sense reference voltage Vrefs.

In the structure employing the diode-connected MOS transistors as the resistance elements, all the diode-connected MOS transistors must be turned on, and therefore the lower limit of the reference voltage is determined depending on the threshold voltage. For example, if all MOS transistors Q25–Q29 in FIG. 9 are diode-connected, lowering of the absolute value of the threshold voltage is required in MOS transistors Q25–Q29, so that the lower limit of peripheral reference voltage Vrefp becomes equal to 5·Vthp. By using the structure shown in FIG. 9, the lower limit of peripheral reference voltage Vrefp can be reduced to a sufficiently small value of 3·Vthp so that reference voltages Vrefp and Vrefs can be stably produced even with a low power supply voltage.

In a structure wherein all the gates of MOS transistors Q25–Q29 are connected to the ground voltage and the back gates of MOS transistors Q25–Q29 are connected to node ND0, the gate-source voltage of each of MOS transistors Q25–Q29 is different from those of the others, and the back gate effect of each MOS transistor is different from those of the others. Therefore, it is impossible to operate all MOS transistors Q25–Q29 under the same operation condition. The channel resistances of MOS transistors Q25–Q29 are different from each other, and it is impossible to voltage-divide accurately peripheral reference voltage Vrefp with an intended ratio (integer ratio) for producing sense reference voltage Vrefs. However, by utilizing the structure shown in FIG. 9, it is possible to produce reference voltages Vrefp and Vrefs accurately providing a predetermined integer ratio of m/n, and reference voltages Vrefp and Vrefs at the desired voltage levels can be stably and easily produced even with a low power supply voltage.

In the structure of reference voltage generating circuit 2 shown in FIG. 9, the reference voltage can be supplied from node ND2, whereby the reference voltage of 3·Vrefp/5 can be produced.

[Application to Another Usage]

Figure 10:
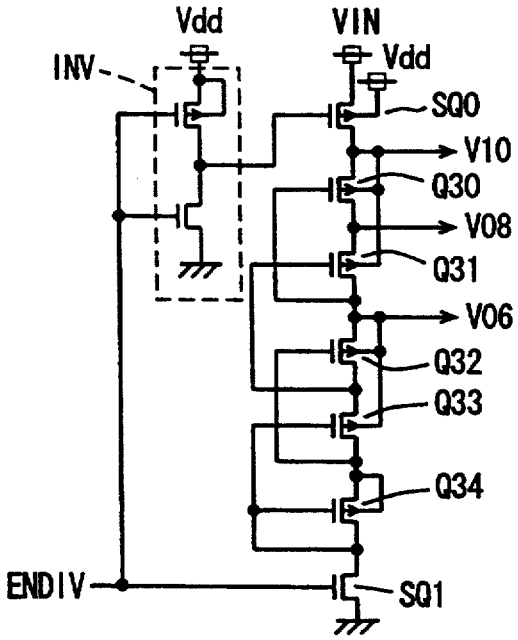
FIG. 10 shows a structure of a voltage dividing circuit in accordance with the embodiment 2 of the invention.

FIG. 10 shows an example in which the reference voltage generating circuit of the embodiment 2 of the invention is applied to another usage. FIG. 10 shows a structure of a voltage dividing circuit which voltage-divides an input voltage VIN when an activating signal ENDIV is active. The voltage dividing circuit shown in FIG. 10 includes a CMOS inverter INV which inverts activating signal ENDIV, a p channel MOS transistor SQO which is turned on to transmit internal voltage INV when the output signal of inverter INV is at L-level, an n channel MOS transistor SQ1 which is turned on to form a current path in the voltage-dividing circuit when activating signal ENDIV is active, and p channel MOS transistors Q30–Q34 which are connected in series between MOS transistors SQ0 and SQ1. Each of MOS transistors Q30–Q34 has a gate connected to the connection node spaced by one adjacent transistor, and back gates in each unit including adjacent two MOS transistors are connected to a connection node at a higher potential for the unit. The configuration of MOS transistors Q30–Q34 are the same as that of MOS transistors Q25–Q29 shown in FIG. 9. A voltage V10 is generated from the node between MOS transistors SQ0 and Q30, and a voltage V08 is generated from the connection node between MOS transistors Q30 and Q31. A voltage V06 is generated from the connection node between MOS transistors Q31 and Q32. Now, operation of the voltage dividing circuit shown in FIG. 10 will be described below with reference to a voltage waveform diagram of FIG. 11.

When activating signal ENDIV is at L-level, MOS transistors SQ0 and SQ1 are off, and each node in this voltage-dividing circuit is electrically floated at the ground voltage level. When activating signal ENDIV attains H-level, MOS transistors SQ0 and SQ1 are turned on, and a current path from the voltage input node to the ground node is formed. When input voltage VIN is at the ground voltage level, voltages V10, V08 and V06 are also at the ground voltage level. When the voltage level of input voltage VIN rises to or above a value which is three times larger than the absolute value of the threshold voltage of each of MOS transistors Q30–Q34, a current flows through MOS transistors Q30–Q34, and the voltage levels of voltages V10, V08 and V06 rise.

Figure 11:
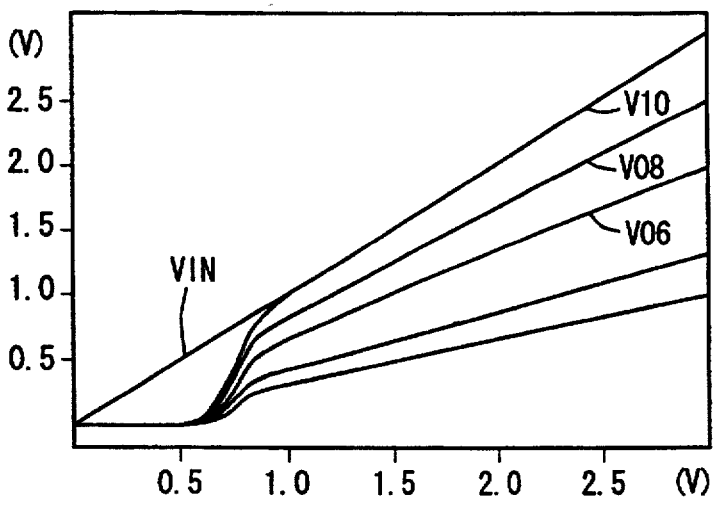
FIG. 11 shows a relationship between the output and input voltages of the voltage dividing circuit shown in FIG. 10.

FIG. 11 shows a state where input voltage VIN is about 0.6 V, and the voltage levels of voltages V10, V08 and V06 start to rise. When all MOS transistors Q30–Q34 are turned on, switching transistor SQ0 transmits input voltage VIN without a loss of threshold voltage so that voltage V10 becomes equal to input voltage VIN. Also, voltage V08 attains the voltage level of 4·V10/5, and voltage V06 attains the voltage level of 3·V10/5. Thereafter, the voltage levels of voltages V10, V08 and V06 rise as the voltage level of input voltage VIN rises. Accordingly, the voltage having a predetermined ratio can be produced over a wide range of input voltage. Since the MOS transistors are used instead of the resistance elements, an area occupied by the components can be significantly reduced.

A voltage Vdd in the voltage dividing circuit shown in FIG. 10 may be internal power supply voltage Vcc or external power supply voltage Vext. By using the voltage dividing circuit, operations such as measurement of the operating margin can be performed with a divided voltage supplied from the voltage dividing circuit, e.g., in a test operation mode.

In the structures shown in FIGS. 9 and 10, the resistance MOS transistors for voltage dividing are five in number. This number is determined depending on the ratio between peripheral reference voltage Vrefp and sense reference voltage Vrefs in the semiconductor memory device. Accordingly, the resistance MOS transistors for voltage dividing may be five or more in number, and an appropriate number n is selected depending on the voltage division ratio m/n.

EMBODIMENT 3

Figure 12:
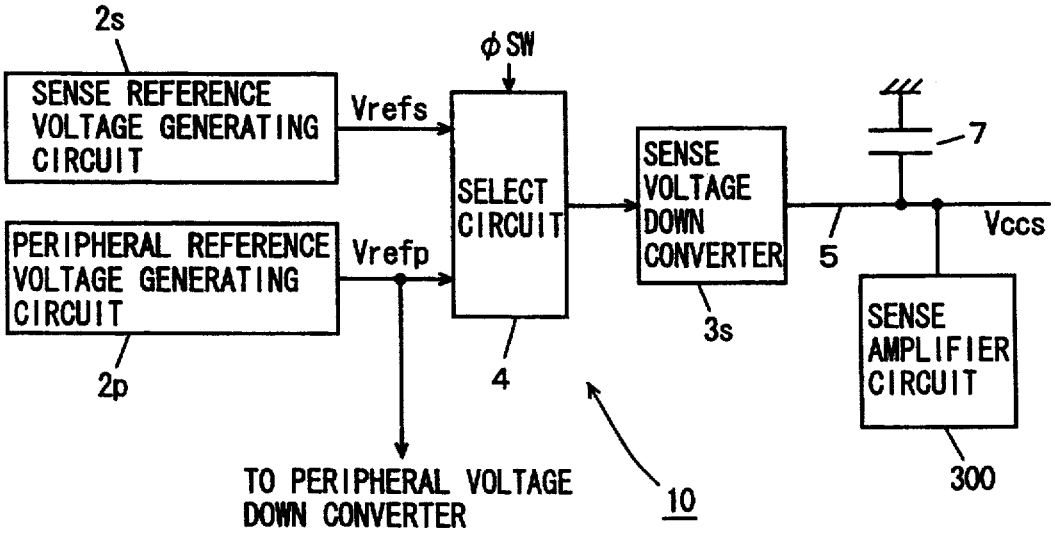
FIG. 12 schematically shows a structure of a main portion of a semiconductor memory device according to an embodiment 3 of the invention.

FIG. 12 schematically shows a structure of a main portion of a semiconductor memory device according to an embodiment 3 of the invention. FIG. 12 shows the structure of a sense power supply circuit for transmitting sense power supply voltage Vccs to a sense amplifier circuit 300. In FIG. 12, the sense power supply circuit includes a sense reference voltage generating circuit 2*s* generating sense reference voltage Vrefs, a peripheral reference voltage generating circuit 2*p* generating peripheral reference voltage Vrefp, a select circuit 4 for selecting one of reference voltages Vrefs and Vrefp in response to a switch signal ϕSW, and a sense voltage down converter 3*s* performing a voltage down-converting operation to produce sense power supply voltage Vccs in accordance with the selected reference voltage from select circuit 4. Sense reference voltage generating circuit 2*s* and peripheral reference voltage generating circuit 2*p* may be independent of each other, or may be provided in a single circuit as is done in the foregoing embodiment 2. It is required only to produce reference voltage Vrefs for sense power supply voltage Vccs and reference voltage Vrefp for peripheral power supply voltage Vccp.

A stabilizing capacitance 7 is arranged at a sense power supply line 5 transmitting sense power supply voltage Vccs from sense voltage down converter 3*s*. Charges accumulated in stabilizing capacitance 7 are utilized to compensate for lowering of sense power supply voltage Vccs caused by charge/discharge current consumption of sense amplifier circuit 300.

Figure 13:
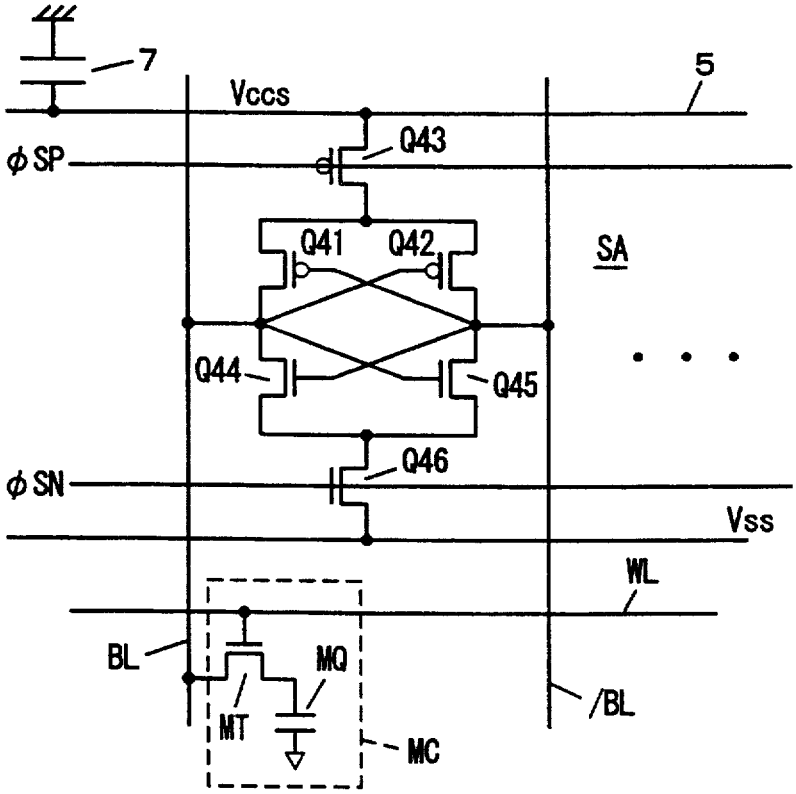
FIG. 13 shows a structure of a sense amplifier circuit shown in FIG. 12.

FIG. 13 shows a structure of sense amplifier circuit 300 shown in FIG. 12. FIG. 13 shows a structure of a portion including sense amplifier SA provided corresponding to one bit line pair. Sense amplifier SA includes p channel MOS transistors Q41 and Q42 having gates and drains cross-coupled, a p channel MOS transistor Q43 transmitting sense power supply voltage Vccs on sense power supply line 5 to the sources of MOS transistors Q41 and Q42, n channel MOS transistors Q44 and Q45 having gates and drains cross-coupled, and an n channel MOS transistor Q46 made turned on in response to activation of a sense amplifier activating signal ϕSN to transmit ground voltage Vss on the ground line to the sources of MOS transistors Q44 and Q45. The drains of MOS transistors Q41 and Q44 are connected to a bit line BL, and the drains of MOS transistors Q42 and Q45 are connected to a bit line /BL.

Word lines WL are arranged in a direction crossing bit lines BL and /BL. Memory cells MC are arranged corresponding to crossings between word lines WL and bit lines BL, respectively. Memory cell MC includes a memory cell capacitor MQ storing information, and an n channel MOS transistor (access transistor) MT made conductive to connect memory cell capacitor MQ to bit line BL in response to the signal potential on word line WL.

In sense amplifier SA, the differential amplifier circuit formed of MOS transistors Q41, Q42, Q44 and Q45 operates when sense amplifier activating signals ϕSP and ϕSN are activated. Thereby, one of bit lines BL and /BL at a higher potential is driven to the level of sense power supply voltage Vccs, and the other at a lower potential is discharged to the ground voltage level. In operation of sense amplifier SA, sense power supply voltage Vccs on sense power supply line 5 is consumed. The level lowering of sense power supply voltage Vccs on sense power supply line 5 is compensated for by charges accumulated in stabilizing capacitance 7, and the sense amplifier is operated fast and stably. Now, operation of the circuits shown in FIGS. 12 and 13 will be described below with reference to a signal waveform diagram of FIG. 14.

Figure 14:
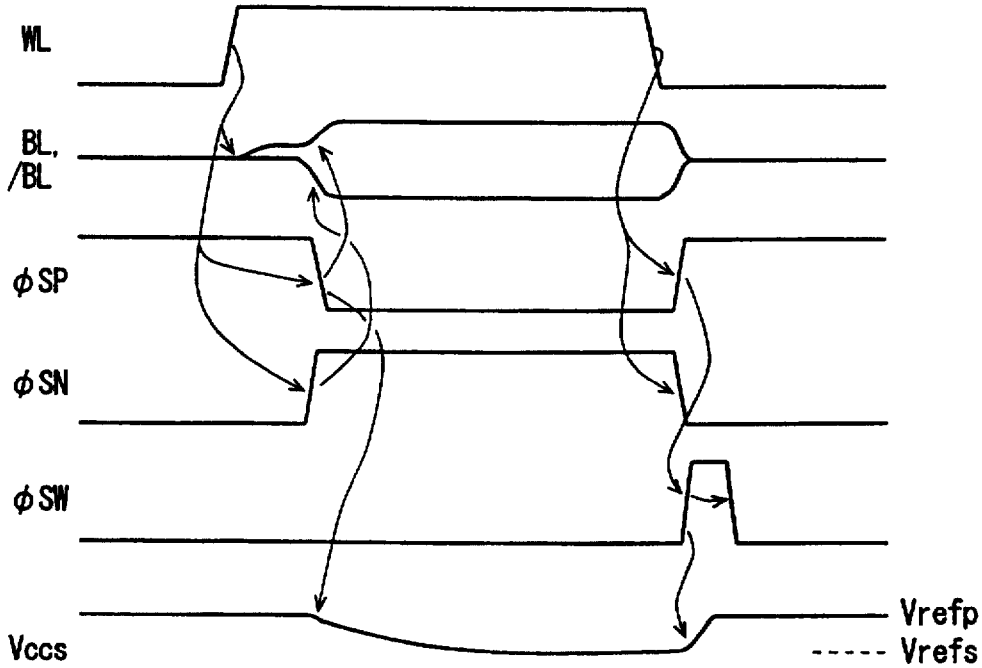
FIG. 14 is a signal waveform diagram representing an operation of the circuit shown in FIG. 12.

During standby, word line WL is not selected, and sense amplifier activating signals ϕSP and ϕSN are inactive. In this state, capacitance 7 is charged at the level of peripheral power supply voltage Vccp determined by peripheral reference voltage Vrefp. In FIG. 14, peripheral power supply voltage Vccp is equal to peripheral reference voltage Vrefp.

When word line WL is selected and its voltage level rises, the access transistor MT in memory cell MC is turned on. Memory capacitor MQ and bit line BL are electrically coupled via access transistor MT. Charges move between bit line BL and memory capacitor MQ. This movement of charges changes the voltage on bit line BL which has been electrically floated at the level of intermediate voltage of Vccs/2. FIG. 14 shows signal waveforms in the case where data of H-level is read onto bit line BL. Bit line /BL is not connected to a selected memory cell, and maintains the voltage level of intermediate voltage of Vccs/2.

Then, sense amplifier activating signal ϕSN attains the active state of L-level, and MOS transistors Q44 and Q45 included in sense amplifier SA perform differential amplification to lower the voltage level on bit line /BL to the ground voltage level. Sense amplifier activating signal ϕSP is activated with a slight delay, and MOS transistors Q41 and Q42 drive the voltage level on bit line BL to the level of sense power supply voltage Vccs.

In the sensing operation, sense voltage down converter 3*s* operates to hold voltage Vccs on sense power supply line 5 at the sense reference voltage level. In the sense operation, charges accumulated in stabilizing capacitance 7 are consumed. Accordingly, the power supply voltage on sense power supply line 5 is prevented from lowering to or below the voltage level determined by sense reference voltage Vrefs, although it lowers from the level of reference voltage Vrefp after start of the sensing operation. Thereby, MOS transistors Q41 and Q42 in sense amplifier SA perform fast sensing operation. Since the voltage level of sense power supply voltage Vccs, which is applied via MOS transistor Q43, is suppressed from lowering at the time of start of the sensing operation, MOS transistors Q41 and Q42 can accurately perform the sense operation in accordance with the voltage levels on bit lines BL and /BL. When sense amplifier SA completes the sensing operation and enters the latching state, the current is hardly consumed, and the sense voltage down converter 3*s* holds the sense power supply voltage Vccs on sense power supply line 5 at the voltage level determines by reference voltage Vrefs. In this case, the voltage on sense power supply line 5 is consumed by a leak current.

When the memory cycle is completed, word line WL has a potential fallen to L-level and enters the unselected state, and sense amplifier activating signals ϕSP and ϕSN are driven to the inactive state. In response to deactivation of sense amplifier activating signal ϕSP, switch signal ϕSW is driven to keep H-level for a predetermined period, and select circuit 4 shown in FIG. 12 selects peripheral reference voltage Vrefp supplied from peripheral reference voltage generating circuit 2*p*, and applies the same to sense voltage down converter 3s instead of sense reference voltage Vrefs supplied from peripheral reference voltage generating circuit 2p. Thereby, the charged voltage levels of sense power supply line 5 and stabilizing capacitance 7 are restored to the voltage levels determined by peripheral reference voltage Vrefp. Thereafter, sense switch signal ϕSW attains the inactive state of L-level, whereby select circuit 4 selects sense reference voltage Vrefs and applies the same to sense voltage down converter 3s. During this period, stabilizing capacitance 7 holds sense power supply line 5 substantially at the level of peripheral power supply voltage Vccp.

As shown in FIGS. 12 and 13, the sense power supply line is charged to the level higher than the sense power supply voltage level before start of the sensing operation, whereby sense power supply voltage Vccs has its voltage level lowering caused by a large sensing current flowing in the sensing operation compensated for, and therefore the sensing operation can be stably performed.

Generally, sense voltage down converter 3s is required to have a relatively large current drive capability, and is not required to have a fast responsibility. Owing to provision of stabilizing capacitance 7, it is possible to suppress rapid lowering of sense power supply voltage Vccs at the time of start of the sensing operation. Stabilizing capacitance 7 is required to have a capacitance value merely allowing compensation for consumption of charges by the charge current in sense amplifier circuit 300 (sense amplifier SA). For example, in the structure where a selected word line WL is connected to bit line pairs of 1K in number, sense amplifier circuit 300 must charge the 1K bit lines. In this structure, the largest charge current flows when all the memory cells connected to the selected word line hold data at L-level. Bit line voltage amplitude is equal to Vccs/2. Therefore, the maximum value of capacitance value C of stabilizing capacitance 7 can be expressed by the following formula, where Cb represents the bit line capacitance:

$$C=Cb\cdot 1K\cdot Vccs/2\cdot(Vcc-Vccs)$$

In view of variations in the manufacturing process, the capacitance value of stabilizing capacitance 7 is generally set to a slightly large value with a margin accounted for. Therefore, if the capacitance value of stabilizing capacitance 7 is unnecessarily large, stabilizing capacitance 7 occupies a large area. Description will now be given on a manner for forming stabilizing capacitance 7 having a lowest required capacity value with a margin.

Figure 15:
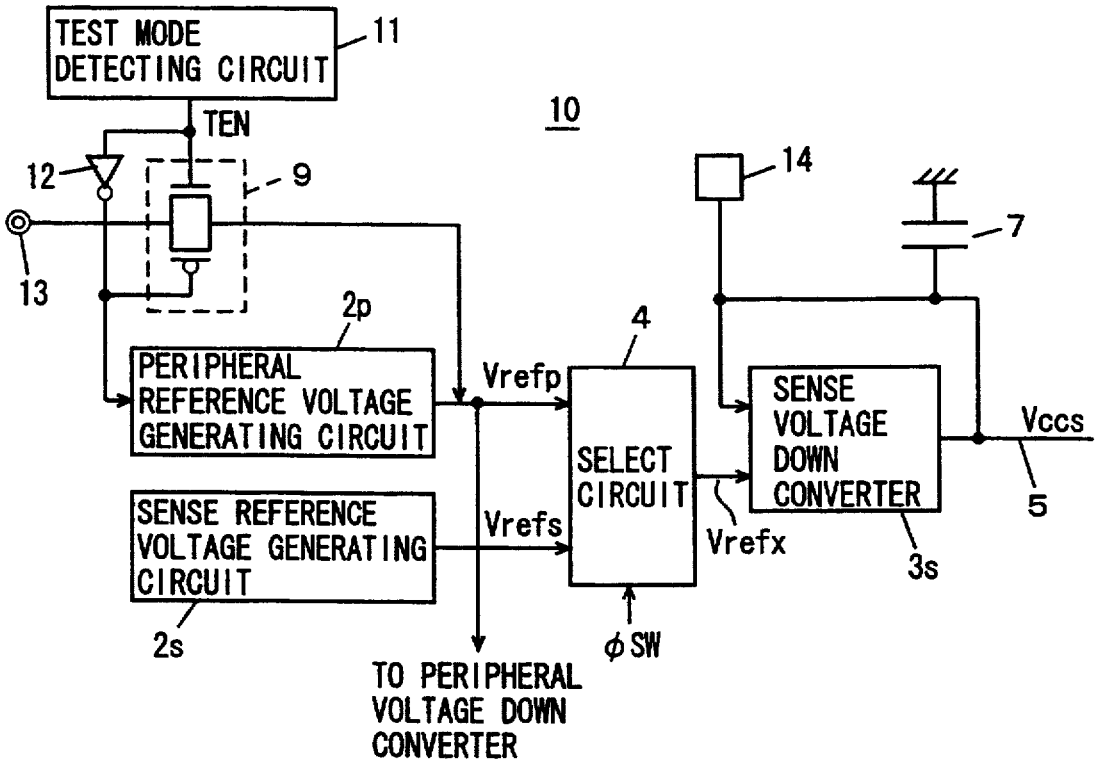
FIG. 15 shows more specifically the structure of the semiconductor memory device according to the embodiment 3 of the invention.

FIG. 15 shows a structure of a main portion of a semiconductor memory device according to an embodiment 3 of the invention. The arrangement shown in FIG. 15 included a test mode detecting circuit 11 which operates in accordance with an externally supplied signal to determine whether a test mode is instructed or not, an inverter 12 which inverts a test mode instructing signal TEN from test mode detecting circuit 11, and a transfer gate 9 which operates in accordance with the output signal of inverter 12 and test mode instructing signal TEN from test mode detecting circuit 11 to connect a pad (or an external terminal) 13 to the output of peripheral reference voltage generating circuit 2p.

The output signal of inverter 12 is applied to peripheral reference voltage generating circuit 2p, and stops the reference voltage generating operation of peripheral reference voltage generating circuit 2p when made active. For sense power supply line 5, there is arranged a monitoring dedicated pad 14 for allowing external monitoring of the voltage on sense power supply line 5. Transfer gate 9, test mode detecting circuit 11, selection circuit 4, stabilizer circuit 7 and pad 14 are included in voltage level control circuit 10 shown in FIG. 1. Now, operation of the structure shown in FIG. 15 will be described below.

In the normal operation mode, test mode instructing signal TEN is inactive at L-level, transfer gate 9 is off, and peripheral reference voltage generating circuit 2p is active. In this state, select circuit 4 selects one of peripheral reference voltage Vrefp from peripheral reference voltage generating circuit 2p and sense reference voltage Vrefs from sense reference voltage generating circuit 2s, and applies the selected voltage as a reference voltage Vrefx to sense voltage down converter 3s.

In the test mode, an externally supplied signal instructs the test mode so that test mode detecting circuit 11 drives test mode instructing signal TEN to the active state of H-level. Responsively, transfer gate 9 is turned on, and the output node of peripheral reference voltage generating circuit 2p is electrically connected to pad 13. Peripheral reference voltage generating circuit 2p is deactivated by a complementary test mode instructing signal applied through inverter 12, and stops the reference voltage generating operation. The voltage level of peripheral reference voltage Vrefp is externally and forcedly set through this pad or external pin terminal (referred to merely as a "pad") 13. In this state, the voltage level of peripheral reference voltage Vrefp is set to an optimum value which is determined, for example, in view of an access time and a timing margin. During the above operation, the voltage level of sense power supply voltage Vccs on sense power supply line 5 is externally monitored via pad 14, and change in voltage level in the sensing operation is externally monitored. During this period, stabilizing capacitance 7 is connected to sense power supply line 5. The optimum value of peripheral reference voltage Vrefp is determined such that the peripheral circuits can operate fast and the voltage level of sense power supply voltage Vccs on sense power supply line 5 may not significantly lower (i.e., may not lower below the voltage level determined by reference voltage Vrefs).

Once the optimum value of peripheral reference voltage Vrefp is determined, the optimum value of the capacity value of stabilizing capacitance 7 is determined such that (Vrefp−Vrefs)·C takes a constant value (i.e., value Q equal to the total quantity of changes utilized for charging the bit lines during the operation of sense amplifier). For providing the stabilizing capacitance 7 having the capacity value of the optimum value, the capacity value of stabilizing capacitance 7 is adjusted, for example, in a step of test design or mask revision for a new generation.

The optimum value of capacity value C of stabilizing capacitance 7 is derived from a relationship that (Vrefp−Vrefs)·C is constant. This represents that, in the sensing operation, the electric charges charged in stabilizing capacitance 7 are fully consumed and, in this case, sense power supply voltage Vccs on sense power supply line 5 becomes equal to the voltage level determined by reference voltage Vrefs. In the sense operation, charges are supplied also from sense voltage down converter 3s so that the capacitance value of stabilizing capacitance 7 can be further decreased. In this case, a change in voltage on sense power supply line 5 may be externally monitored via monitor pad 14, and a change in sense power supply voltage Vccs may be monitored for determining the optimum value of the capacitance value. More specifically, sense voltage down converter 3s and selection circuit 4 are operated, and the change in sense power supply voltage Vccs during the sensing operation is externally monitored via monitor pad 14, and an excessive or insufficient quantity of charges is determined from the monitored voltage waveform. Then, the capacitance value of stabilizing capacitance 7 is determined to compensate for the excessive or insufficient quantity of changes determined (assuming that the lowest voltage on sense power supply line 5 is equal to Vrefs).

Figure 16:
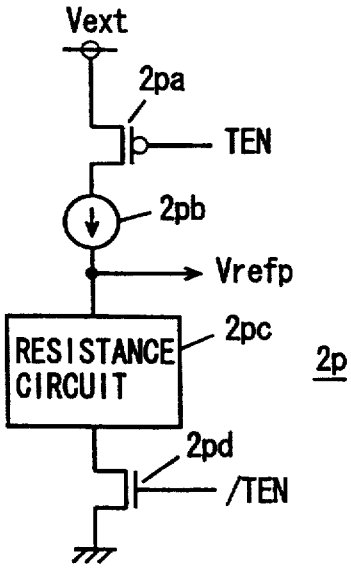
FIG. 16 shows a structure of the peripheral reference voltage generating circuit shown in FIG. 15.

FIG. 16 schematically shows a structure of reference voltage generating circuit 2*p* shown in FIG. 15. In FIG. 16, peripheral reference voltage generating circuit 2*p* includes a p channel MOS transistor 2*pa* which is turned on to transmit external power supply voltage Vext when test mode instructing signal TEN is inactive, a constant current source 2*pb* which is coupled to the external power supply node via MOS transistor pa and supplies a constant current, a resistance circuit 2*pc* which converts the current supplied from constant current source 2*pb* into a voltage, and an n channel MOS transistor 2*pd* which is turned on to couple resistance circuit 2*pc* to the ground node when a test mode instructing signal /TEN is inactive. Resistance circuit 2*pc* may be formed of either the polycrystalline silicon resistance element or the resistance element formed of an MOS transistor already described in connection with the embodiment 2.

In the structure of peripheral reference voltage generating circuit 2*p* shown in FIG. 16, MOS transistors 2*pa* and 2*pb* are turned on when test mode instructing signal TEN is inactive so that a current path from the external power supply node to the ground node is formed, and peripheral reference voltage Vrefp according to the resistance value of resistance circuit 2*pc* is produced.

When the optimum value of peripheral reference voltage Vrefp is determined, the resistance value of resistance circuit 2*pc* or the current value of the constant current source may be trimmed in accordance with the optimum value by employing an appropriate structure. The trimming of the resistance value can be performed with fuse elements or the like.

By utilizing peripheral reference voltage generating circuit 2*p* shown in FIG. 16, peripheral reference voltage generating circuit 2*p* can be set to an output high impedance state during the test mode.

Pad 13 may be a pad which is dedicated to external application of the peripheral reference voltage for optimizing stabilizing capacitance 7, and is not coupled to an external pin terminal.

Pad 14 for monitoring is always coupled to sense power supply line 5 so that a parasitic capacitance of pad 14, which exerts an influence on change in sense power supply voltage Vccs on sense power supply line 5 during monitoring of the voltage on power supply line 5, may likewise exert the influence even during the normal operation.

In the above description, the optimum value of peripheral reference voltage Vrefp is determined in view of the operating margin and operation speed of the peripheral circuit and change in sense power supply voltage Vccs on sense power supply line 5. However, such a method may be employed that the optimum value of peripheral reference voltage Vrefp is determined to optimize the operation characteristics of the peripheral circuit, and the capacitance value of stabilizing capacitance 7 is determined only from a relationship to sense power supply voltage Vccs in accordance with the determined optimum value.

[Modification 1]

Figure 17:
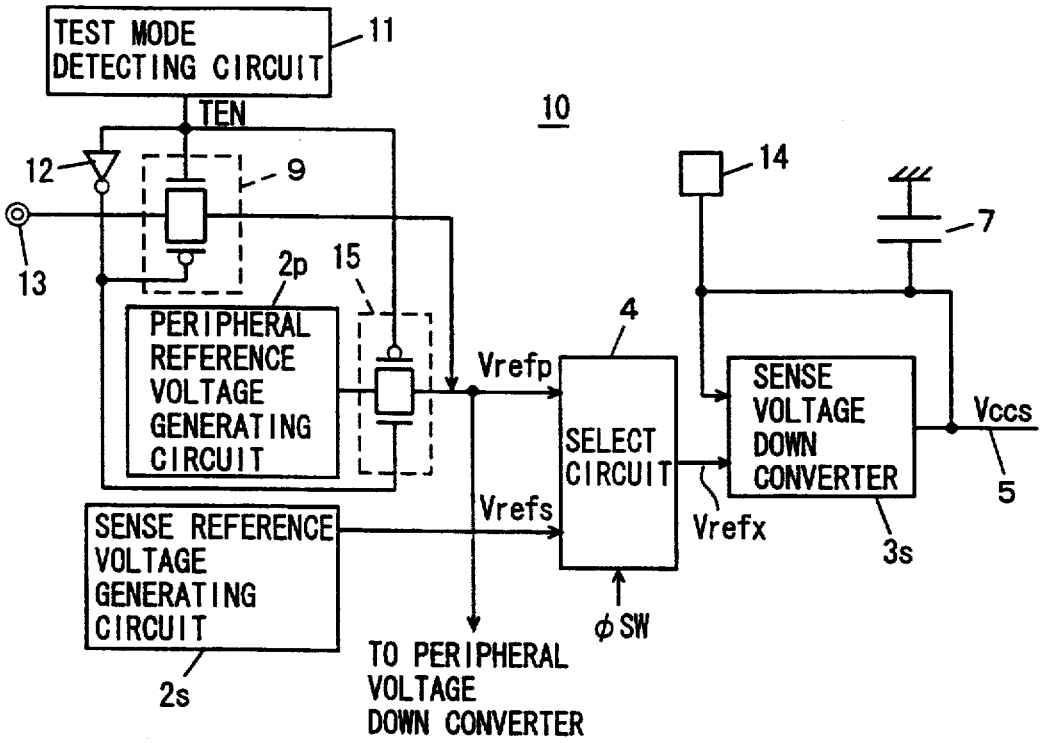
FIG. 17 schematically shows a structure of a modification of the embodiment 3 of the invention.

FIG. 17 schematically shows a structure of a modification 1 of the embodiment 3 of the invention. The structure shown in FIG. 17 differs from the structure shown in FIG. 15 in that a transfer gate 15 which is made off when test mode instructing signal TEN is active is arranged between peripheral reference voltage generating circuit 2*p* and select circuit 4. Further, peripheral reference voltage generating circuit 2*p* in FIG. 17 does not receive the inverted test mode instructing signal, and operates normally. Structures other than the above are the same as those shown in FIG. 15, and the corresponding portions bear the same reference numerals.

In the test mode, transfer gate 15 is off and disconnects peripheral reference voltage generating circuit 2*p* from select circuit 4, and transfer gate 9 connects pad 13 to select circuit 4. Thereby, peripheral reference voltage Vrefp can be externally and forcedly set without an influence by the reference voltage generated by peripheral reference voltage generating circuit 2*p*. Peripheral reference voltage generating circuit 2*p* does not require a circuit structure for holding the peripheral reference voltage generating circuit 2*p* in the inactive state during the test mode, and the peripheral reference voltage generating circuit 2*p* can accurately produce the reference voltage at the desired voltage level without an influence by a channel resistance of a control transistor and others.

In the structure shown in FIG. 17, peripheral reference voltage generating circuit 2*p* and sense reference voltage generating circuit 2*s* may be formed in a single circuit structure so that the circuit structure may always produce the peripheral reference voltage and the sense reference voltage at a predetermined magnitude ratio (see FIG. 2).

Figure 18:
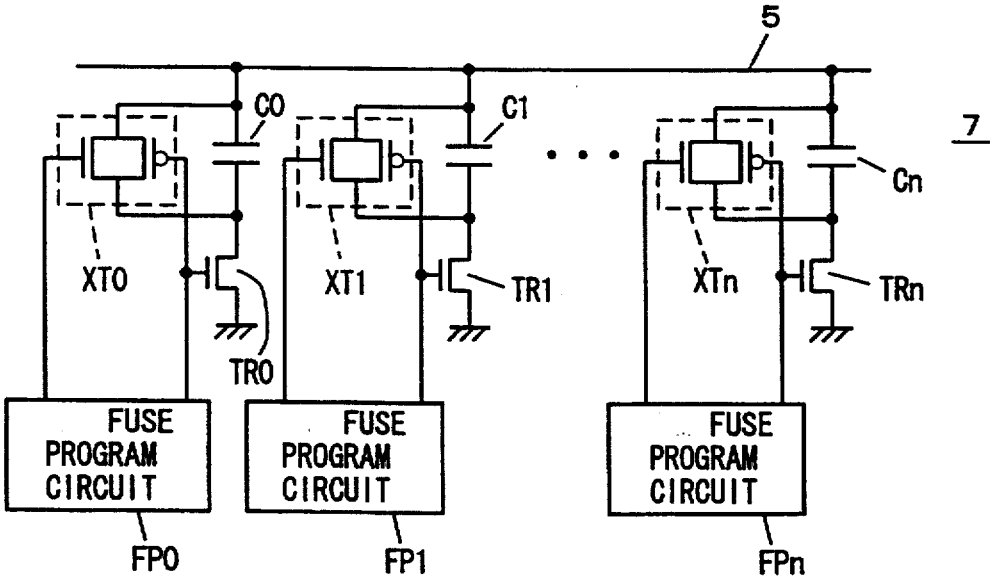
FIG. 18 shows more specifically a structure of a stabilizing capacitance shown in FIGS. 15 and 17.

FIG. 18 shows an example of the structure of the stabilizing capacitance shown in FIGS. 15 and 17. In FIG. 18, capacitors C0–Cn which are in parallel with each other are connected to sense power supply line 5. Transfer gates XT0–XTn are arranged in parallel with capacitors C0–Cn, respectively. Switching transistors TR0–TRn are arranged in series between capacitors C0–Cn and the ground node, respectively.

For controlling on/off of transfer gates XT0–XTn and switching transistors TR0–TRn, fuse program circuits FP0–FPn are arranged corresponding to capacitors C0–Cn, respectively. Fuse program circuits FP0–FPn complementarily turn on transfer gates XT0–XTn and switching transistors TR0–TRn, respectively. These capacitors C0–Cn have the equal capacitance value, and are selectively connected to sense power supply line 5 under the control by fuse program circuits FP0–FPn for establishing the necessary capacitance value. Each of transfer gates XT0–XTn short-circuits a corresponding one of capacitors C0–Cn when turned on. A capacitor, which is not used because a corresponding one of switching transistors TR0–Trn is off, attains such a state that the facing electrodes of the unused capacitor are short-circuited. Thereby, the capacitors C0–Cn are prevented from acting as parasitic capacitances on sense power supply line 5 when unused.

If the positions of the capacitors C0–Cn and switching transistors TR0–TRn were exchanged and the switching transistors TR0–TRn are connected to sense power supply line 5, the channel resistances of switching transistors TR0–TRn would form delay circuits so that a capacitor to be used could not be charged and discharged rapidly. As shown in FIG. 18, transfer gates XT0–XTn can selectively short-circuit corresponding capacitors C0–Cn so that an unused capacitor can be prevented from accumulating charges, and can also be prevented from acting as a noise source or a parasitic capacitance adversely affecting other circuits.

Figure 19:
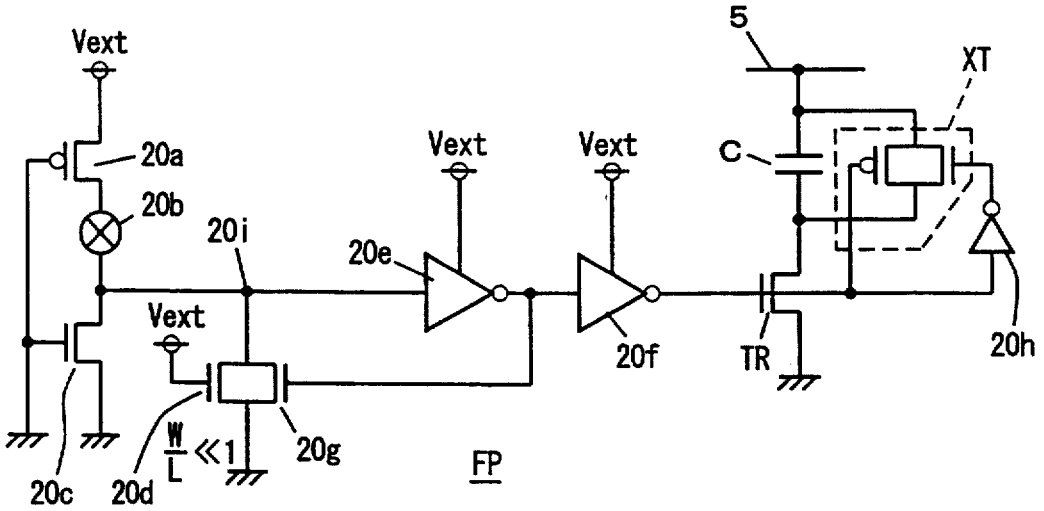
FIG. 19 shows a structure of a fuse program circuit shown in FIG. 18.

FIG. 19 shows a structure of fuse program circuits FP0–FPn shown in FIG. 18. More specifically, FIG. 19 shows a structure of one of fuse program circuits FP. In FIG. 19, fuse program circuit FR (FP0–FPn) includes a p channel MOS transistor 20*a* having a conduction nodes connected to the external power supply node, a blowable link element 20*b* connected between MOS transistor 20*a* and a node 20*i*, an n channel MOS transistor 20*c* connected between node 20*i* and the ground node, an n channel MOS transistor 20*d* connected between node 20*i* and the ground node with a gate connected to the external power supply node, an inverter 20*e* for inverting the voltage on node 20*i*, an inverter 20*f* for inverting the output signal of inverter 20*e*, an inverter 20*h* for inverting the output signal of inverter 20*f*, and an n channel MOS transistor 20*g* connected between node 20*i* and the ground node with a gate receiving the output signal of inverter 20*e*.

Each of inverters 20*e* and 20*f* uses external power supply voltage Vext as one operation power supply voltage. The output signals of inverters 20*f* and 20*h* control on/off of transfer gate XT. The output signal of inverter 20*f* controls on/off of switching transistor TR. The output signal of inverter 20*h* is applied to the gate of the n channel MOS transistor of the CMOS transmission gate in transfer gate XT (XT0–XTn).

MOS transistor 20*d* has a ratio (W/L) between the channel width to the channel length sufficiently reduced, and therefore has a sufficiently small current driving capability. MOS transistors 20*a* and 20*c* have gates connected to the ground node. Operation will now be described below.

When link element 20*b* is conductive (not blown), node 20*i* is charged through MOS transistor 20*a*. When the voltage level on node 20*i* exceeds the input logical threshold voltage of inverter 20*e*, the output signal of inverter 20*e* attains L-level, and MOS transistor 20*g* is turned off. MOS transistor 20*d* has a ratio of the channel width and to channel length made sufficiently small, and causes an extremely small current flow. Therefore, the node 20*i* is at the voltage at the level of external power supply voltage Vext. The output signal of inverter 20*f* attains H-level (external power supply voltage level), transfer gate XT is turned off, and switching transistor TR is turned on so that capacitor C serves as a stabilizing capacitance for sense power supply line 5.

If link element 20*b* is blown, node 20*i* is always driven weakly to the ground voltage level via MOS transistor 20*d*. When the voltage level on node 20*a* decreases below the input logical threshold voltage of inverter 20*e* (after power-on), the output signal of inverter 20*e* attains H-level, MOS transistor 20*g* is turned on, and node 20*a* is held at the ground voltage level. The output signal of inverter 20*f* attains L-level so that switching transistor TR is turned off, and transfer gate XT is turned on to short-circuit capacitor C.

The purpose of n channel MOS transistor 20*c* is to prevent of node 20*a* from being driven to a negative voltage level at the time of power-on. When link element 20*b* is blown, power supply voltage Vext is initially at a low level, and MOS transistor 20*d* has a small current driving capability so that recovery from the negative voltage level cannot be done fast, and an erroneous initialization may be done. MOS transistor 20*c* prevents this erroneous setting.

By utilizing the capacitor and the fuse program circuit shown in FIG. 19, the stabilizing capacitance having the optimum capacitance value can be implemented by the fuse program after determining optimum values of the respective capacitance values in the wafer process.

In each chip, the optimum stabilizing capacitance for the sense power supply voltage can be implemented, and the sense amplifier can operate fast and stably.

[Structure 2 of Stabilizing capacitance]

Figure 20:
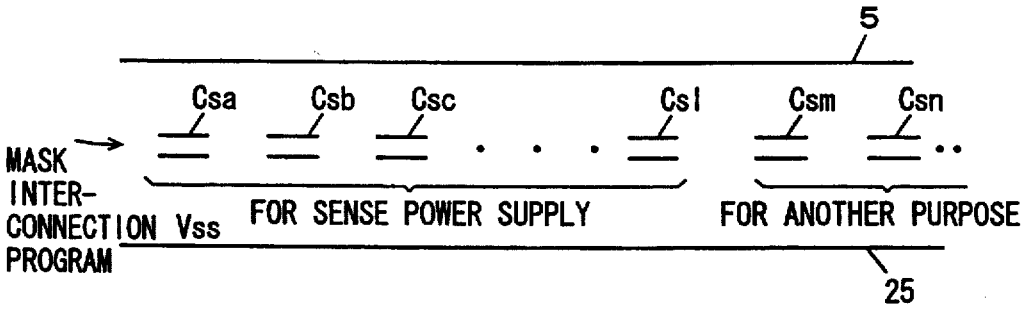
FIG. 20 shows another structure of the stabilizing capacitance shown in FIGS. 15 and 17.

FIG. 20 shows another structure of a capacitor for stabilizing the sense power supply voltage. In the structure shown in FIG. 20, capacitors Csa–Csn are arranged in parallel with each other for sense power supply line 5. The optimum capacitance value is determined based on the optimum peripheral reference voltage, and the capacitor(s) is selected from capacitors Csa–Csn in accordance with the optimum capacitance value. Capacitors Csa–Csn have equal capacitance value. For example, capacitors Csa–Csn are connected between sense power supply line 5 and a ground line 25 by mask interconnection process, and are used as the capacitance for stabilizing the sense power supply voltage. Other capacitors Csm, Csn, . . . are used for other purpose(s) such a decoupling capacitance for stabilizing the peripheral circuit power supply voltage and a charge pump capacitor performing a charge pump operation. In this case, the capacitors can be efficiently utilized for the sense power supply line so that an area occupied by the capacitors can be reduced.

In the structure shown in FIG. 20, the capacitors are selected by mask interconnection line. Therefore, the sense power supply stabilizing capacitor cannot be optimized for each wafer, based on a performance of each chip, but an area occupied by the capacitors for stabilizing the sense power supply voltage can be effectively reduced (because unused capacitors are used for other purposes).

[Modification 3]

Figure 21:
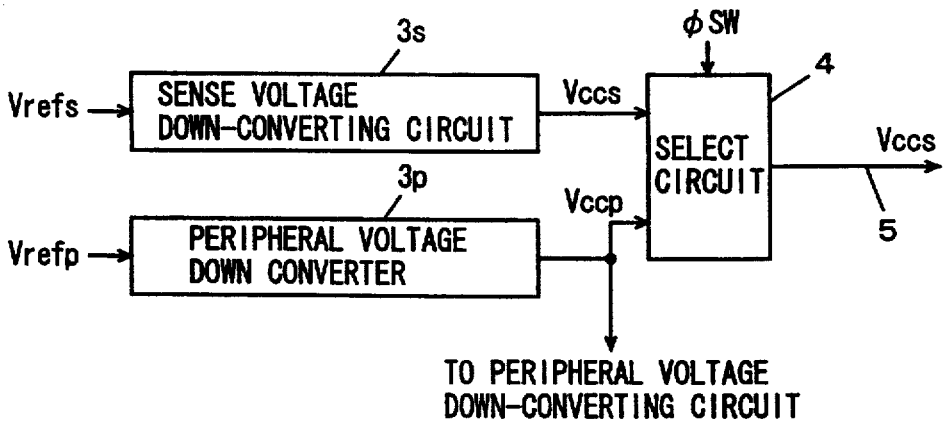
FIG. 21 schematically shows a modification of the third embodiment of the invention.

FIG. 21 schematically shows a structure of a modification 3 of the embodiment 3 of the invention. In FIG. 21, sense power supply voltage Vccs supplied from sense voltage down converter 3*s* and peripheral power supply voltage Vccp supplied from peripheral voltage down converter 3*p* are selected by select circuit 4, and the selected voltage is transmitted onto sense power supply line 5. In the structure shown in FIG. 21, therefore, peripheral power supply voltage Vccp supplied from peripheral voltage down converter 3*p* is transmitted onto sense power supply line 5 for a predetermined period when the sense amplifier operates. During the operation of the sense amplifier, the peripheral circuits are not usually operating because the sense amplifier is activated after completion of the row select, and the column selection will be performed after completion of the sense operation. Accordingly, no adverse influence is exerted on the operation of the peripheral circuits by the operation, in which sense power supply voltage Vccs supplied from sense voltage down converter 3*s* and peripheral power supply voltage Vccp supplied from peripheral voltage down converter 3*p* are selected in accordance with switch signal ϕSW and are transmitted onto sense power supply line 5 as shown in FIG. 21. Therefore, the voltage level on sense power supply voltage Vccs can be raised to the level of peripheral power supply voltage Vccp without any adverse influence.

[Application to Another Usage]

Figure 22:
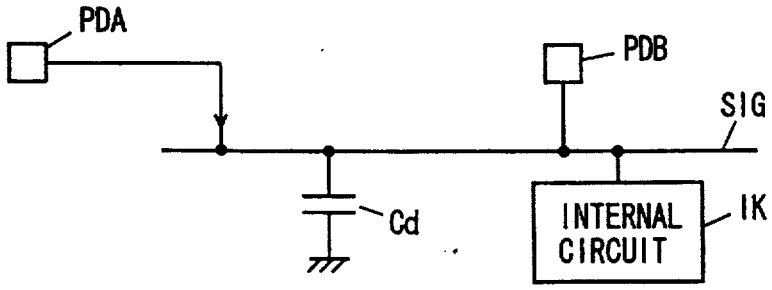
FIG. 22 shows an example of application of the embodiment 3 of the invention.

FIG. 22 shows an example of application of the embodiment 3 of the invention to another usage. In the structure shown in FIG. 22, a decoupling capacitance Cd is connected to a power supply line SIG. An internal circuit IK utilizes the voltage on power supply line SIG. A pad PDB dedicated to monitoring is connected to power supply line SIG, and the voltage level on power supply line SIG can be externally and forcedly set via pad PDA (see structures shown in FIGS. 15 and 17). Decoupling capacitance Cd has a function of holding the voltage on power supply line SIG at a constant voltage level, and has a function of absorbing noises.

According to predetermined simulation, candidate capacitance values of decoupling capacitance Cd are determined. In the test mode, the voltage on power supply line SIG is externally changed via pad PD, and a change in voltage on power supply line SIG is concurrently monitored via pad PDB. A voltage, which is applied via pad DAP and causes the lowest change in voltage on power supply line SIG, is determined. It is assumed that a voltage thus determined is the voltage Vt. It is also assumed that a voltage Vj is actually transmitted onto power supply line SIG. In this case, optimized voltage Vt compensates for a current consumed by internal circuit IK or noises, and the charges consumed in this operation can be expressed by Vt·Cd. Therefore, an optimum value Cdo of stabilizing capacitance Cd can be expressed by the following equation:

$$Cdo=(Vt/Vj)\cdot Cd$$

The optimum value of stabilizing capacitance Cd can be determined, and the stabilizing capacitance occupying the lowest area can be implemented.

[Application 2 to Another Usage]

Figure 23:
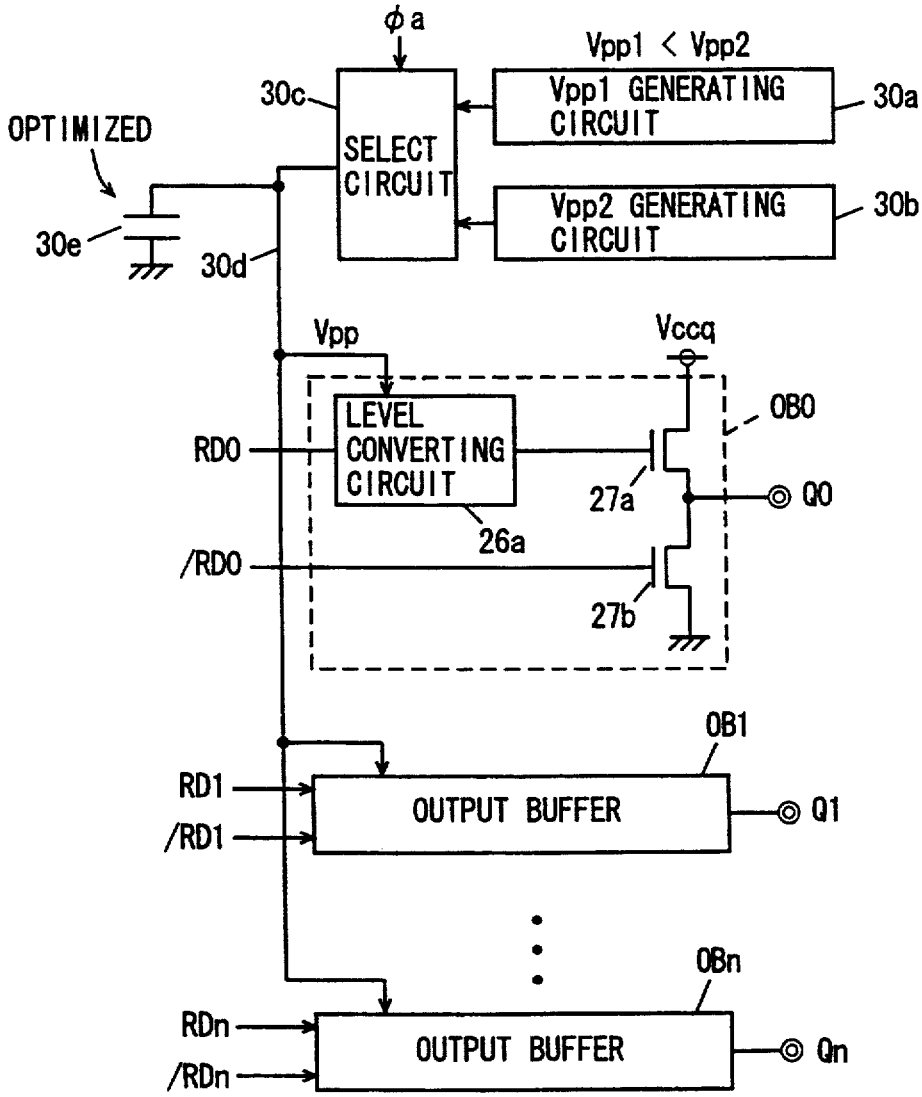
FIG. 23 shows another example of application of the embodiment 3 of the invention.

FIG. 23 schematically shows a structure of an example 2 to which the embodiment 3 of the invention is applied. In FIG. 23, output buffers OB0–OBn are provided for output data bits Q0–Qn, respectively. Output buffers OB0–OBn buffer internal read data RD0 and/RD0–RDn and/RDn which are internally read out, to produce corresponding output data Q0–Qn for external output, respectively. Output buffers OB0–OBn have the same structure, and FIG. 23 representatively shows the structure of output buffer OB0.

Output buffer OB0 includes a level converting circuit 26*a* for converting the voltage level of internal read data RD0 into a level of high voltage Vpp, an n channel MOS transistor 27*a* made conductive to drive output data bit Q0 to H-level when the output signal of level converting circuit 26*a* is at H-level, and an n channel MOS transistor 27*b* made conductive to drive output data bit Q0 to the ground voltage level when complementary internal read data /RD0 is at H-level. Level converting circuit 26*a* operates using high voltage Vpp as one operation power supply voltage, and level converts the H-level (equal to the level of internal power supply voltage Vccs) of internal read data RD0 to a level of high voltage Vpp. MOS transistor 27*a* receives a power supply voltage Vccq as one power supply voltage, and also receives, on its gate, voltage Vpp higher than power supply voltage Vccq supplied from level converting circuit 26*a* to drive output data bit Q0 to the H-level equal to the level of power supply voltage Vccq without a loss of threshold voltage.

Commonly to these output buffers OB0–OBn, there are arranged a Vpp1 generating circuit 30*a* generating a first high voltage Vpp1, a Vpp2 generating circuit 30*b* generating a second high voltage Vpp2 higher than first high voltage Vpp1, a select circuit 30*c* for transmitting one of high voltages Vpp1 and Vpp2 onto an internal high voltage transmission line 30*d* in response to a switch signal ϕa, and a stabilizing capacitance 30*e* stabilizing the voltage on internal high voltage transmission line 30*d*.

Internal high voltage transmission line 30*d* supplies high voltage Vpp to the respective level converting circuits included in output buffers OB0–OBn. Switch signal ϕa for selecting second high voltage Vpp2 for a predetermined period is generated when output buffers OB0–OBn start the operation and complete the operation. Accordingly, the voltage on internal high voltage transmission line 30*d* is held at the level of second high voltage Vpp when level converting circuits 26*a* operate in output buffers OB0–OBn, and level converting circuits 26*a* can stably perform level conversion without lowering the voltage level of internal high voltage Vpp. Owing to this, output buffers OB0–OBn rapidly produce output data bits at the level of power supply voltage Vccq without a loss of threshold voltage of output transistor 27*a* and without lowering the operation speed.

For optimizing the capacitance value of stabilizing capacitance 30*e* of internal high voltage transmission line 30*d*, the structure already described with reference to FIGS. 15 to 20 can be used, whereby it is possible to implement stabilizing capacitance 30*e* which stably produces high voltage Vpp with a lowest area.

Vpp1 and Vpp2 generating circuits 30*a* and 30*b* each are formed of, e.g., a charge pump circuit. In the case of a standard DRAM, switch signal ϕa is set to the state for selecting second high voltage Vpp2 for a predetermined period in response to transition to activation and deactivation of output enable signal /OE. In the case of a synchronous semiconductor memory device which performs data output in synchronization with a clock signal, switch signal ϕa is set to the state for selecting second high voltage Vpp2 in synchronization with the clock signal for a period of a burst length (the number of data bits successively read out in response to one read command) after a predetermined period (usually shorter than a CAS latency) since the read command instructing data reading is applied.

Switch signal ϕa may be set to the state for selecting second internal high voltage Vpp2 every time a change in internal read data RD0 and /RD0–RDn and /RDn is detected.

By employing the structure shown in FIG. 23, it is possible to implement the output circuit which occupies a small area and performs fast and stable outputting data.

According to the embodiment 3 of the invention, as described above, it is possible to monitor externally the optimum value of the capacitor which is provided for stabilizing the voltage on the power supply line or the internal high voltage line supplied with a predetermined voltage. Therefore, it is possible to provide the stabilizing capacitance occupying the lowest area, and it is possible to reduce an area occupied by the capacitor.

EMBODIMENT 4

Figure 24:
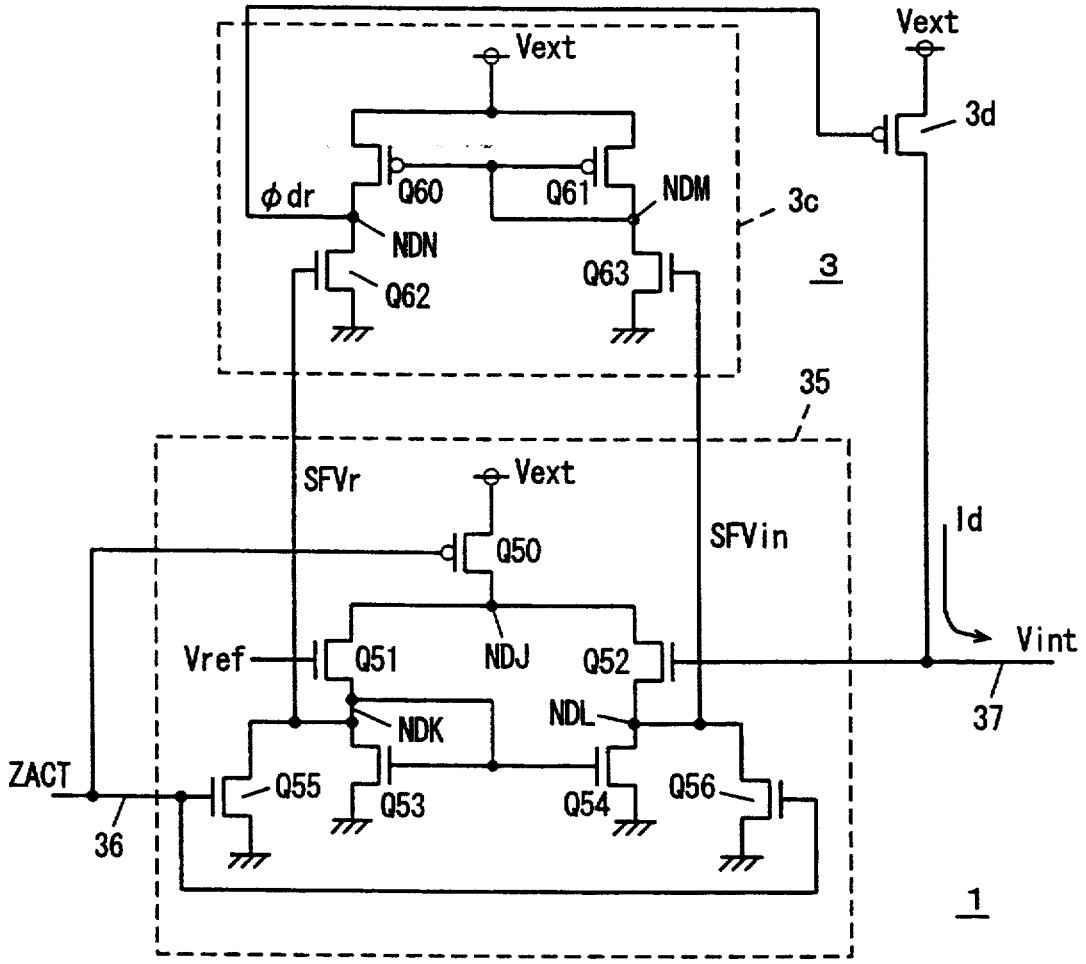
FIG. 24 shows a structure of a main portion of a semiconductor memory device according to an embodiment 4 of the invention.

FIG. 24 shows a structure of a main portion of a semiconductor memory device according to an embodiment 4 of the invention. FIG. 24 shows a structure of the voltage down converter included in internal power supply circuit 1 shown in FIG. 1. The sense voltage down converter and the peripheral voltage down converter have different operation characteristics, but has the same circuit structure, and FIG. 24 shows one voltage down converter 3.

In FIG. 24, voltage down converter 3 includes a local level shifting circuit 35 which shifts the levels of internal power supply voltage Vint on internal power supply line 37 and reference voltage Vref to produce a level-shifted power supply voltage SFVin and a level-shifted reference voltage SFV. Voltage down converter 3 also includes a comparator 3*c* which compares level-shifted voltages SFVin and SFVr sent from local level shifting circuit 35, to generate a signal ϕdr representing the result of comparison, and a current drive transistor 3*d* which is formed of a p channel MOS transistor and supplies a current from the external power supply node to internal power supply line 37 in accordance with output signal ϕdr of comparator 3*c*. Comparator 3*c* is formed of a differential amplifier circuit, and its output signal ϕdr has an amplitude substantially between external power supply voltage Vext and the ground voltage. Thereby, such a problem is overcome that the gate-source voltage of current drive transistor 3*d* lowers at the time of lowering of external power supply voltage Vext, and thereby rapid reduction of the current supplying capability of current drive transistor 3*d* is prevented.

Comparator 3c includes a p channel MOS transistor Q61 which is connected between the external power supply node and a node NDM and has a gate connected to node NDM, a p channel MOS transistor Q60 which is connected between the external power supply node and a node NDN and has a gate connected to node NDM, an n channel MOS transistor Q62 which is connected between node NDN and the ground node and has a gate receiving level-shifted reference voltage SFVr, and an n channel MOS transistor Q63 which is connected between node NDM and the ground node and has a gate receiving level-shifted internal power supply voltage SFVin. MOS transistors Q60 and Q61 form a current mirror stage, and MOS transistors Q62 and Q63 form a comparison stage. Output signal ϕdr applied to the gate of current drive transistor 3d is generated from node NDN. Operation will be briefly described below.

Local level shifting circuit 35, of which structure and operation will be described later in detail, shifts the levels of reference voltage Vref and internal power supply voltage Vint to produce level-shifted voltages SFVr and SFVin. These level-shifted voltages SFVr and SFVin are at the voltage levels corresponding to reference voltage Vref and internal power supply voltage Vint, respectively, and a voltage difference between them accurately reflects the voltage difference between reference voltage Vref and internal power supply voltage Vint, although the difference is smaller than the difference between reference voltage Vref and internal power supply voltage Vint (voltage difference is divided by pseudo voltage dividing).

Comparator 3c differentially amplifies level-shifted voltages SFVr and SFVin. If level-shifted power supply voltage SFVin is lower than the level-shifted reference voltage SFVr, MOS transistor Q62 discharges the current rent supplied via MOS transistor Q60 to the ground node, to lower the voltage level on node NDN, and output signal ϕdr increases the conductance of current drive transistor 3d to increase current Id. Node NDN is coupled to the ground node via MOS transistor Q62, and the lowest attainable potential on node NDN is equal to the ground voltage level. Therefore, the maximum gate-source voltage of current drive transistor 3d is equal to −Vext, and current drive transistor 3d can supply current Id onto internal power supply line 37 with a large current driving capability even when external power supply voltage Vext lowers.

If level-shifted power supply voltage SFVin is higher than level-shifted reference voltage SFVr, MOS transistor Q62 cannot fully discharge the current supplied through MOS transistor Q60, and the voltage level on node NDN rises so that output signal ϕdr from node NDN lowers the conductance of current drive transistor 3d, and the current supply stops.

Figure 25A:
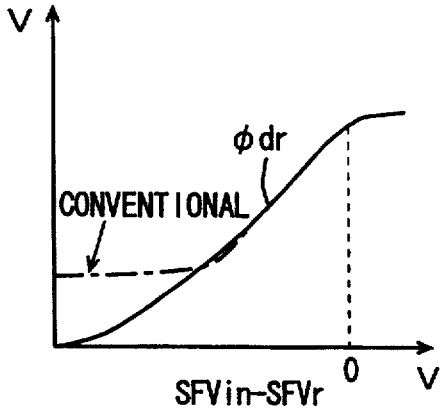
FIG. 25A is a signal waveform diagram representing an operation of a comparing circuit shown in FIG. 24.
Figure 25B:
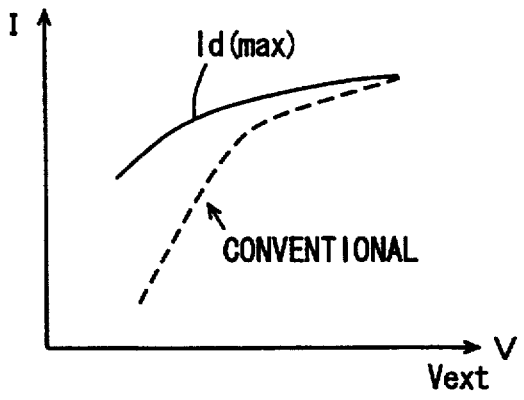
FIG. 25B shows a current driving capability of a current drive transistor shown in FIG. 24.

As shown in FIG. 25A, the lowest attainable voltage of output signal ϕdr of comparator 3c is equal to the ground voltage level. Therefore, it is possible to prevent rising of the lowest attainable potential of output signal ϕdr, which may occur due to the channel resistance of the current supply transistor as represented by alternate long and short dash line in FIG. 25A. Accordingly, current drive transistor 3d can receive the gate-source voltage of a sufficiently large absolute value even if external power supply voltage Vext is at the level near the lowest operable region, and the current driving capability of current drive transistor 3d does not significantly lower as shown in FIG. 25B. Since the lowest attainable voltage of output signal ϕdr is the ground voltage level, such a conventional problem can be overcome that the current supplying capability of current drive transistor 3d suddenly lowers at the vicinity of the operable lower limit of external power supply voltage Vext (because the gate-source voltage approaches the absolute value of threshold voltage).

It is not necessary to increase the channel width W for increasing the current driving capability of current drive transistor 3d, and therefore an area occupied by the voltage down converter can be reduced. Although the a local level shifting circuit 35, is provided MOS transistors forming local level shifting circuit 35 merely perform the level shifting, and therefore occupies a sufficiently small area so that increase in area occupied by the circuit can be sufficiently suppressed. In the prior art, current drive transistor 3d must have a channel width of several millimeters for sufficiently increasing its current driving capability.

In the voltage down converter shown in FIG. 24, if the lowest attainable potential of output signal ϕdr of comparator 3c is equal to the ground voltage level, comparator 3c is required to operate in a more sensitive region. If reference voltage Vref and internal power supply voltage Vint are directly applied to comparator 3c, conductances of both MOS transistors Q62 and Q63 would increase, to impair response characteristics thereof because voltages Vref and Vint are much higher than the ground voltage. Local level shifting circuit 35 is employed for preventing the above situation.

Local level shifting circuit 35 includes a p channel MOS transistor Q50 which is connected between the external power supply node and node NDJ and has a gate receiving an activating signal ZACT, an n channel MOS transistor Q51 which is connected between nodes NDJ and NDK and has a gate receiving reference voltage Vref, an n channel MOS transistor Q52 which is connected between nodes NDJ and NDL and has a gate receiving internal power supply voltage Vint, an n channel MOS transistor Q53 which is connected between nodes NDK and the ground node and has a gate connected to node NDK, an n channel MOS transistor Q54 which is connected between node NDL and the ground node and has a gate connected to node NDK, an n channel MOS transistor Q55 which is connected between node NDK and the ground node and has a gate receiving activating signal ZACT, and an n channel MOS transistor Q56 which is connected between node NDL and the ground node and has a gate receiving activating signal ZACT. Activating signal ZACT is kept active at L-level while the internal circuitry consuming internal power supply voltage Vint is active, and corresponds to, e.g., an internal row address strobe signal in a standard DRAM. Operation of local level shifting circuit 35 will now be described below.

When activating signal ZACT is inactive at H-level, MOS transistor Q50 is off, and MOS transistors Q55 and Q56 are on so that level-shifted voltages SFVin and SFVr maintain the ground voltage level of L-level. By keeping MOS transistors Q55 and Q56 in the on state when activating signal ZACT is inactive, the internal nodes in local level shifting circuit 35 are prevented from being electrically floated. By keeping MOS transistor Q50 in the off state, generation of a through current in local level shifting circuit 35 is prevented. In this state, level shifted voltages SFVin and SFVr are at the ground voltage level of L-level, and MOS transistors Q62 and Q63 in comparator 3c are kept off so that generation of a through current in comparator 3c is prevented. Thereby, the current consumption is reduced.

When activating signal ZACT attains the active state at L-level, MOS transistor Q50 is turned on, and MOS transistors Q55 and Q56 are turned off so that local level shifting circuit 35 starts the level shifting operation. Both reference voltage Vref and internal power supply voltage Vint are at the voltage levels lower than external power supply voltage Vext. Therefore, MOS transistors Q51 and Q52 operate in a saturated region. MOS transistor Q53 has the gate and drain interconnected, and operates in a saturated region. MOS transistors Q51–Q54 have the same size and the same threshold voltage. Large currents flow through MOS transistors Q51 and Q53, respectively. Therefore, the following equation is established:

$$(Vref-Vn-Vth)^2\cdot\beta=(Vn-Vth)^2\cdot\beta$$

where Vn represents a voltage on node NDK. The following relation is derived from the above equation:

$$Vn=Vref/2$$

Thus, a voltage equal to ½ times reference voltage Vref appears on node NDK. MOS transistors Q53 and Q54 have the same size, and currents of the same magnitude flow through MOS transistors Q53 and Q54. Whether MOS transistor Q54 operates in the saturated or nonsaturated region is determined depending on the voltage on node NDL. The voltage on node NDL is stabilized under the state where currents of the equal magnitude flow through MOS transistors Q52 and Q54. Therefore, the following equations are established where VI represents the voltage on node NDL:

$$(Vint-VI-Vth)^2\cdot b=(Vn-Vth)^2\cdot b$$

$$Vint-VI=Vn$$

$$VI=Vint-Vref/2$$

Therefore, a voltage equal to a difference between internal power supply voltage Vint and voltage Vref/2 on node NKD appears on node NDL. Thus, level-shifted internal power supply voltage SFVin is at the level attained by shifting internal power supply voltage Vint by a level of Vref/2, and level-shifted reference voltage SFVr is the reference voltage resistance-divided with a division ratio of 2.

Comparator 3 compares these voltages (Vint–Vref/2) and Vref, and therefore a comparison between internal power supply voltage Vint and reference voltage Vref is performed in comparator 3*c*, which in turn is formed of a differential amplifier. By using local level shifting circuit 35, comparator 3*c* can compare level-shifted voltages SFVr and SFVin with each other. Accordingly, even if the lowest attainable voltage of output signal ϕdr of comparator 3*c* is equal to the ground voltage level, comparator 3*c* can perform the comparing operation in the most sensitive region, and a fast response to the change in internal power supply voltage Vint can be achieved.

[Modification 1]

Figure 26:
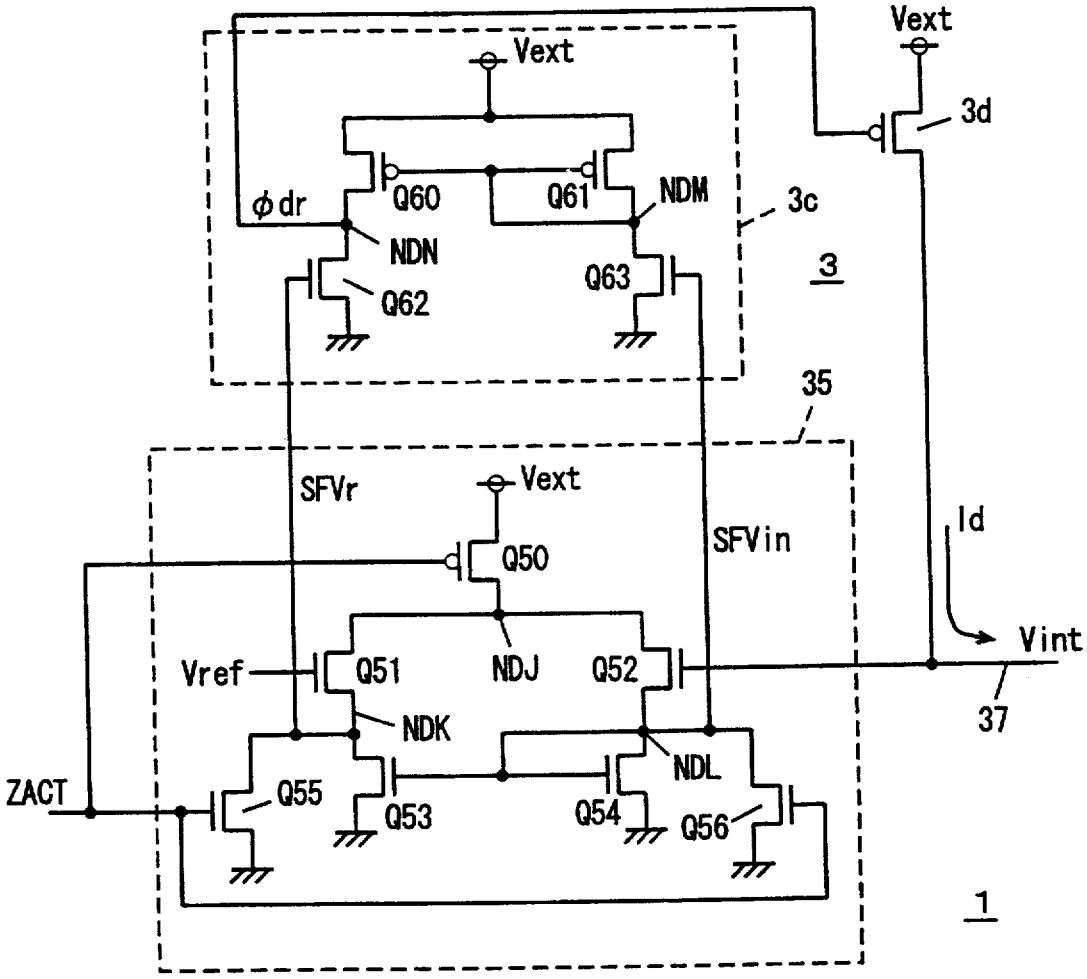
FIG. 26 schematically shows a structure of a modification of the embodiment 4 of the invention.

FIG. 26 shows a structure of a modification 1 of the embodiment 4 of the invention. The structure shown in FIG. 26 differs from the structure shown in FIG. 24 in that gates of MOS transistors Q53 and Q54 in local level shifting circuit 35 are connected to node NDL. Structures other than the above are the same as those shown in FIG. 24, and corresponding portions bear the same reference numerals, and will not be described in detail.

In the structure shown in FIG. 26, MOS transistors Q52 and Q54 operate in the saturated region so that level-shifted internal power supply voltage SFVin generated from node NDL in local level shifting circuit 35 is equal to ½ times internal power supply voltage Vint. MOS transistor Q51 operates in the saturated region, and a current of the same magnitude as the current flowing through MOS transistor Q54 flows through MOS transistor Q51 so that the following operation can hold assuming that the saturation currents of these transistors are equal to each other:

$$Vint/2=Vref-SFVr$$

$$SFVr=Vref-Vint/2$$

Figure 27:
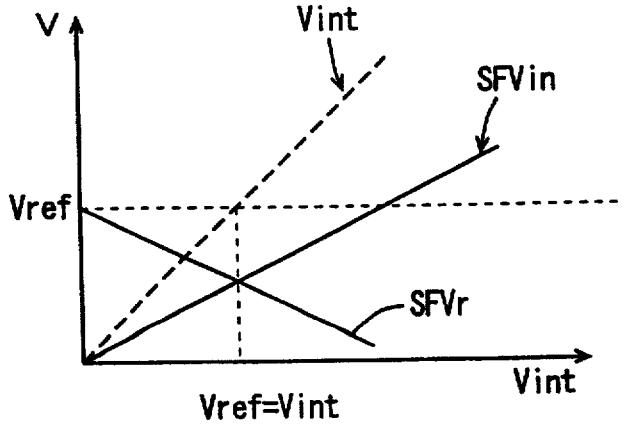
FIG. 27 is a signal waveform diagram representing an operation of a level conversion circuit shown in FIG. 26.

As shown in FIG. 27, level-shifted internal power supply voltage SFVin and level-shifted reference voltage SFVr change in accordance with internal power supply voltage Vint in a reversed phase. Comparator 3*c* makes a comparison between level-shifted reference voltage SFVr (=Vref–Vint/2) and level-shifted power supply voltage SFVin (=Vint/2), and equivalently makes a comparison between the voltage levels of reference voltage Vref and internal power supply voltage Vint. However, level-shifted voltages SFVr and SFVin change in a reverse phase so that a difference of the input voltages of comparator 3*c* relative to a variation in internal power supply voltage Vint is enlarged. Therefore, a conductance of current drive transistor 3*d* can be controlled more precisely in accordance with a change in internal power supply voltage Vint, and the voltage down converter having an excellent response characteristic can be implemented.

When the level-shifted power supply voltage SFVin exceeds level-shifted reference voltage SFVr, output signal ϕdr generated from node NDN attains H-level, and current drive transistor 3*d* is turned off. Level-shifted voltages SFVin and SFVr become equal to each other when internal power supply voltage Vint becomes equal to reference voltage Vref

[Modification 2]

Figure 28:
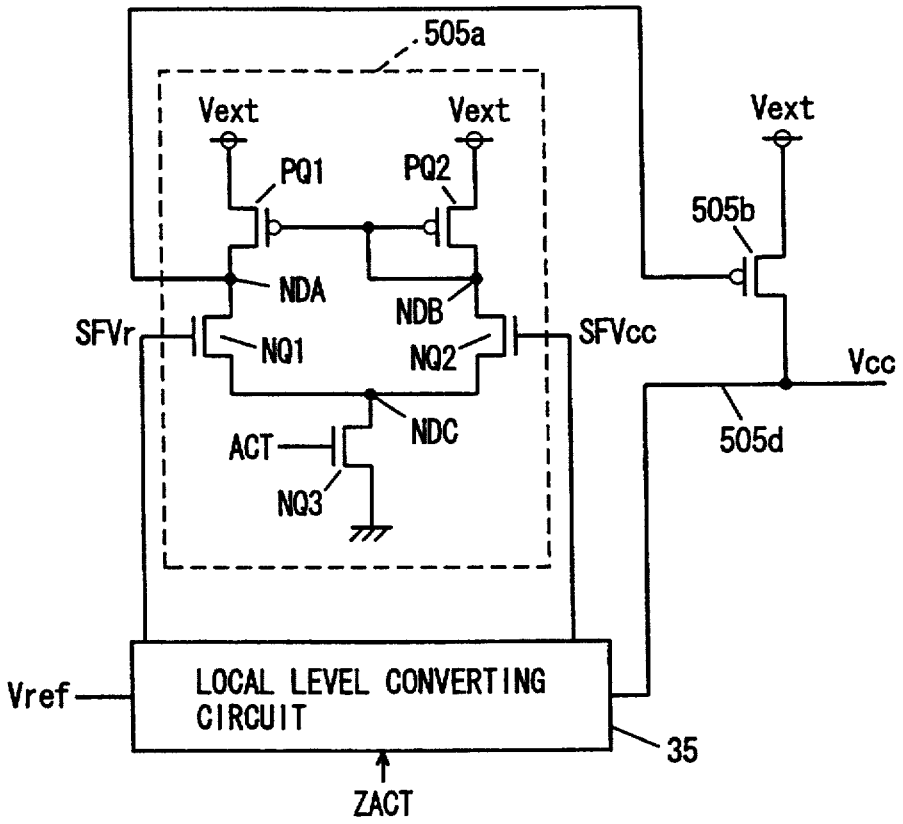
FIG. 28 schematically shows a structure of a modification 2 of the embodiment 4 of the invention.
Figure 53:
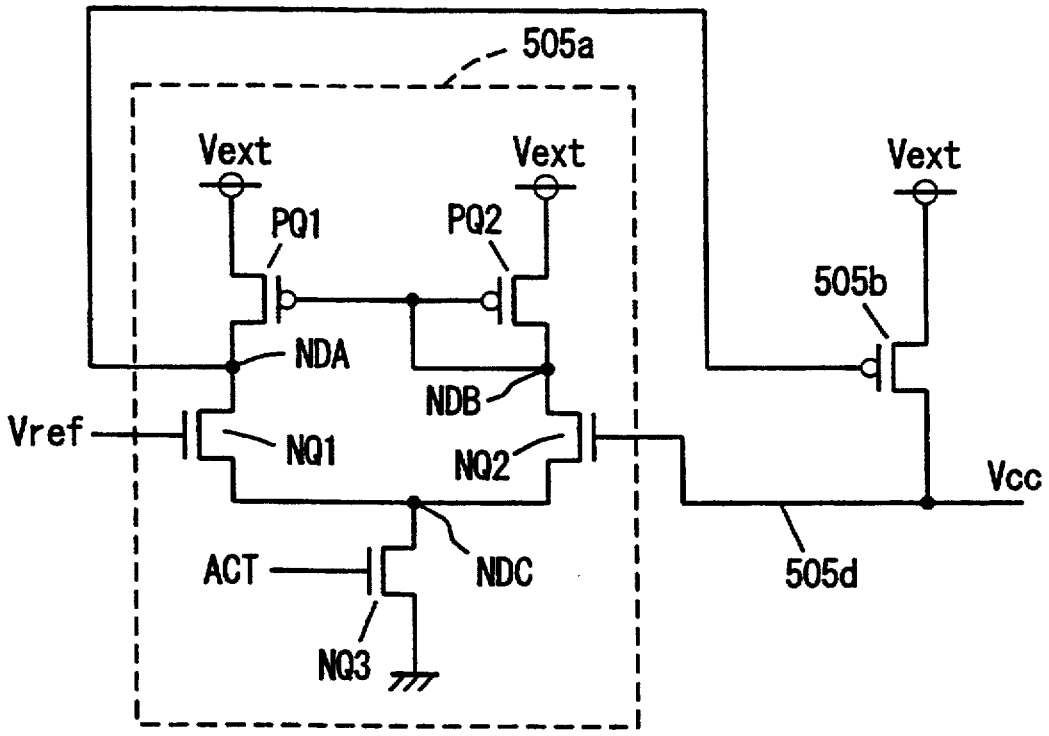
FIG. 53 PRIOR ART
FIG. 53 shows a schematic structure of the voltage down converter shown in FIG. 48.

FIG. 28 shows a structure of a modification 2 of the embodiment 4 of the invention. In a voltage down converter shown in FIG. 28, a comparator 505*a* is supplied with level-shifted voltages SFVr and SFVcc, from local level shifting circuit 35 shifting the levels of internal power supply voltage Vcc on an internal power supply line 505*d* and reference voltage Vref. Local level shifting circuit 35 in FIG. 28 has the same structure as that shown in FIG. 24 or 26. Comparator 505*a* has the same structure as that shown in FIG. 53, and corresponding portions bear the same reference numerals.

According to the structure of the voltage down converter shown in FIG. 28, local level shifting circuit 35 generates level-shifted voltages SFVr and SFVcc to comparator 505*a*. Therefore, comparator 505*a* can operate in the most sensitive region, where the conductances of MOS transistors NQ1 and NQ2 change significantly in accordance with respective the gate voltages so that the response characteristic of comparator 505*a* can be improved.

Even if external power supply voltage Vext is at the voltage level near the lowest operable region, lowering of the current supplying capability of current drive transistor 505*a* can be suppressed by employing current supply transistor NQ3 which has a sufficiently reduced channel resistance.

According to the embodiment 4, as described above, the local level shifting circuit is used to shift the levels of the reference voltage and the internal power supply voltage, and the conductance of the current drive transistor is adjusted in accordance with a result of the comparison that is made between the level-shifted reference voltage and the level-shifted internal power supply voltage. Therefore, even if the external power supply voltage is at the voltage level near the lowest operable region, the comparator can operate in the most sensitive region, and the variation in level of the internal power supply voltage can be suppressed through a fast response to change of the same.

By employing the structure wherein the MOS transistors in the comparing stage of the comparator have the sources directly receiving the ground voltage, the output signal amplitude of the comparator can be expanded to a range between the external power supply voltage and the ground voltage level. Therefore, even if the external power supply voltage is at the voltage level near the lowest operable region, the gate-source voltage of the current drive transistor can be sufficiently increased, and lowering of the current driving capability of the current drive transistor in this region can be suppressed. Further, it is not necessary to increase the channel width of the current drive transistor, and therefore the internal power supply voltage can be stably held at the predetermined voltage level without increasing an occupying area.

Since the MOS transistors of the same conductivity type are used for the local level shifting circuit, an area occupied by the circuit can be reduced. The local level shifting circuit is a current controlled type comparing circuit, and performs the current amplification, but it does not perform the voltage amplification. The level shifting of the reference voltage and the internal power supply voltage is achieved by equivalently performing the resistance division with the ratio between channel resistances of the MOS transistors. Therefore, comparison between the voltage levels is performed fast for producing the level-shifted voltages, and the voltage down converter can have a fast response characteristic. Since the local level shifting circuit is formed of the MOS transistors, all of which are of the same conductivity type, all the components thereof have the same temperature characteristics. Also, the comparator differentially amplifies the output signals of the local level shifting circuit. Therefore, the temperature dependency of the output voltages of the local level shifting circuit cancel each other so that the level-shifted reference voltage and the level-shifted power supply voltage, of which temperature dependency are canceled, can be produced. Thus, through the temperature characteristic compensation for the reference voltage, the internal power supply voltage subject to the temperature characteristic compensation can be produced.

EMBODIMENT 5

Figure 29:
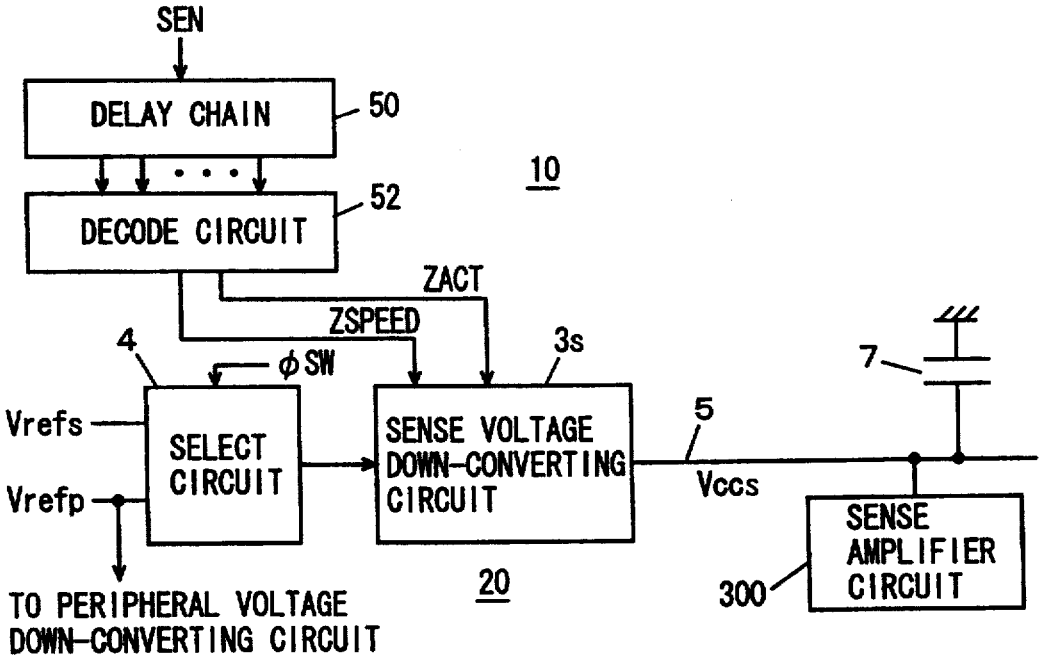
FIG. 29 shows a structure of a main portion of a semiconductor memory device according to an embodiment 5 of the invention.

FIG. 29 shows a structure of a main portion of a semiconductor memory device according to an embodiment 5 of the invention. FIG. 29 schematically shows structures of portions of an internal power supply circuit and a voltage level control circuit. In FIG. 29, internal power supply circuit 20 includes sense voltage down converter 3*s*, for holding a sense power supply voltage Vcca at a voltage level determined by reference voltage Vrefs or Vrefp in accordance with reference voltage Vrefs and peripheral reference voltage Vrefp.

Voltage level control circuit 10 includes select circuit 4 which is responsive to switch signal ϕSW for selecting one of sense reference voltage Vrefs and peripheral reference voltage Vrefp for transmission to sense voltage down converter 3*s*, a delay chain 50 which is formed of a plurality of delay circuits (inverters) and delays a sense activating signal SEN for generating a plurality of timing signals from a plurality of internal nodes, respectively, and a decode circuit 52 which decodes the output signal from delay chain 50, and produces a signal controlling activation/deactivation of sense voltage down converter 3*s* and increase/decrease of the operation current. A sense amplifier circuit 300 is coupled to sense power supply line 5, and a stabilizing capacitance 7, which is used for stabilizing the voltage on sense power supply line 5 or accumulating charges upon over-drive, is also coupled to sense power supply line 5.

Select circuit 4 transmits peripheral reference voltage Vrefp to sense voltage down converter 3*s* when sense activating signal SEN changes to the inactive state. At this time, decode circuit 52 increases the operation current of sense voltage down converter 3*s*, to increase the response speed thereof. In the sensing operation, sense voltage down converter 3*s* operates with the operation current increased in accordance with the output signal of decode circuit 52, and exhibits a fast response.

The delay chain 50 includes a set of delay circuits (inverter stages) connected in series. The output signals of the set of delay circuit stages are appropriately selected and decoded to produce a plurality of control signals. Thereby, the number of components of the control signal producing portion and the area occupied by the circuitry are reduced. Structures of the respective portions will now be described below.

Figure 30:
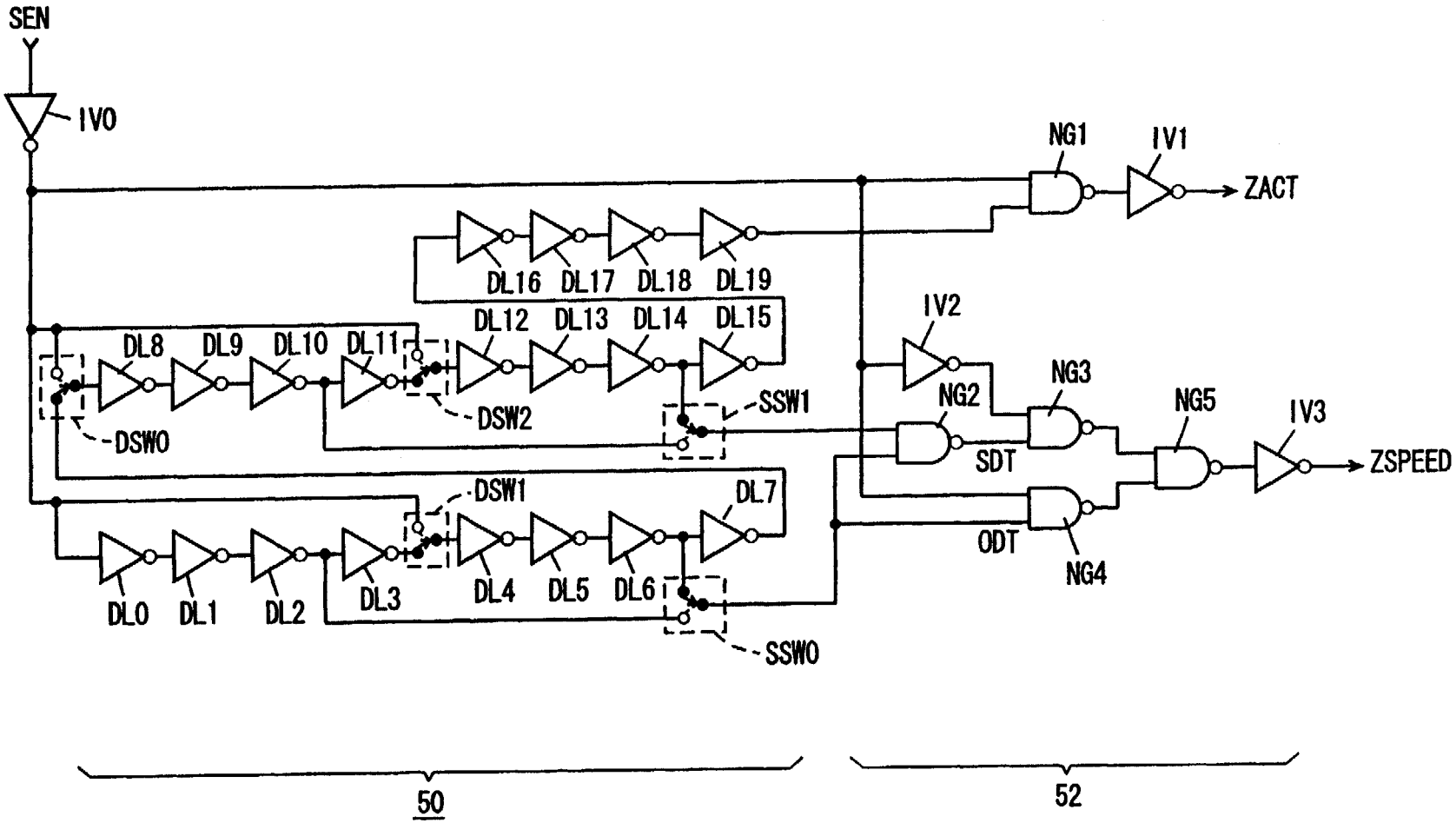
FIG. 30 shows structures of a delay chain and a decode circuit shown in FIG. 29.

FIG. 30 shows structures of the delay chain and decode circuit shown in FIG. 29. In FIG. 30, delay chain 50 includes an inverter IV0 inverting sense activating signal SEN, and cascaded delay inverters DL0–DL19 for receiving the output signal of inverter IV0. Between delay inverters DL3 and DL4, there is arranged a delay select switch DSW1 for selecting one of the output signals of delay inverter DL3 and inverter IV0 for application to the input of delay inverter DL4. Between delay inverters DL7 and DL8, there is arranged a delay select switch DSW0 for selecting one of the output signals of delay inverter DL7 and inverter IV0 for application to the input of delay inverter DL8. Between delay inverters DL11 and DL12, there is arranged a delay select switch DSW for selecting one of the output signals of delay inverter DL11 and inverter IV0 for application to the input of delay inverter DL12.

Further, an output select switch SSW0 which selects one of the output signals of delay inverters DL2 and DL6, and an output select switch SW1 which selects one of the output signals of delay inverters DL10 and DL14 are provided. Output select switches SSW0 and SSW1 can change the delay time of the signal generated from delay chain 50. Delay select switches DSW0–DSW2 can control the delay time of delay chain of delay inverters DL0–DL19. For example, by setting delay select switch DSW0 to the state for selecting the output signal of inverter IV0, delay inverters DL0–DL7 are short-circuited, and the signal can be transmitted to delay inverter DL8. In FIG. 30, delay select switches DSW0–DSW2 are set to the state for selecting the output signals of the delay inverters, respectively, and delay inverters DL0–DL19 are cascaded and form the delay chain.

Decode circuit 52 includes a 2-input NAND circuit NGI receiving the output signal of inverter IV0 and the output signal of delay inverter DL19, an inverter IV1 for which inverting the output signal of NAND circuit NG1, to generate voltage down-converting activating signal ZACT, an inverter IV2 inverting the output signal of inverter IV0, a 2-input NAND circuit NG2 receiving the output signals of output select switches SSW1 and SSW0, a 2-input NAND circuit NG3 receiving the output signal of inverter IV2 and an output signal SDT of NAND circuit NG2, a 2-input NAND circuit NG4 receiving the output signal of inverter IV0 and an output signal ODT of output select switch SSWO, a 2-input NAND circuit NG5 receiving the output signals of NAND circuits NG3 and NG4, and an inverter IV3 inverting the output signal of NAND circuit NG5.

Inverter IV3 generates a signal ZSPEED for increasing the operation current.

As shown in FIG. 30, the delay inverters of the delay chain are commonly used for producing signals ZACT and ZSPEED. Owing to this structure, the delay inverters for producing a plurality of control signals can be reduced in number, and the area occupied thereby and the current consumption can be reduced.

Figure 31:
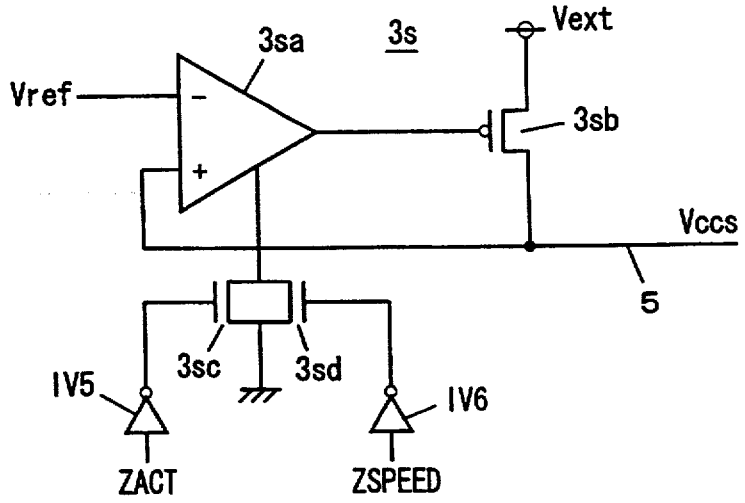
FIG. 31 schematically shows a structure of a sense voltage down converter shown in FIG. 29.

FIG. 31 schematically shows a structure of sense voltage down converter 3*s* shown in FIG. 29. Sense voltage down converter 3*s* in FIG. 31 includes a comparator 3*sa* which makes a comparison between reference voltage Vref from select circuit 4 and sense power supply voltage Vccs on sense power supply line 5, a current drive transistor 3*sb* which supplies a current from the external power supply node to sense power supply line 5 in accordance with the output signal of comparator 3*sa*, an n channel MOS transistor 3*sc* which receives sense activating signal ZACT on its gate via inverter IV5 and operates as a current source for comparator 3*sa*, and an n channel MOS transistor 3*sd* which receives control signal ZSPEED on its gate through inverter IV6 and increases the operation current of comparator 3*sa*. Comparator 3*sa* may have a conventional structure or the structure in the embodiment 3. Although the structure will be described later, any one of the circuit structures can be applied to the embodiment 4.

In sense voltage down converter 3*s* shown in FIG. 31, when activating signal ZACT attains the active state of L-level, the output signal of inverter IV5 attains H-level and MOS transistor 3*sc* is turned on to form a current path to comparator 3*sa* so that the comparing operation starts. When control signal ZSPEED attains the active state of L-level, MOS transistor 3*sd* is turned on through inverter IV6 so that it operates as a current source transistor of comparator 3*sa*, and increases the operation current of comparator 3*sa*. When control signal ZSPEED is made active, comparator 3*sa* increases its operation speed, and quickly responds to change in sense power supply voltage Vccs on sense power supply line 5.

Figure 32:
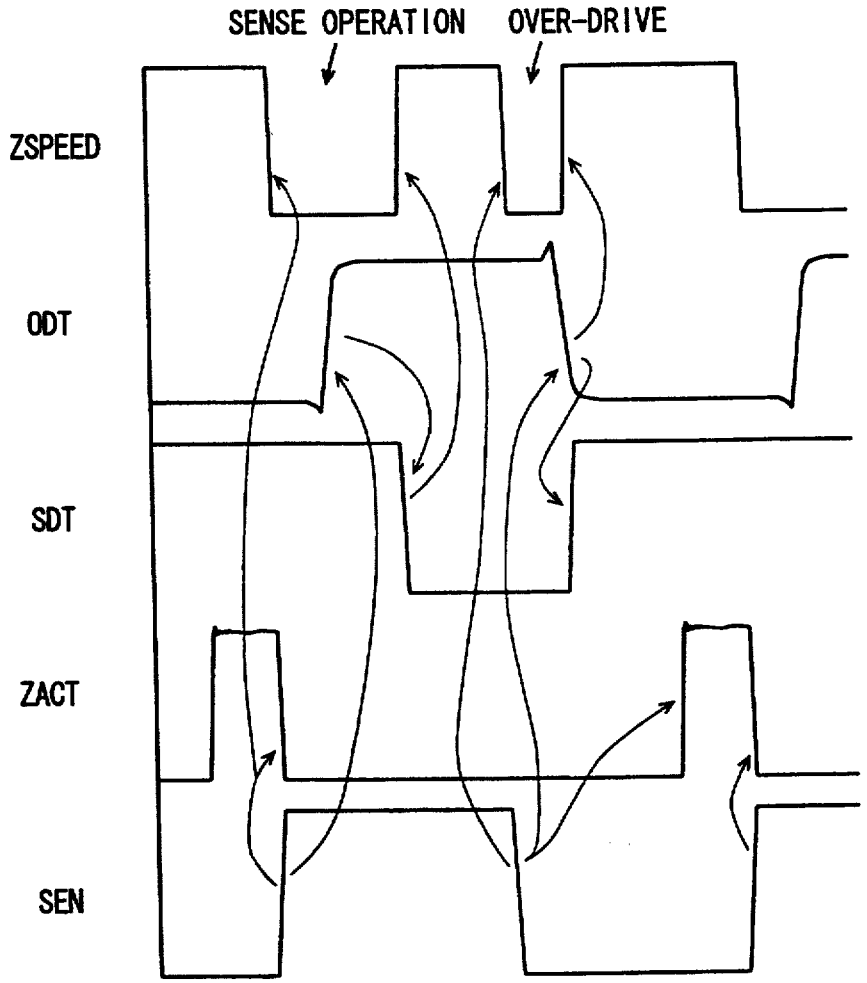
FIG. 32 is a signal waveform diagram representing an operation of the circuit shown in FIG. 30.

Operation of the circuits shown in FIGS. 30 and 31 will be described below with reference to a signal waveform diagram of FIG. 32. When sense activating signal SEN rises from L-level to H-level, the output signal of inverter IV0 lowers to L-level. Responsively, the output signal of NAND circuit NG1 attains H-level, and activating signal ZACT from inverter IV1 attains L-level so that MOS transistor 3*sc* shown in FIG. 31 is turned on, and comparator 3*sa* starts the comparing operation. Meanwhile, the output signal of NAND circuit NG4 rises to H-level. Signal SDT is at H-level because the output signal of output select switch SSW0 is at L-level. Also, the output signal of inverter IV2 attains H-level. Accordingly, the output signal of NAND circuit NG3 attains L-level, and the output signal of NAND circuit NG5 attains L-level so that output signal ZSPEED of inverter IV3 falls to L-level.

When the delay time provided by inverter IV0 and delay inverters DL0–DL6 elapses after sense activating signal SEN rises to H-level, signal ODT generated from output select switch SSW0 rises to H-level. In this state, however, the output signal of inverter IV0 is at L-level, and the output signal of NAND circuit NG4 does not change. When the delay time provided by delay inverters DL7–DL14 elapses after signal ODT from output select switch SSW0 rises to H-level, the output signal of output select switch SSW1 rises to H-level, and the output signal of NAND circuit NG2 rises to H-level so that signal SDT falls to L-level, and the output signal of NAND circuit NG3 attains H-level. Both the inputs of NAND circuit NG5 attain H-level, and the output signal of NAND circuit NG5 attains L-level so that signal ZSPEED of inverter IV3 rises to H-level.

Accordingly, signal ZSPEED maintains the active state of L-level until the delay time of delay inverters DL0–DL14 elapses after activation of sense activating signal SEN. During this period, the operation current of comparator 3*sa* increases, and quickly responds to the change in sense power supply voltage Vccs.

When sense activating signal SEN falls from H-level to L-level and deactivates the sense amplifier, the output signal of NAND circuit NG4 attains L-level because signal ODT is at H-level so that NAND circuit NG5 and inverter IV3 lower signal ZSPEED to L-level. When the delay time of delay inverters DL0–DL14 elapses after sense activating signal SEN falls to L-level, signal ODT falls from H-level to L-level, and the output signal of NAND circuit NG4 is fixed to H-level. When signal ODT falls to L-level, output signal SDT generated from NAND circuit NG2 rises to H-level. The output signal of inverter IV2 is at L-level, and the output signal of NAND circuit NG3 maintains H-level. NAND circuit NG4 raises its output signal to H-level in accordance with signal ODT at L-level, and the output signal of NAND circuit NG5 attains L-level so that signal ZSPEED rises to H-level. Therefore, when sense activating signal SEN changes from the active state to the inactive state, control signal ZSPEED is held in the active state of L-level for a delay time of the delay inverters DL0–DL6. Therefore, when the operation of the sense amplifier is completed, the operation current of comparator 3*sa* increases again, and the current is rapidly supplied to sense power supply line 5 so that an over-drive state is attained, and the sense power supply voltage Vccs is charged to the level of peripheral power supply voltage Vccp. Switch signal ϕSW is produced in response to deactivation of sense activating signal SEN and activation of control signal ZSPEED, and peripheral reference voltage Vrefp is selected as reference voltage Vref. Thereby, the voltage on sense power supply line 5 is preliminarily charged to the level of peripheral power supply voltage Vccp when the sense operation is completed so that lowering of the voltage level of sense power supply voltage Vccs is suppressed during the sense operation, and the sense operation can be performed fast.

Activating signal ZACT is driven to the inactive state of H-level when the delay time of delay inverters DL0–DL19 elapses after sense activating signal SEN changes from the active state to the inactive state.

By selecting an output signal of delay chain 50 for decoding by decode circuit 52, it is possible to produce easily the pulse signal which is driven to the active state in response to activation and deactivation of sense activating signal SEN. At the same, it is possible to produce, from this decode circuit, voltage down converter activating signal ZACT which is activated in response to the activation of sense activating signal SEN, and changes to the inactive state in response to deactivation of sense activating signal SEN after elapsing of a predetermined time (completion of over-driving operation).

Figure 33:
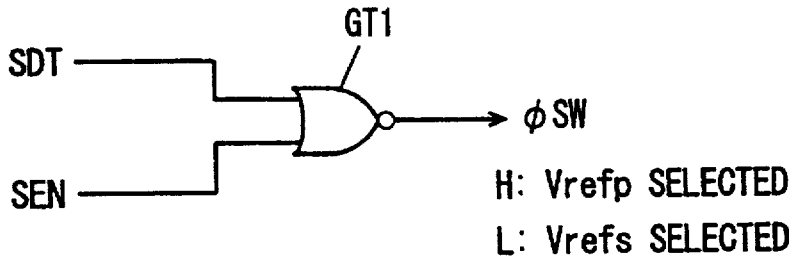
FIG. 33 shows a structure of a switch signal generating portion shown in FIG. 29.

FIG. 33 shows a structure of a portion generating switch signal ϕSW applied to select circuit 4 shown in FIG. 29. In FIG. 33, the switch signal generating portion includes an NOR circuit GTI receiving signal SDT and sense activating signal SEN. When switch signal ϕSW from NOR circuit GTI is at H-level, peripheral reference voltage Vrefp is selected. When switch signal ϕSW is at L-level, sense reference voltage Vrefs is selected. NOR circuit GTI is included in a decode circuit 52 shown in FIG. 29, and is configured to receive, for example, the output signals of inverter IV2 and NAND circuit NG2 shown in FIG. 30. As is apparent from a signal waveform diagram of FIG. 32, sense activating signal SEN and control signal SDT are at L-level only for a period of the over-driving operation so that peripheral reference voltage Vrefp is selected and applied to the sense voltage down converter for this period to raise sense power supply voltage Vccs on sense power supply line 5. During the sensing operation in the normal operation, sense activating signal SEN attains H-level, and switch signal ϕSW is at L-level so that sense reference voltage Vrefs is selected.

[Modification 1]

Figure 34:
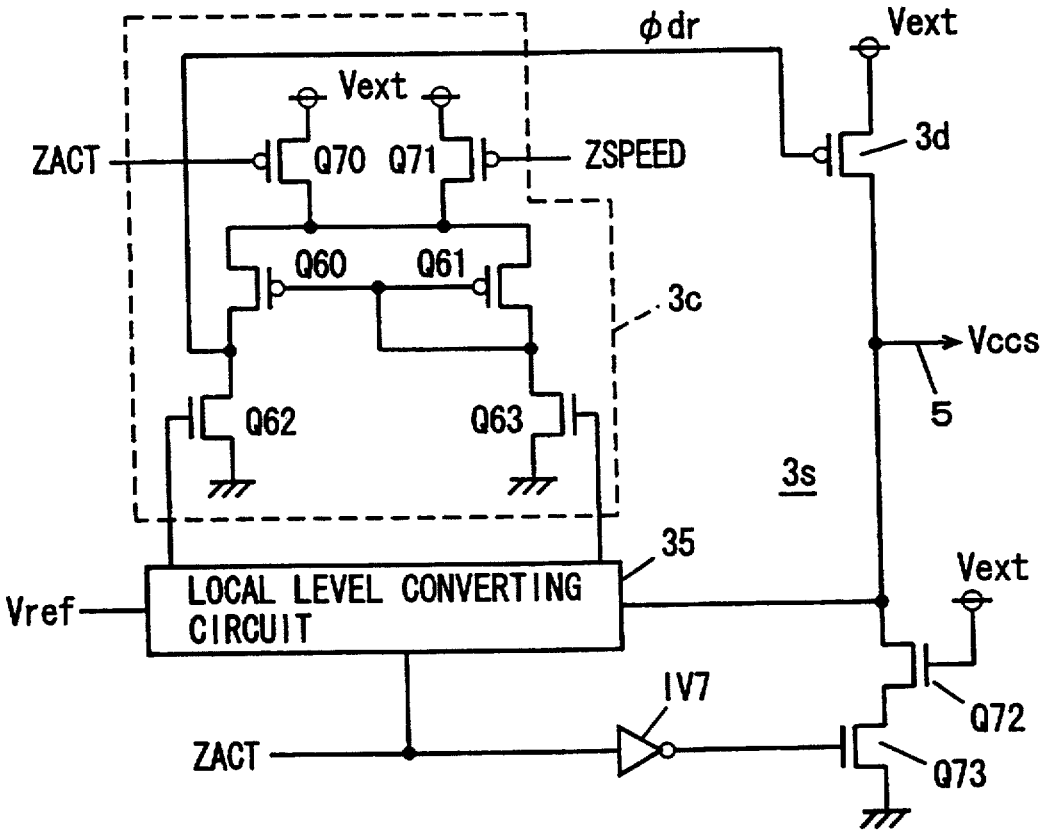
FIG. 34 schematically shows a structure of a modification of the embodiment 5 of the invention.

FIG. 34 shows a structure of a modification 1 of the embodiment 5 of the invention. Sense voltage down converter 3*s* shown in FIG. 34 includes a local level shifting circuit 35 which shifts the levels of reference voltage Vref and sense power supply voltage Vccs on sense power supply line 5, comparator 3*c* which makes a comparison between these level-shifted voltage sent from local level shifting circuit 35, and a current drive transistor 3*d* which supplies a current from the external power supply node to sense power supply line 5 in accordance with the output signal of comparator 3*c*.

In comparator 3*c*, MOS transistors Q62 and Q63 receiving the voltage from local level shifting circuit 35 are coupled to the ground node. Similarly to the voltage down converter shown in FIG. 26, drive control signal ϕdr applied to the gate of current drive transistor 3*d* can be driven to the ground voltage level. A p channel MOS transistor Q70 receiving activating signal ZACT on its gate and a p channel MOS transistor Q71 receiving control signal ZSPEED on its gate are arranged between the external power supply node and MOS transistors Q60 and Q61 forming the current mirror circuit. MOS transistors Q60 and Q61 can discharge the currents supplied from current source transistors Q70 and Q71.

By utilizing the structure shown in FIG. 34, it is possible in the sense amplifier operation to drive control signal ZSPEED to the active state to increase the operation current. Also, in the over-drive operation after the sensing operation, the operation current can be increased in accordance with control signal ZSPEED, and the voltage level of sense power supply voltage Vccs can be raised rapidly.

Between sense power supply line 5 and the ground node, there are arranged an n channel MOS transistor Q72 which has a gate coupled to the external power supply node and operates as a resistance element, and an n channel MOS transistor Q73 which is coupled between MOS transistor Q72 and the ground node and receives activating signal ZACT on its gate through inverter IV7. When sense voltage down converter 3*s* is inactive (in the standby cycle), MOS transistor Q73 is turned off to prevent flow of a current from sense power supply line 5 to the ground node for reducing a current consumption. By increasing the resistance value of MOS transistor Q72, flow of a current from sense power supply line 5 to the ground node is suppressed during operation of sense voltage down converter 3*s*, whereby excessive rising of sense power supply voltage Vccs is prevented, and sense power supply voltage Vccs is precisely transmitted to local level shifting circuit 35.

[Modification 2]

Figure 35:
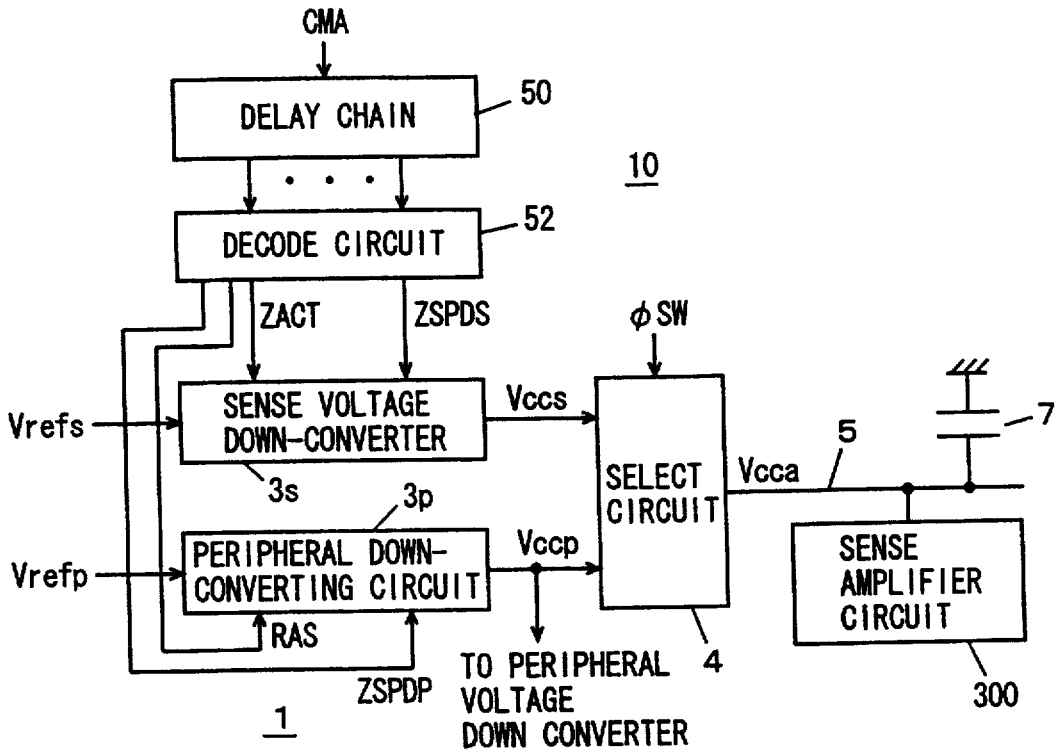
FIG. 35 schematically shows a structure of a modification 2 of the embodiment 5 of the invention.

FIG. 35 schematically shows a structure of a modification 2 of the embodiment 5 of the invention. In the structure shown in FIG. 35, internal power supply circuit 1 includes a sense voltage down converter 3*s* which produces sense power supply voltage Vccs in accordance with reference voltage Vrefs, peripheral voltage down converter 3*p* which produces peripheral power supply voltage Vccp in accordance with peripheral reference voltage Vrefp, and a select circuit 4 which selects one of power supply voltages Vccs and Vccp, respectively from sense voltage down converter 3*s* and peripheral voltage down converter 3*p* in accordance with select control signal ϕSW, and applies the selected voltage as a sense power supply voltage (array power supply voltage) Vcca onto sense power supply line 5.

Figure 36:
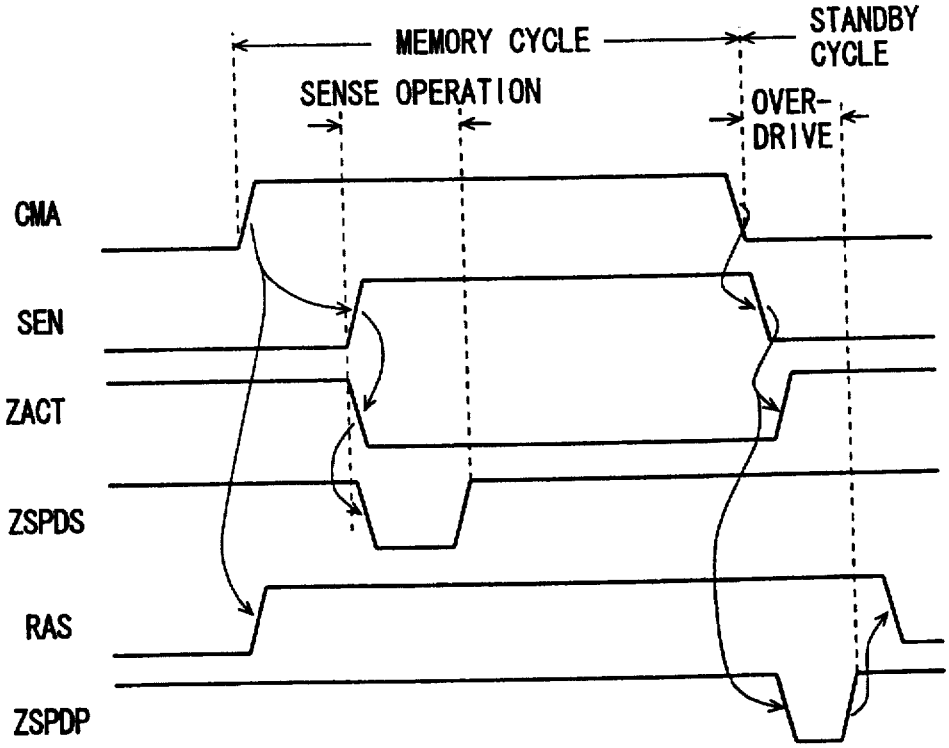
FIG. 36 is a signal waveform diagram representing an operation of the circuit shown in FIG. 35.

Voltage level control circuit 10 includes delay chain 50 which delays the signal instructing start of the internal cycle, and decode circuit 52 which decodes predetermined delay signals of delay circuit 50 and produces signals controlling the operation currents and activation/deactivation of sense voltage down converter 3*s* and peripheral voltage down converter 3*p*. Delay chain 50 produces the sense amplifier activating signal in accordance with memory cycle activating signal CMA, and delays the sense activating signal to produce various control signals ZACT, ZSPDS, PAS and ZSPDP. Operation of the internal power supply circuit shown in FIG. 35 will be described below with reference to a signal waveform diagram of FIG. 36.

When memory cycle activating signal CMA attains the active state of H-level, internal signal RAS instructing start of selection of a memory cell row is driven to the active state of H-level. In the memory cell array, a memory cell row is selected. Peripheral voltage down converter 3*p* is activated.

When a predetermined time elapses, sense amplifier activating signal SEN is driven to the active state of H-level, and sense amplifier circuit 300 shown in FIG. 35 is activated. In response to the activation of sense activating signal SEN, activating signal ZACT is driven to the active state of L-level, and sense voltage down converter 3*s* starts the voltage down-converting operation. In response to the activation of activating signal ZACT, control signal ZSPDS from decode circuit 52 is driven to the active state of L-level for a predetermined period. Responsively, sense voltage down converter 3*s* has its operation current increased, and rapidly compensates for the sense current in the sense operation. When sense amplifier circuit 300 completes the sense operation and enters the state of latching the memory cell data, control signal SPDS attains the inactive state of H-level, and the operation current of sense voltage down converter 3*s* is reduced.

When the memory cycle is completed, memory cycle activating signal CMA is driven to the inactive state of L-level, and sense activating signal SEN is driven to the inactive state of L-level. Sense amplifier circuit 300 is deactivated, and activating signal ZACT attains the inactive state of H-level so that sense voltage down converter 3*s* stops its voltage down-converting operation.

In response to deactivation (L-level) of memory cycle activating signal CMA, control signal ZSPDP is driven to the active state of L-level, and the operation current of peripheral voltage down converter 3*p*, activated by signal RAS increases. The select circuit 4 selects peripheral power supply voltage Vccp from peripheral voltage down converter 3*p* in accordance with switch signal ϕSW, for transmission to sense power supply line 5. Since the operation current of peripheral voltage down converter 3*p* increases, sense power supply line 5 is rapidly charged to the level of peripheral power supply voltage Vccp by the increased operation current. When control signal ZSPDP is deactivated and the over-drive of sense power supply line 5 is completed, signal RAS instructing start of the memory cell selection attains the inactive state of L-level, and the peripheral voltage down converter 3*p* is deactivated to stop the voltage down-converting operation.

In the structure shown in FIG. 35, control signal ZSPDS increases the operation current of sense voltage down converter 3*s* during operation of sense amplifier circuit 300, and the operation current of peripheral voltage down converter 3*p* is increased for over-driving sense power supply line 5 (rapidly charging stabilizing capacitance 7) after the memory cycle is completed, i.e., when sense amplifier circuit 300 is inactive. Control signals ZACT, RAS, ZSDPS and ZSPDP for the above operation are produced by delay chain 50 and decode circuit 52.

Figure 37:
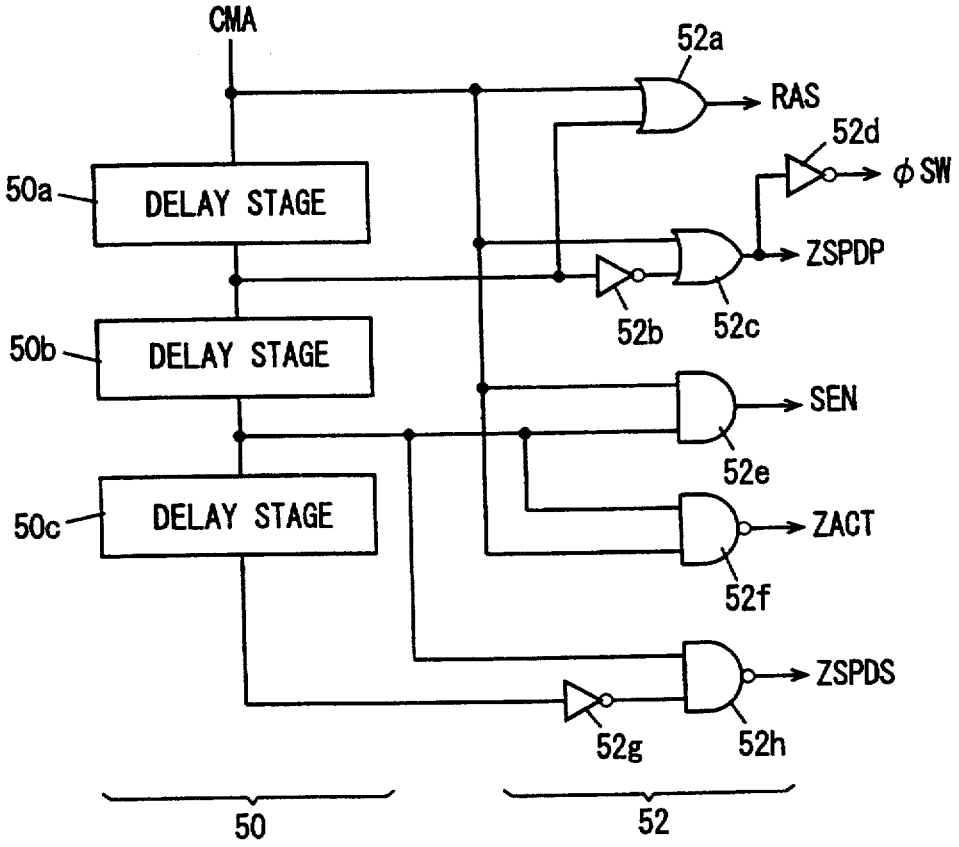
FIG. 37 schematically shows structures of a delay chain and a decode circuit shown in FIG. 35.

FIG. 37 schematically shows structures of delay chain 50 and decode circuit 52 shown in FIG. 35. In FIG. 37, delay chain 50 includes three cascaded delay stages 50a, 50b and 50c. Each of delay stages 50*a*–50*c* delays memory cycle activating signal CMA by a predetermined time.

Decode circuit 52 includes an OR circuit 52*a* receiving memory cycle activating signal CMA and the output signal of delay stage 50*a*, an inverter 52*b* inverting the output signal of delay stage 50*a*, an OR circuit 52*c* receiving the output signal of inverter 52*b* and memory cycle activating signal CMA, and an inverter 52*d* inverting the output signal of OR circuit 52*c*. OR circuit 52*a* generates internal signal RAS instructing start of selection of a memory cell row. OR circuit 52*c* generates control signal ZSPDP. Inverter 52*d* generates select instructing signal ϕSW. Signal RAS instructing start of selection of the memory cell row is driven to the active state when memory cycle activating signal CMA is driven to the active state, and is held active until the output signal of delay stage 50*a* is driven to the inactive state. Therefore, signal RAS is driven to the inactive state when the delay time of delay stage 50*a* elapses after deactivation of memory cycle activating signal CMA. After memory cycle activating signal CMAC is activated, control signal ZSPDP is held at L-level until the output signal of delay stage 50*a* reaches the inactive state of L-level. Therefore, control signal ZSPDP is driven to the active state of L-level when the memory cycle is completed, and is kept active for a period equal to the delay time of delay stage 50*a*. Switch signal ϕSW is at H-level when control signal ZSPDP is active, whereby select circuit 4 shown in FIG. 35 selects peripheral power supply voltage Vccp from peripheral voltage down converter 3*p*.

Decode circuit 52 includes AND circuit 52*e* which receives memory cycle activating signal CMA and the output signal of delay stage 50*b*, an NAND circuit 52*f* which receives memory cycle activating signal CMA and the output signal of delay stage 50*b*, an inverter 52*g* which inverts the output signal of delay stage 50*c*, and an NAND circuit 52*h* which receives the output signal of delay stage 50*b* and the output signal of inverter 52*g*. AND circuit 52*e* generates sense activating signal SEN. Sense activating signal SEN is driven to the active state after the delay time of delay stages 50*a* and 50*b* elapses from the time when memory cycle activating signal CMA is driven to the active state of H-level, and is driven to the inactive state in response to deactivation of memory cycle activating signal CMA.

NAND circuit 52*f* generates activating signal ZACT, which in turn is driven to the active state of L-level for the substantially same period as sense activating signal SEN. NAND circuit 52*h* generates control signal ZSPDS, which in turn is driven to the active state of L-level for a period equal to the delay time of delay stage 50*c* when the output signal of delay stage 50*b* attains H-level, i.e., when sense activating signal SEN is activated. Thereby, the operation current of sense voltage down converter 3*s* is increased to increase the response speed in the sensing operation, and lowering of the sense power supply voltage is suppressed.

In the case of a standard DRAM, memory cycle activating signal CMA is driven to the active state in accordance with externally supplied row address strobe signal ext/RAS. In the case of a clock synchronous semiconductor memory device which operates in synchronization with a clock signal, memory cycle activating signal CMA is driven to the active state in response to an externally applied active command, and is driven to the inactive state in response to a precharge command.

When activating signals ZACT and RAS are active, sense voltage down converter 3*s* and peripheral voltage down converter 3*p* are activated, and the operation currents of sense voltage down converter 3*s* and peripheral voltage down converter 3*p* are increased when control signals ZSPDS and ZSPD are active. Sense voltage down converter 3*s* and peripheral voltage down converter 3*p* may have the structure shown in either FIG. 31 or FIG. 34. It is required merely to apply activating signal ZACT (or RAS) and control signal ZSPDS (or ZSPDP) to the current source transistor.

The select circuit 4 can be usually formed of a CMOS transmission gate.

According to the embodiment 5 of the invention, as described above, a plurality of timing signals are produced from one signal by the delay chain, and these plurality of timing signals are decoded to produce the signals controlling the operation current of the voltage down converter and activation/deactivation of the voltage down converter. Therefore, it is not necessary to provide independent delay circuits for the control signal controlling the activation/deactivation and for the control signal controlling the operation current thereof. Accordingly, the circuit elements can be reduced in number so that the area occupied by the circuitry and the current consumption can be reduced.

EMBODIMENT 6

Figure 38:
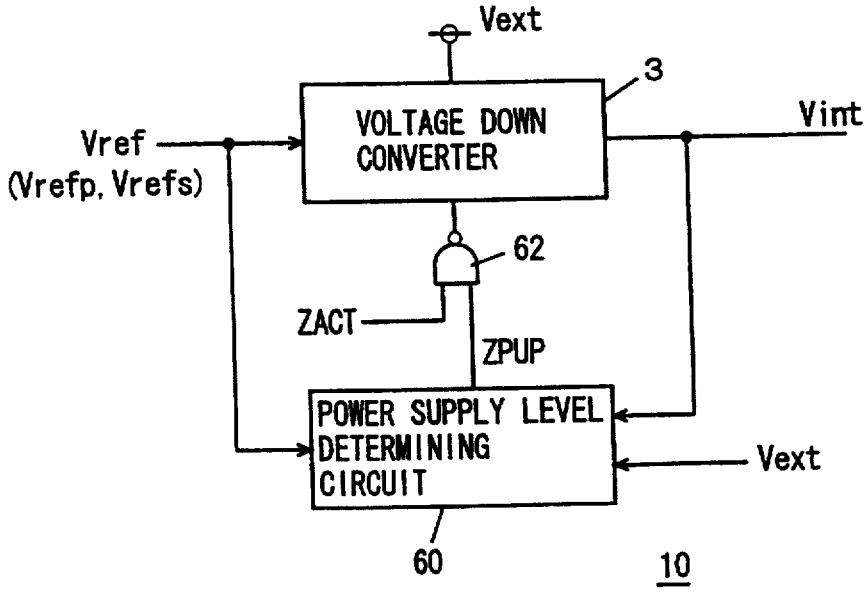
FIG. 38 schematically shows a structure of a main portion of a semiconductor memory device according to an embodiment 6 of the invention.

FIG. 38 shows a structure of a main portion of a semiconductor memory device according to an embodiment 6 of the invention. In FIG. 38, there is provided a power supply level determining circuit 60 for forcedly activating voltage down converter 3 until internal power supply voltage Vint reaches a predetermined voltage level after power-on. Power supply level determining circuit 60 receives external power supply voltage Vext, internal power supply voltage Vint and reference voltage Vref, and determines whether internal power supply voltage Vint reaches a predetermined level or not. When it is determined from the relationship to external power supply voltage Vext that internal power supply voltage Vint reaches the predetermined voltage level, forced-activating signal ZPUP is driven to H-level. NAND circuit 62 receives activating signal ZACT and forced-activating signal ZPUP from power supply level determining circuit 60, and drives voltage down converter 3 to the active state when one of these received signals is active. Voltage down converter 3 may be either the sense voltage down converter or the peripheral voltage down converter, and may include the structure already described in connection with the embodiment 4 or a structure similar to a conventional voltage down converter.

In the structure employing power supply level determining circuit 60 described above, a power-on detection (reset) signal POR is not used, and the external power supply node is not directly connected to the internal power supply line. Therefore, it is possible to prevent internal power supply voltage Vint from being driven by external power supply voltage Vext, and internal power supply voltage Vint can be changed in accordance with reference voltage Vref so that the internal circuits can be prevented from being suffered from an excessively large voltage.

Figure 39:
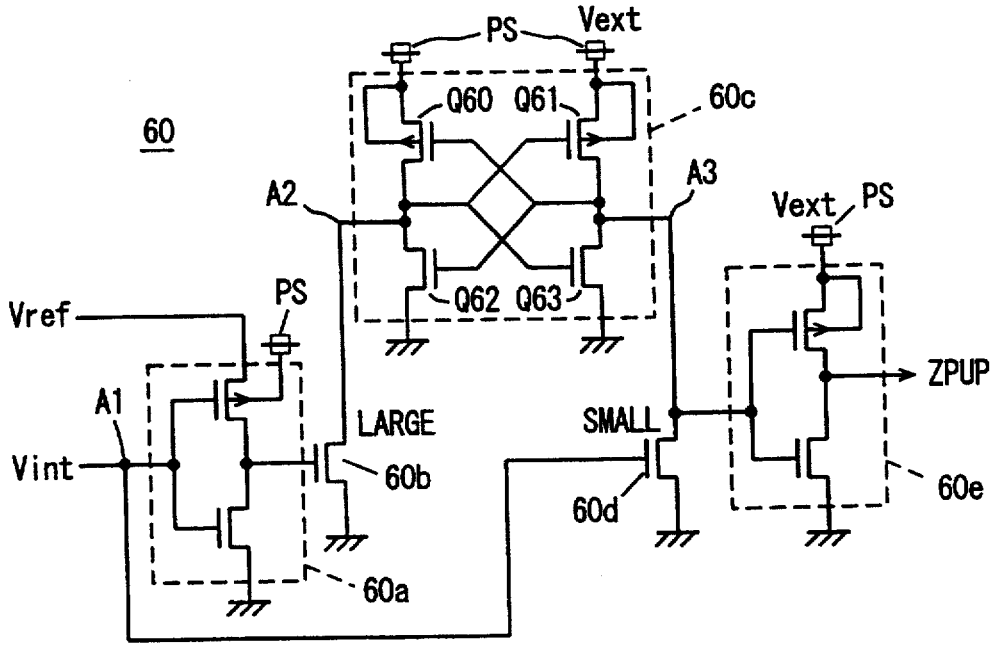
FIG. 39 shows a structure of a power supply level determining circuit shown in FIG. 38.

FIG. 39 shows a specific structure of power supply level determining circuit 60 shown in FIG. 38. In FIG. 39, power supply level determining circuit 60 includes a CMOS inverter 60*a* which uses reference voltage Vref as one operation power supply voltage, to invert internal power supply voltage Vint, an n channel MOS transistor 60*b* which discharges a node A2 to the ground voltage level in accordance with the output signal of CMOS inverter 60*a*, a CMOS inverter latch 60*c* which latches the voltages on nodes A2 and A3, an n channel MOS transistor 60d which discharges node A3 to the ground voltage level in accordance with internal power supply voltage Vint, and a CMOS inverter 60*e* which inverts the signal voltage on node A3, to generate forced-activating signal ZPUP.

CMOS inverter latch 60*c* includes a CMOS inverter formed of p channel MOS transistor Q60 and n channel MOS transistor Q62 connected between power supply node PS receiving external power supply voltage Vext and the ground node and having gates connected to node A3 and another CMOS inverter formed of p channel MOS transistor Q61 and n channel MOS transistor Q63 connected between external power supply node PS and the ground node and having gates connected to node A2.

Reference voltage Vref is used for producing internal power supply voltage Vint in voltage down converter 3, and is produced from external power supply voltage Vext (see the embodiments 1 and 2). Each of CMOS inverter latch 60*c* and CMOS inverter 60*e* uses external power supply voltage Vext supplied to external power supply node PS as one operation power supply voltage. Reference voltage Vref reaches and is stabilized at a predetermined voltage level faster than internal power supply voltage Vint does. Now, operation of power supply level determining circuit 60 shown in FIG. 39 will be described below with reference to a signal waveform diagram of FIG. 40.

Figure 40:
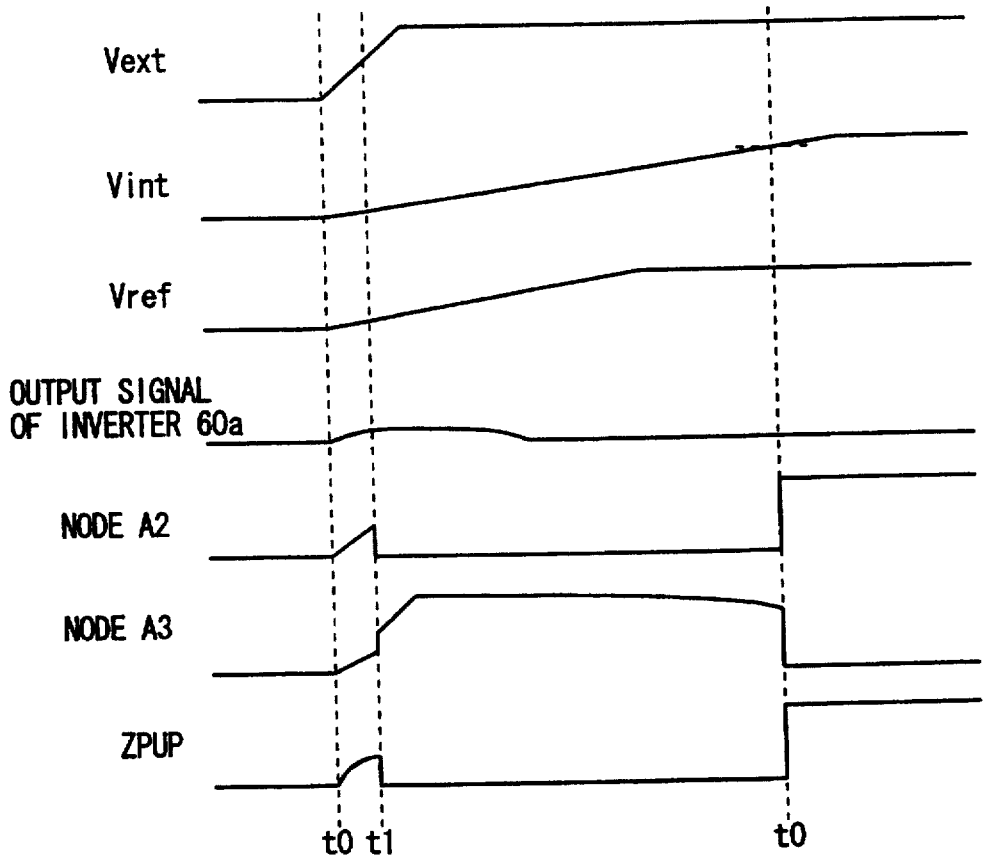
FIG. 40 is a signal waveform diagram representing an operation of the power supply level determining circuit shown in FIG. 39.

At time t0, power is turned on, and the voltage level of external power supply voltage Vext on external power supply node PS rises. Immediately after the power-on, reference voltage Vref rises more rapidly than internal power supply voltage Vint. Thus, in CMOS inverter 60*a*, the conductance of the p channel MOS transistor is larger than the conductance of n channel MOS transistor, and the voltage level of the output signal of CMOS inverter 60*a* rises in accordance with the rising level of reference voltage Vref. In CMOS inverter latch 60*c* immediately after the power-on, p channel MOS transistors Q60 and Q61 are on (the gate-source voltages are larger than the absolute values of their threshold voltages, respectively), and the voltage levels on node A2 and A3 rise in accordance with the rising level of external power supply voltage Vext. In CMOS inverter 60*e*, the conductance of the p channel MOS transistor is larger than the conductance of n channel MOS transistor, and the voltage level of forced-activating signal ZPUP slowly rises. This voltage level, which is exaggerated in FIG. 40, is extremely low, and NAND circuit 62 shown in FIG. 38 determines that forced-activating signal ZPUP is at L-level, and generates the output signal at H-level. Thereby, voltage down converter 3 maintains the active state, and raises the voltage level of internal power supply voltage Vint by comparing reference voltage Vref and internal power supply voltage Vint with each other.

At time t1, the voltage level of the output signal of CMOS inverter 60*a* exceeds the threshold voltage of n channel MOS transistor 60*b*, whereby MOS transistor 60*b* is turned on, and MOS transistors 60*b* and Q62 drive node A2 to the ground voltage level. N channel MOS transistor 60*d* is used for determining the voltage level of internal power supply voltage Vint, and has the threshold voltage or the current driving capability set to be larger or smaller than that of n channel MOS transistor 60*b*. When node A2 is driven to the ground voltage level, n channel MOS transistor Q63 in CMOS inverter latch 60*c* is turned off, and p channel transistor Q61 attains a stronger onstate and couples node A3 to external power supply node PS to raise voltage level at node A3 to external power supply voltage Vext level. Since the voltage level on node A3 rises to the level of external power supply voltage Vext, CMOS inverter 60*e* has the p channel MOS transistor and the n channel MOS transistor therein turned off and on, respectively. Therefore, forced-activating signal ZPUP is driven to the ground voltage level.

As the voltage level of internal power supply voltage Vint rises, in CMOS inverter 60*b* the conductance of the n channel MOS transistor exceeds the conductance of the p channel MOS transistor, and the voltage level of the output signal of CMOS inverter 60*a* lowers and is finally driven to the ground voltage level (because the difference between reference voltage Vref and internal power supply voltage Vint becomes smaller than the difference between internal power supply voltage Vint and the ground voltage). Thereby, n channel MOS transistor 60*b* is turned off, and node A2 is held at the ground voltage level by n channel MOS transistor Q62 included in CMOS inverter latch 60*c*. Meanwhile, node A3 is held at the voltage level of external power supply voltage Vext by p channel MOS transistor Q61.

As the voltage level of internal power supply voltage Vint rises, the conductance of n channel MOS transistor 60*d* receiving internal power supply voltage Vint on its gate increases. When the conductance of n channel MOS transistor 60*d* exceeds that of p channel MOS transistor Q61 charging node A3 to the level of external power supply voltage Vext, the voltage level on node A3 starts to lower.

At time t2, internal power supply voltage Vint applied to node A1 reaches a predetermined voltage level. N channel MOS transistor 60*d* has a sufficiently increased conductance, and the voltage level on node A3 further lowers so that the current supplying capability of p channel MOS transistor Q60 exceeds the current supplying capability of n channel MOS transistor Q62, and the voltage level on node A2 rises. Therefore, p channel MOS transistor Q61 changes to the off state. Through a series of these operations, the latch state of CMOS inverter 60*c* is inverted so that the voltage level on node A3 attains the ground voltage level, and node A2 attains the voltage level of external power supply voltage Vext. As the voltage level on node A3 lowers, forced-activating signal ZPUP from CMOS inverter 60*e* rises to H-level of external power supply voltage Vext. Responsively, the output signal of NAND circuit 62 shown in FIG. 38 attains L-level, and voltage down converter 3 stops the voltage down-converting operation.

Although the predetermined voltage level of internal power supply voltage Vint is set to be lower than or equal to reference voltage Vref, internal power supply voltage Vint is driven by a not shown standby voltage down converter, which always operates, and thereby substantially reaches the predetermined voltage.

If the voltage levels on nodes A2 and A3 change and the forced-activating signal ZPUP is driven to the inactive state with a delay to time t2 when internal power supply voltage Vint reaches the predetermined voltage level, this delay time may be utilized for internal power supply voltage Vint to reach the predetermined voltage level in this delay time. Thereby, the internal power supply voltage can be initialized upon power-on without directly transmitting external power supply voltage Vext to the internal power supply line.

As shown in FIG. 39, CMOS inverter 60*a* uses, as one power supply voltage, reference voltage Vref which changes sufficiently slowly compared with external power supply voltage Vext, so that internal nodes A2 and A3 can be reliably set to the initial state.

When external power supply voltage Vext is stabilized and internal power supply voltage Vint reaches the predetermined voltage level, the current driving capabilities of MOS transistors Q61 and Q62 are adjusted by the gate voltages thereof and, as a result, it is determined based on the voltage level of external power supply voltage Vext whether internal power supply voltage Vint reaches the predetermined voltage level or not. The criterion level for the internal power supply voltage Vint is determined by adjusting the current driving capability or the threshold voltage of MOS transistor 60*d*. However, the determination is performed based on the difference in current driving capability between MOS transistor Q61 for charging node A3 of CMOS inverter latch 60*c* and n channel MOS transistor 60*d* for discharging node A3. As a result, the voltage level of internal power supply voltage Vint is detected based on the voltage level of external power supply voltage Vext. Thereby, the stable operation of detecting the internal power supply voltage is achieved.

In the case where CMOS inverter 60*a* uses external power supply voltage Vext as one operation power supply voltage, the current always flows through CMOS inverter 60*a* when internal power supply voltage Vint is at the voltage level lower than external power supply voltage Vext, resulting in increase in current consumption. Even if the internal power supply voltage Vint reaches the predetermined voltage level, the output signal of CMOS inverter 60*a* is not discharged to the ground voltage level (i.e., n channel MOS transistor 60*b* is not set to the completely off state). Therefore, the latch state of CMOS inverter latch 60*c* cannot be inverted when internal power supply voltage Vint reaches the predetermined voltage level. By utilizing reference voltage Vref which is at the voltage level lower than or equal to internal power supply voltage Vint and is produced from external power supply voltage Vext, the latch state of CMOS inverter latch 60*c* can be quickly inverted when internal power supply voltage Vint reaches the predetermined voltage level, because MOS transistor 60*b* can be completely turned off.

[Modification]

Figure 41:
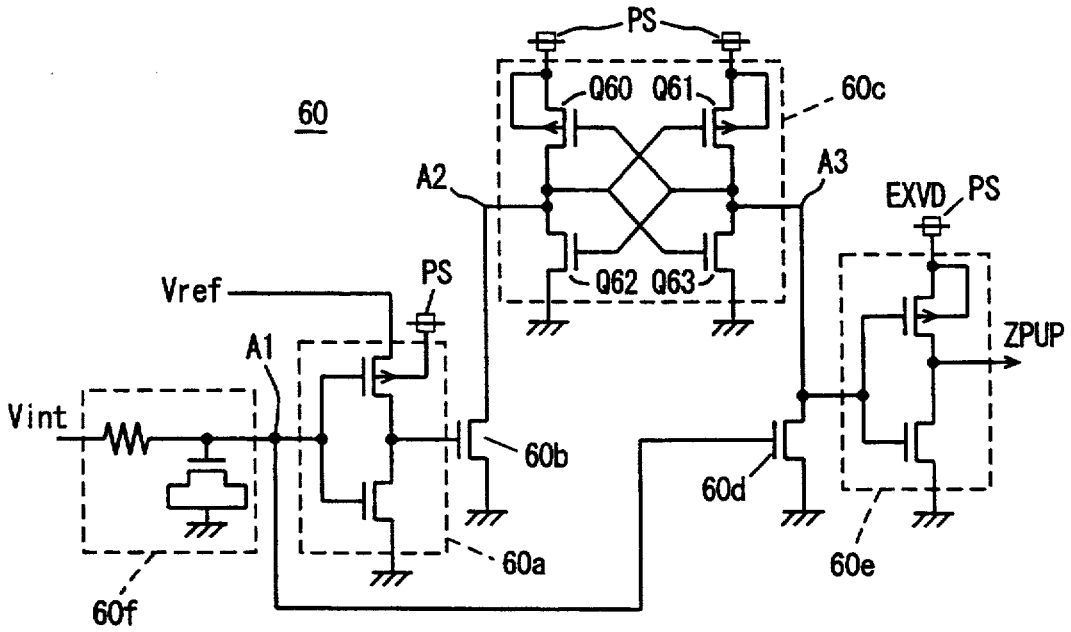
FIG. 41 shows a modification of the power supply level determining circuit shown in FIG. 39.

FIG. 41 shows a structure of a modification of power supply level determining circuit 60 shown in FIG. 39. Power supply level determining circuit 60 shown in FIG. 41 is provided with an RC delay circuit 60*f* receiving internal power supply voltage Vint at input node Al of CMOS inverter 60*a*. RC delay circuit 60*f* includes a resistance element and an MOS capacitor. Other structures are the same as those shown in FIG. 39. Corresponding portions bear the same reference numerals, and will not be described in detail below.

In the structure shown in FIG. 41, RC delay circuit 6*f* can adjust the rate of change in signal voltage on input node A of CMOS inverter 60*a*, and time t2 of deactivation of forced-activating signal ZPUP can be set to provide appropriate timing in a signal waveform diagram of FIG. 40. By adjusting the rate of change in voltage on input node A in accordance with the rate of change in reference voltage Vref, the voltage levels on internal latch nodes A2 and A3 can be reliably set to L- and H-levels, respectively, after temporarily these voltage levels rise. Accordingly, such a situation can be prevented that the latch is performed on internal latch nodes A2 and A3 at instable voltage levels, and CMOS inverter 60*c* enters an erroneous internal latch state. Thus, accurate circuit operation can be ensured. Further, RC delay circuit 60*f* can function as a low pass filter. More specifically, when a circuit using internal power supply voltage Vint may operate after rising of internal power supply voltage Vint, the current consumption may temporarily increase, and internal power supply voltage Vint may rapidly change. Even in this case, RC delay circuit 60*f* functions as a low pass filter against such high frequency change in voltage of internal power supply voltage Vint, and suppresses erroneous starting of the internal latch operation of power supply level determining circuit 60.

[Modification 2]

Figure 42:
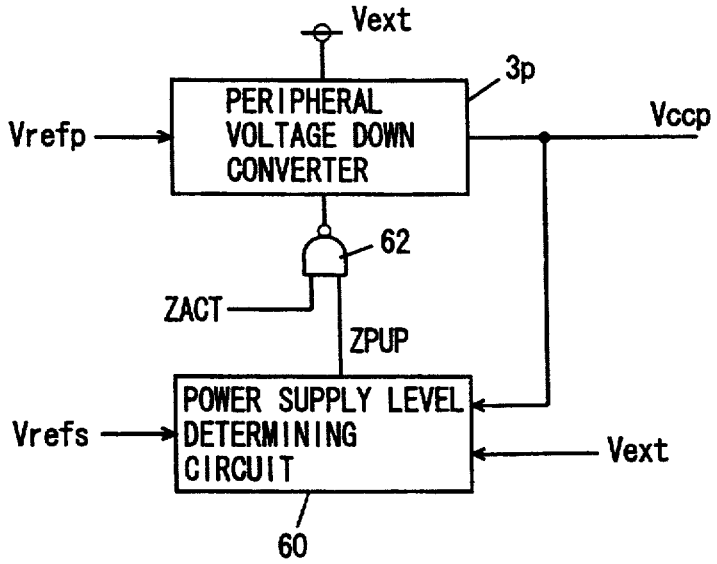
FIG. 42 schematically shows a structure of a modification 2 of the embodiment 6 of the invention.

FIG. 42 schematically shows a structure of a modification 2 of the embodiment 6 of the invention. In the structure shown in FIG. 42, peripheral voltage down converter 3*p* is supplied with forced-activating signal ZPUP from voltage level determining circuit 60 through gate circuit 62, for controlling activation/deactivation of the voltage down-converter 3*p*. Power supply level determining circuit 60 receives sense reference voltage Vrefs, and reliably performs the initialization of latch nodes A2 and A3 of CMOS inverter latch 60*c* shown in FIGS. 39 and 41, based on the relationship between sense reference voltage Vrefs and peripheral power supply potential Vccp. Sense reference voltage Vrefs reaches the stable state more slowly than external power supply voltage Vext, and changes to the stable state faster than peripheral power supply potential Vccs. Accordingly, by using sense reference voltage Vrefs and external power supply voltage Vext for determining the voltage level of peripheral power supply voltage Vccp, the level determination can be accurately performed.

In particular, peripheral power supply voltage Vccp is directly applied to MOS transistors which are components of peripheral circuitry. Therefore, elements may be destructed if external power supply voltage Vext is directly applied upon power-on. By utilizing the structure shown in FIG. 42, it is possible to prevent destruction of the elements of the peripheral circuitry which may be caused by application of a high voltage upon power-on. The sense power supply voltage is transmitted to the sense amplifier through a sense amplifier activating transistor. Since a large number of sense amplifiers are connected to the sense power supply line, the sense power supply line has a large load capacitance, and rapid rising of the voltage does not occur owing to the large load capacitance, which reduces a possibility of the element destruction due to rapid rising of the sense power supply voltage upon power-on. Accordingly, by applying forced-activating signal ZPUP to the peripheral voltage down converter from power supply level determining circuit 60 and controlling activation/deactivation of the voltage down-converter, it is possible to prevent the element destruction of the internal circuitry of the semiconductor memory device upon power on.

In the structure shown in FIG. 42, forced-activating signal ZPUP from power supply level determining circuit 60 may be used for forcibly activating sense voltage down converter 3*s*.

When sense reference voltage Vrefs is stable, the voltage level of sense reference voltage Vrefs is lower than peripheral power supply voltage Vccp, and can reliably drive the output signal of CMOS inverter 60*a* shown in FIGS. 39 or 41 to L-level for holding thereat.

The output signal of NAND circuit 62 is applied to the gate of the current source transistor of the internal voltage down converter of the internal power supply circuit in the foregoing embodiment 4.

[Modification 3]

Figure 43:
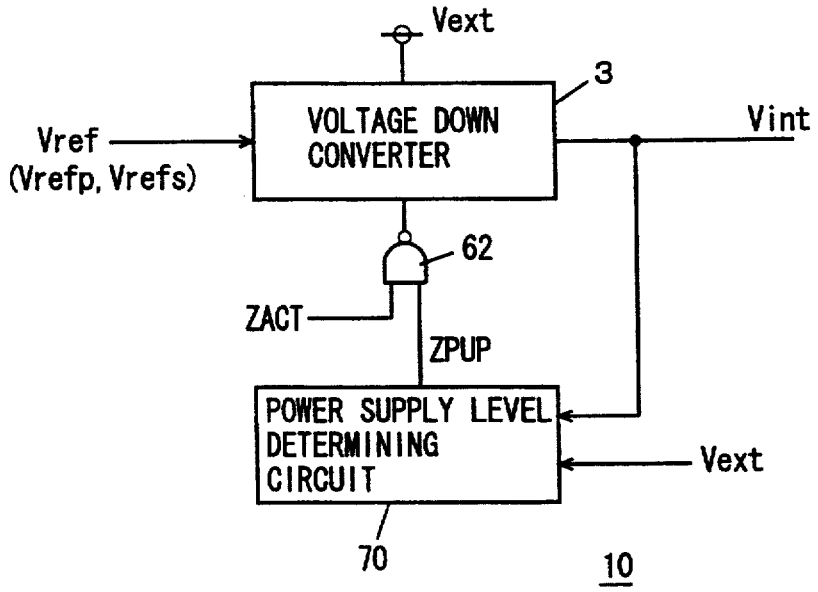
FIG. 43 schematically shows a structure of a modification 3 of the embodiment 6 of the invention.

FIG. 43 schematically shows a structure of a modification 3 of the embodiment 6 of the invention. In the structure shown in FIG. 43, voltage level control circuit 10 includes a power supply level determining circuit 70 which detects the voltage level of internal power supply voltage Vint, using the voltage of external power supply voltage Vext. When internal power supply voltage Vint and external power supply voltage Vext satisfy a predetermined relationship, power supply level determining circuit 70 drives forced-activating signal ZPUP to the inactive state. While forced-activating signal ZPUP is active, voltage down converter 3 performs the voltage down-converting operation to produce internal power supply voltage Vint at the level of reference voltage Vref from external power supply voltage Vext.

As shown in FIG. 43, the voltage level of internal power supply voltage Vint is detected, using external power supply voltage Vext which is stabilized at the fastest timing in the device, so that the stable operation of detecting the voltage level can be ensured.

Figure 44:
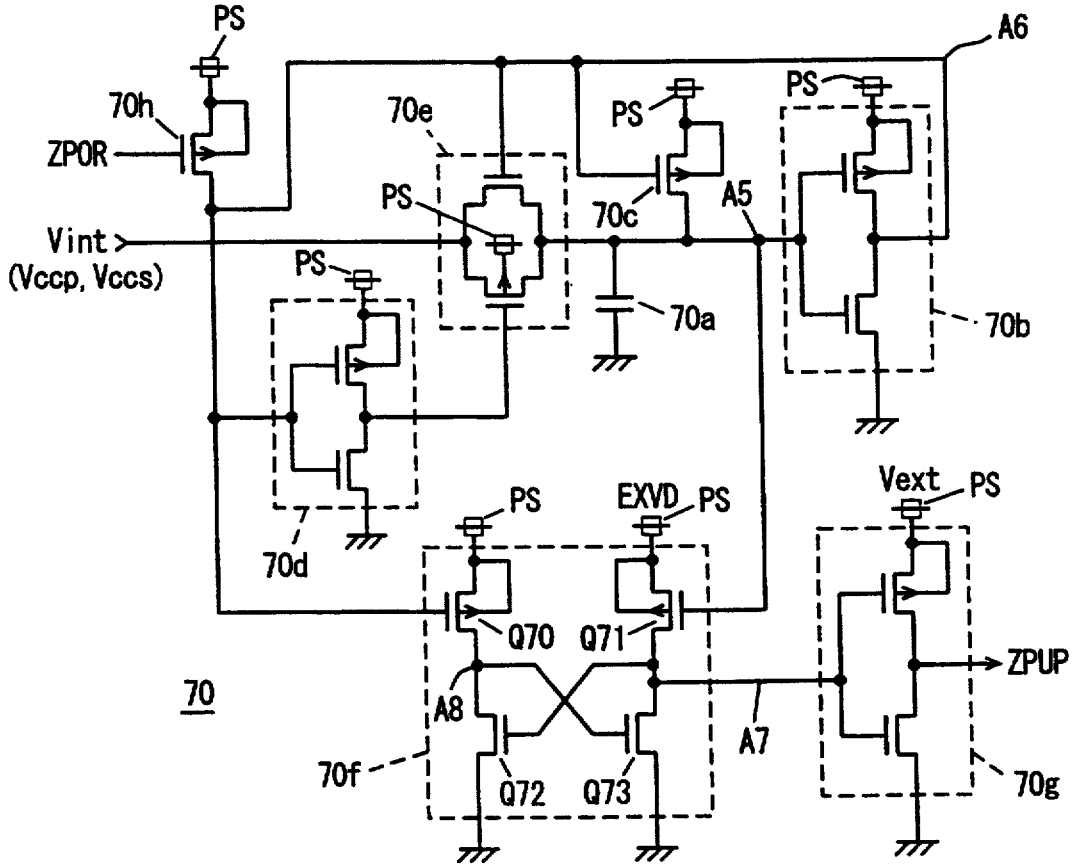
FIG. 44 shows a structure of a power supply level determining circuit shown in FIG. 43.

FIG. 44 shows a specific structure of the power supply level determining circuit 70 shown in FIG. 43. In FIG. 44, power supply level determining circuit 70 includes a capacitance element 70*a* which is connected between a node A5 and the ground node, a CMOS inverter 70*b* which operates using, as one operation power supply voltage, external power supply voltage Vext applied to external power supply node PS and receives the signal on node A5, a p channel MOS transistor 70*c* which selectively couples node A5 to external power supply node PS in accordance with the output signal of CMOS inverter 70*b* applied onto node A6, a CMOS inverter 70*d* which operates using, as one operation power supply voltage, external power supply voltage Vext applied from external power supply node PS, and receives the output signal of CMOS inverter 70*b* applied onto node A6, a CMOS transmission gate 70*e* which is selectively turned on in response to the output signals of CMOS inverters 70*b* and 70*d*, to selectively transmit internal power supply voltage Vint onto node A5, a comparison latch circuit 70*f* which makes a comparison between the signal voltages on nodes A5 and A6, and latches the signal representing the result of the comparison, a CMOS inverter 70*g* which operates using, as one operation power supply voltage, external power supply voltage Vext applied to external power supply node PS, and generates forced-activating signal ZPUP by inverting the signal on output node A7 of comparison latch circuit 70*f*.

Each of CMOS inverters 70*b*, 70*d* and 70*g* includes p and n channel MOS transistors connected between external power supply node PS and the ground node. CMOS transmission gate 70*e* includes an n channel MOS transistor receiving on its gate the output signal of CMOS inverter 70*b*, and a p channel MOS transistor connected in parallel with this n channel MOS transistor and receives on its gate the output signal of CMOS inverter 70*d*.

Comparison latch circuit 70*f* includes a p channel MOS transistor Q70 which is connected between external power supply node PS and a node A8 and has a gate connected to node A6, an n channel MOS transistor Q71 which is connected between external power supply node PS and node A7 and has a gate connected to node A5, an n channel MOS transistor Q72 which is connected between node A8 and the ground node and has a gate connected to node A7, and an n channel MOS transistor Q73 which is connected between node A7 and the ground node and has a gate connected to node A8.

Figure 45:
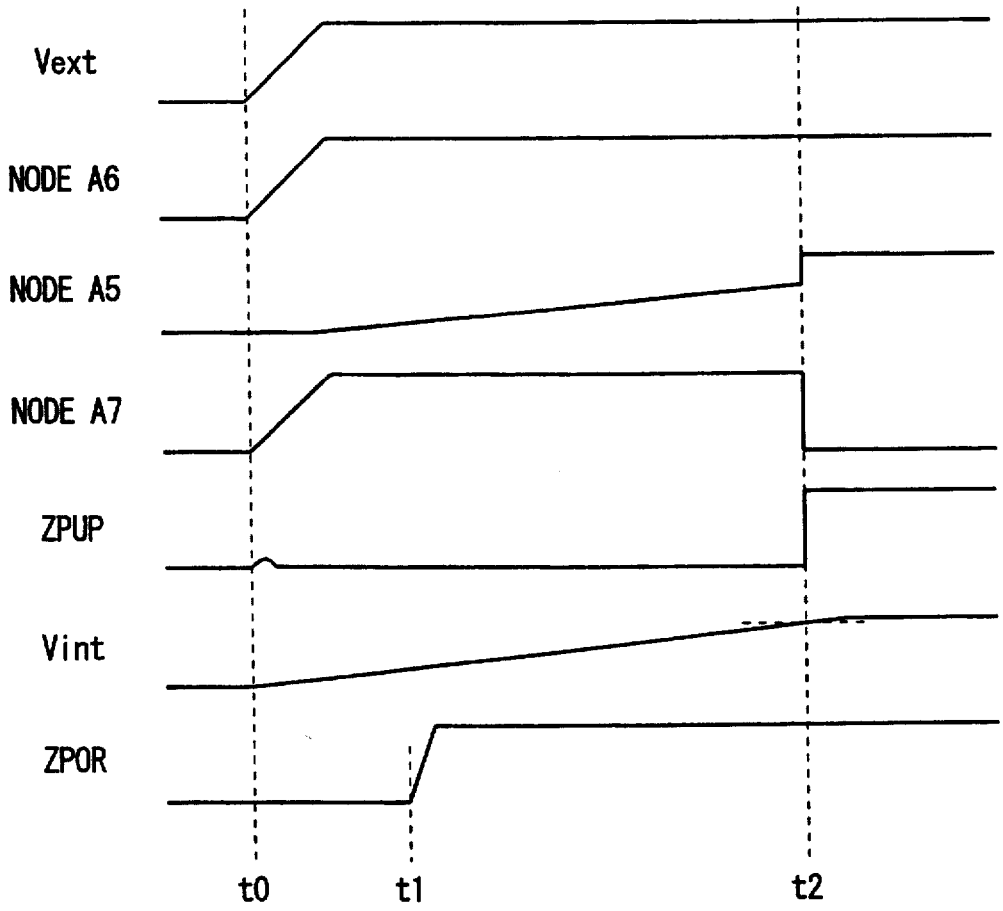
FIG. 45 is a signal waveform diagram representing an operation of the power supply level determining circuit shown in FIG. 44.

Power supply level determining circuit 70 further includes a p channel MOS transistor 70*h* which is connected between power supply node PS and node A6 and has a gate receiving power-on detection signal ZPOR. Internal power supply voltage Vint is sense power supply voltage Vccs produced from the sense power supply circuit or peripheral power supply voltage Vccp produced from the peripheral power supply circuit. Operation of the power supply level determining circuit 70 shown in FIG. 44 will now be described below with reference to a signal waveform diagram of FIG. 45.

At time t0, the power is turned on, and the voltage level of external power supply voltage Vext rises. When the power is turned on, power-on detection signal ZPOR is at L-level so that p channel MOS transistor 70*h* is turned on, and the voltage level on node A6 rises with the voltage level of external power supply voltage Vext. The voltage level on node A5 is lower than the input logical threshold voltage of CMOS inverter 70*b*, and therefore the output signal of CMOS inverter 70*b* rises in accordance with the voltage level of external power supply voltage Vext. In CMOS inverter 70*d*, the p channel MOS transistor maintains the off state because the voltage level on node A6 rises in accordance with the voltage level of external power supply voltage Vext. Therefore, the output signal of CMOS inverter 70*d* is at the ground voltage level of L-level. Accordingly, CMOS transmission gate 70*a* is turned on, and internal power supply voltage Vint is transmitted to node A5. Node A5 is connected to capacitance element 70*a*, and is charged in accordance with internal power supply voltage Vint, so that the voltage level on node A5 slowly rises.

As already described, internal power supply voltage Vint is produced from external power supply voltage Vext based on the comparison with reference voltage Vref produced from external power supply voltage Vext. After the power-on, therefore, the voltage level of internal power supply voltage Vint rises in accordance with the voltage level of reference voltage Vref, which in turn rises in accordance with the voltage level of external power supply voltage Vext.

In comparison latch circuit 70*f*, the conductance of p channel MOS transistor Q71 is larger than the conductance of p channel MOS transistor Q70 because the voltage level on node A6 is higher than the voltage level on node A5, and cross-coupled n channel MOS transistors Q72 and Q73 hold node A8 at the ground voltage level. Also, the voltage level on node A7 rises in accordance with the voltage level of external power supply voltage Vext which in turn is raised by the charging current supplied from p channel MOS transistor Q71. Accordingly, if the voltage level on node A7 is lower than the input logical threshold voltage of CMOS inverter 70*d* immediately after power-on, the voltage level of forced-activating signal ZPUP is slightly raised by CMOS inverter 70*g*, but is soon discharged, and then forced-activating signal ZPUP maintains L-level.

After external power supply voltage Vext reaches a predetermined voltage level or is stabilized after reaching the predetermined voltage level, power-on detection signal ZPOR rises to H-level at time t1, and p channel MOS transistor 70*h* is turned off. At time t1, external power supply voltage Vext is stable at the predetermined voltage level, and the voltage level on node A6 is stabilized at the voltage level of external power supply voltage Vext. In this state, CMOS transmission gate 70*a* is still on, and the voltage level on node A5 rises in accordance with rising of the voltage level of internal power supply voltage Vint. In comparison latch circuit 70*f*, p channel MOS transistor Q70 is off (the source and gate thereof receive the voltages at the same level), and node A7 maintains H-level.

In accordance with the rising of the voltage level of internal power supply voltage Vint, capacitance element 70*a* is charged, and the voltage level on node A5 rises. When the voltage level on node A5 exceeds the input logical threshold voltage of CMOS inverter 70*b* at time t2, the output signal of CMOS inverter 70*b* shifts to L-level. Thereby, node A6 is discharged to the ground voltage level, and p channel MOS transistor 70*c* is turned on, so that node A5 is coupled to external power supply node PS, and the voltage level on node A5 rises to the voltage level of external power supply voltage Vext. In response to the lowering of the voltage level on node A6, the output signal of CMOS inverter 70*d* attains H-level, and CMOS transmission gate 70*e* is turned off to prevent transmission of external power supply voltage Vext on node A5 to the node supplying internal power supply voltage Vint.

In response to the lowering of voltage level on node A6, in comparison latch circuit 70*f*, p channel MOS transistor Q70 is on and p channel MOS transistor Q71 is off so that node A8 is charged by p channel MOS transistor Q70, and the voltage level on node A8 rises. Meanwhile, node A3 is discharged through MOS transistor Q73, to have the voltage level lowered. Charging and discharging of nodes A7 and A8 are rapidly performed by the amplifier circuit formed of cross-coupled n channel MOS transistors Q72 and Q73. In response to the lowering of the voltage level on node A7, forced-activating signal ZPUP from CMOS inverter 70*g* rises to H-level. Thereby, voltage down converter 3 stops the voltage lowering operation.

In the structure of the power supply level determining circuit 70 shown in FIG. 44, forced-activating signal ZPUP is deactivated when the voltage level on node A5 exceeds the input logical threshold voltage of CMOS inverter 70*b*. The input logical threshold voltage of CMOS inverter 70*b* is determined by external power supply voltage Vext applied to external power supply node PS and a β ratio between the MOS transistors included in CMOS inverter 70*b*. The criterion voltage level of internal power supply voltage Vint is set by using external power supply voltage Vext which in turn is stabilized at the fastest earliest time after power-on, and it can be accurately determined whether internal power supply voltage Vint reaches the predetermined voltage level or not, based on the criterion voltage provided by input logical threshold voltage of CMOS inverter 70*b*. This is because the input logical threshold voltage of CMOS inverter 70*b* holds a constant value while external power supply voltage Vext is held at a stationary state. The above β is a ratio of the channel width to the channel length of a MOS transistor.

A time period from time t0 to time t2 is set to an appropriate value by adjusting the input logical threshold voltage of CMOS inverter 70*b*. Alternatively, such a structure may be employed that a resistance element is interposed between CMOS transmission gate 70*e* and capacitance element 70*a* for causing a difference in rising rate between the voltage level on node A5 and the voltage level of internal power supply voltage Vint, whereby the active time of forced-activating signal ZPUP is adjusted.

Figure 46:
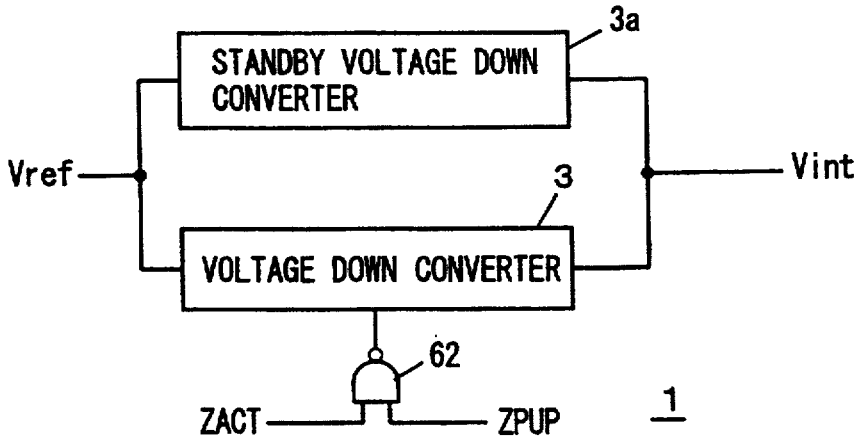
FIG. 46 schematically shows a structure of an internal power supply circuit of an embodiment 6 of the invention.
Figure 47:
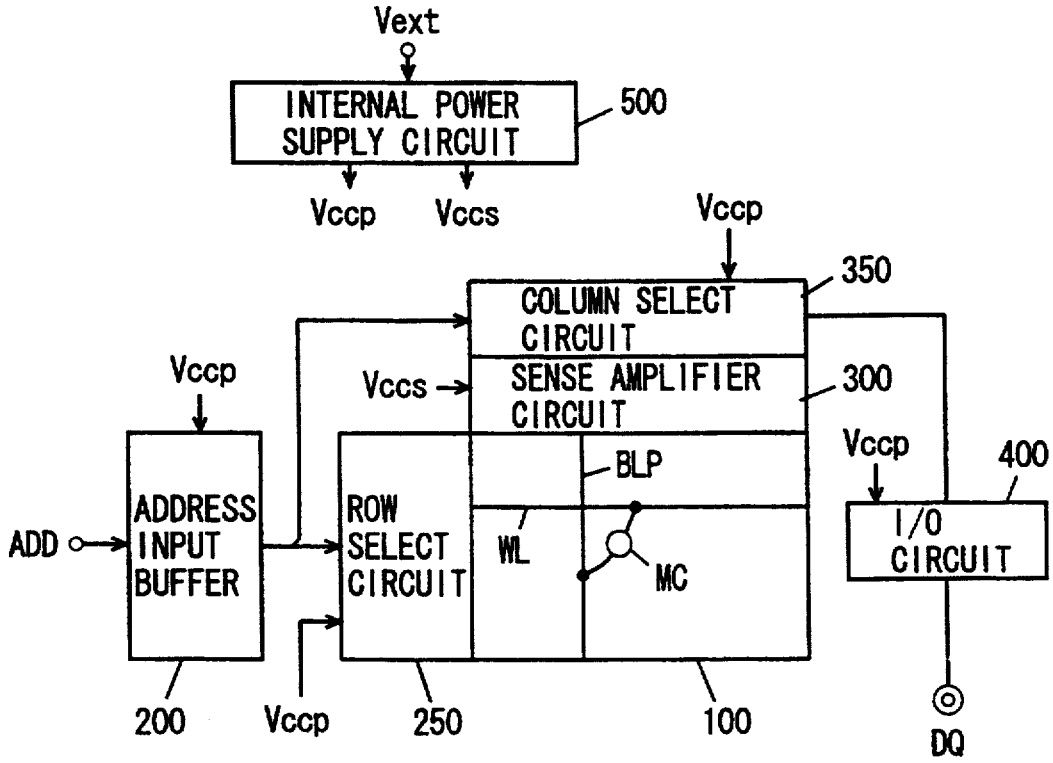
FIG. 47 PRIOR ART
FIG. 47 schematically shows a whole structure of a conventional semiconductor memory device.
Figure 48:
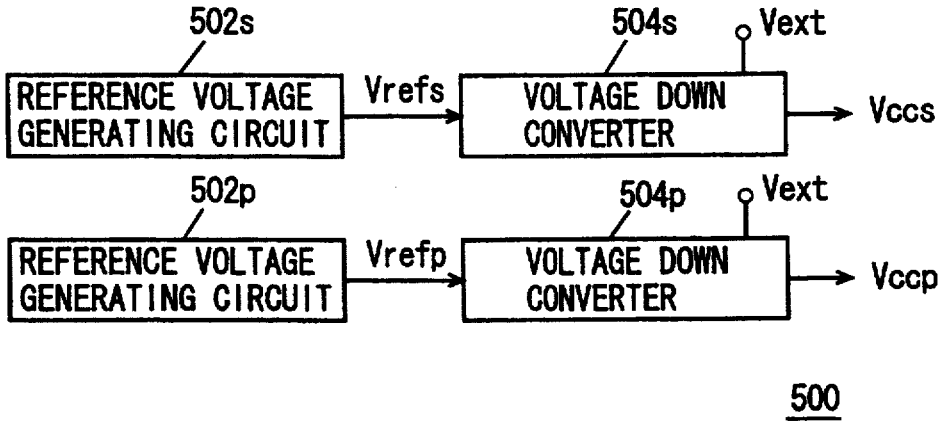
FIG. 48 PRIOR ART
FIG. 48 schematically shows a structure of an internal power supply circuit shown in FIG. 47.
Figure 49:
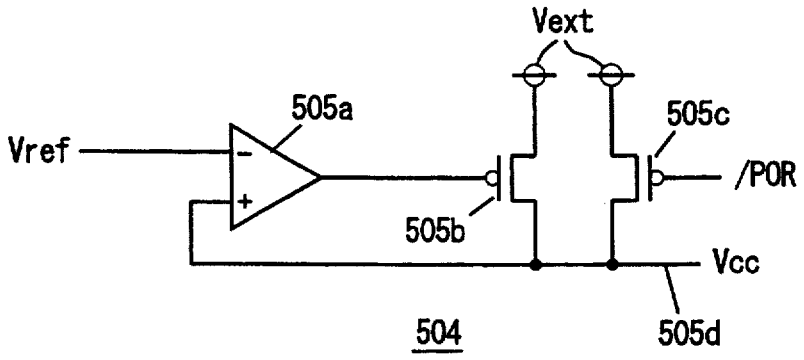
FIG. 49 PRIOR ART
FIG. 49 schematically shows a structure of a voltage down converter shown in FIG. 48.
Figure 50:
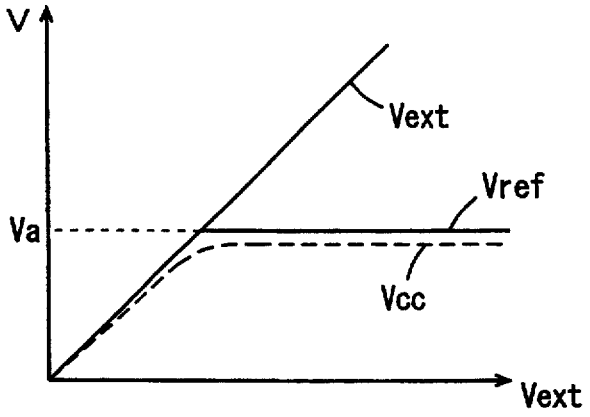
FIG. 50 PRIOR ART
FIG. 50 shows a relationship between an output voltage of a voltage down converter, an external power supply voltage and a reference voltage.
Figure 51:
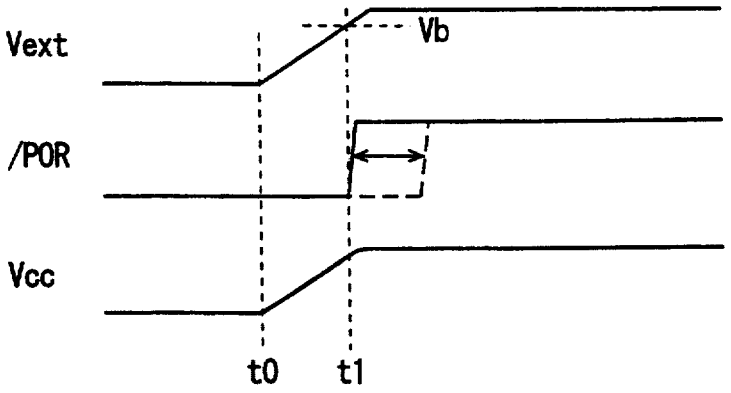
FIG. 51 PRIOR ART
FIG. 51 is a signal waveform diagram representing an operation of the voltage down converter shown in FIG. 49.
Figure 52:
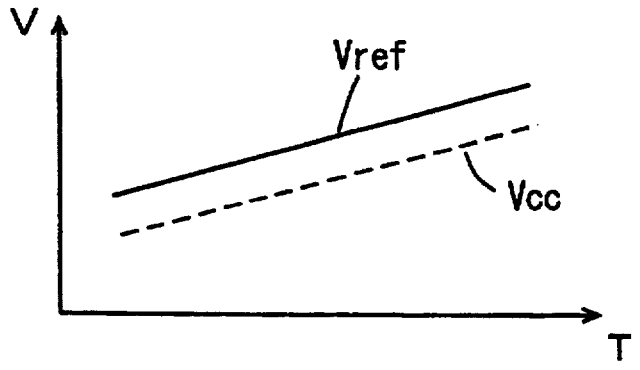
FIG. 52 PRIOR ART
FIG. 52 schematically shows temperature dependency of a reference voltage generated by a reference voltage generating circuit shown in FIG. 48.

The input logical threshold voltage of CMOS inverter 70*b* in the stable state may be set to the voltage level of reference voltage Vref (Vrefp or Vrefs) determining the voltage level of internal power supply voltage Vint (Vccp or Vccs), whereby the operation of voltage down converter 3 can be stopped when internal power supply voltage Vint reaches the predetermined reference voltage level, without direct coupling between the internal power supply line and the external power supply node. In this case, internal power supply voltage Vint may be at the voltage level lower then reference voltage Vref. The reason for this is as follows:

FIG. 46 schematically shows a structure of a main portion of the internal power supply circuit. In FIG. 46, internal power supply circuit 1 includes voltage down converter 3 which is selectively activated and deactivated to perform the voltage down-converting operation in response to the control signal from gate circuit 62, and a standby voltage down converter 3*a* which always operates to produce internal power supply voltage Vint corresponding to reference voltage Vref The output nodes of standby voltage down converter 3*a* and voltage down converter 3 are commonly coupled. Standby voltage down converter 3*a* is provided for compensating for a leak current of the internal power supply line during standby, and has a sufficiently small current drivability. However, voltage down converter 3 compensates for the current consumption during operation of the internal circuitry (i.e., peripheral circuitry and/or sense amplifier circuit), and therefore has a large current drivability. Accordingly, the foregoing structure, in which voltage down converter 3 operates to raise the voltage level of internal power supply voltage Vint upon power-on, and thereafter internal power supply voltage Vint is raised to the predetermined voltage level in accordance with only standby voltage down converter 3*a*, can significantly reduce a time required for stabilization of internal power supply voltage Vint, compared with the structure in which only standby voltage down converter 3*a* is used to drive internal power supply voltage Vint to the predetermined voltage level defined by reference voltage Vref after power-on. No problem occurs even if the time of deactivation of forced-activating signal ZPUP is set to a time when internal power supply voltage Vint is lower than reference voltage Vref.

Standby voltage down converter 3*a* has the same structure as the voltage down converter already described except for that a bias voltage is applied, instead of the activation control signal, to the gate of the current source transistor and, the current drivability is merely reduced.

According to the embodiment 6 of the invention, as described above, the voltage down converter is forcedly driven to the active state upon at power-on based on the relationship between the internal power supply voltage and the external power supply voltage. Therefore, the internal power supply voltage is produced through the voltage down converter, and coupling between the internal power supply line and the external power supply node can be prevented. Accordingly, direct application of the external power supply voltage to the internal power supply line can be prevented, and therefore it is possible to prevent destruction of the elements, which would be caused if the internal circuitry were subjected to a high voltage due to noises or the like upon power-on.

ANOTHER EXAMPLE OF APPLICATION

Each of the embodiments 1 to 6, which have been described, may be appropriately used in combination with the other embodiment(s) or may be solely used in the power supply level control circuit shown in FIG. 1.

The dynamic random access memory has been discussed as an example of the semiconductor memory device. The dynamic random access memory may be either a standard DRAM or a synchronous semiconductor memory device performing input/output of data in synchronization with a clock signal.

According to the invention, as described above, the internal power supply voltage at a desired level can be stably produced with a reduced current consumption and a small occupied area, and the internal circuits can operate stably.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A semiconductor device comprising:

a current drive transistor coupled between an external power supply node receiving an externally supplied power supply voltage and an internal power supply line transmitting an internal power supply voltage;

a level converting circuit receiving a reference voltage and the internal power supply voltage on said internal power supply line, for level-converting said reference voltage and said internal power supply voltage for outputting; and a comparing circuit for making a comparison between a level-converted reference voltage and a level-converted internal power supply voltage received from said level converting circuit, to adjust a conductance of said current drive transistor in accordance with a result of said comparison.

2. The semiconductor device according to claim 1, wherein said comparing circuit includes:

a current mirror stage coupled to said external power supply node for supplying a current; and a pair of insulated gate field effect transistors connected between said current mirror stage and a ground node and receiving the level-converted internal power supply voltage and the level-converted reference voltage on their gates, respectively, wherein a first conduction node of each of said pair of insulated gate field effect transistors is coupled to receive the ground voltage.

3. The semiconductor device according to claim 1, wherein said level converting circuit includes:

a first insulated gate field effect transistor coupled between first and second nodes and receiving said internal power supply voltage on a gate thereof;

a second insulated gate field effect transistor coupled between the first node and a third node and receiving said reference voltage on a gate thereof;

a third insulated gate field effect transistor coupled between said second node and a ground node and having a gate coupled to said third node; and a fourth insulated gate field effect transistor coupled between said third node and said ground node and having a gate coupled to said third node, said level-converted reference voltage being generated from said third node, said level-converted internal power supply voltage being generated from said second node, and the first to fourth insulated gate field effect transistors being of a common conductivity type.

4. The semiconductor device according to claim 1, wherein said level converting circuit includes:

a first insulated gate field effect transistor coupled between a first node and a second node, and receiving said internal power supply voltage on a gate thereof;

a second insulated gate field effect transistor coupled between the first node and a third node, and receiving said reference voltage on a gate thereof;

a third insulated gate field effect transistor coupled between the second node and a ground node, and having a gate coupled to said second node; and a fourth insulated gate field effect transistor coupled between said third node and the ground node, and having a gate coupled to said second node;

said level-converted internal power supply voltage being generated at said second node, and said level-converted reference voltage being generated at said third node, and the first to fourth insulated gate field effect transistors being the same in conducting type.

5. A semiconductor device comprising:

a delay chain including a plurality of delay stages connected in series, receiving an operation mode instructing signal for delaying;

decode circuitry for decoding signals on a plurality of predetermined nodes of said delay chain to produce an activating signal;

a voltage down converter activated in response to activation of the activating signal from said decode circuitry, for adjusting a voltage level of an internal power supply voltage in accordance with a difference between said internal power supply voltage and a reference voltage, said voltage down converter including a first down-converter circuit for generating a first internal power supply voltage, and a second down-converter circuit for generating a second internal power supply voltage higher than said first internal power supply voltage;

a plurality of memory cells arranged in rows and columns;

sense amplifiers provided corresponding to the columns, receiving the internal power supply voltage from the voltage down converter for sensing and amplifying data on corresponding columns when activated in response to activation of said operation mode instructing signal; and a selector coupled to said voltage down converter, for selecting the second internal power supply voltage for application to said sense amplifiers in response to deactivation of said operation mode instructing signal.

6. A semiconductor device comprising:

a delay chain including a plurality of delay stages connected in series, receiving an operation mode instructing signal for delaying;

decode circuitry for decoding signals on a plurality of predetermined nodes of said delay chain to produce an activating signal; and a voltage down converter activated in response to activation of the activating signal from said decode circuitry, for adjusting a voltage level of an internal power supply voltage in accordance with a difference between said internal power supply voltage and a reference voltage, said voltage down converter including a comparison circuit for making a comparison between said internal power supply voltage and said reference voltage, and a current drive transistor for supplying a current from an external power supply node to an internal power supply line transmitting said internal power supply voltage in accordance with the output signal of the comparison circuit, wherein said decode circuitry includes a circuit for producing a first activating signal activating said voltage down converter, and a second activating signal increasing an operation current of the comparison circuit of the voltage down converter for a predetermined period upon activation thereof.

7. The semiconductor device according to claim 6, wherein said circuit included in said decode circuitry activates said second activating signal in response to shifting to activation and deactivation of said operation mode instructing signal.

8. The semiconductor device according to claim 6, further comprising;

a plurality of memory cells arranged in rows and columns; and sense amplifiers provided corresponding to the columns, receiving the internal power supply voltage from the voltage down converter for sensing and amplifying data on corresponding columns when activated in response to activation of said operation mode instructing signal.

9. A semiconductor device comprising:

a delay chain including a plurality of delay stages connected in series, receiving an operation mode instructing signal for delaying;

decode circuitry for decoding signals on a plurality of predetermined nodes of said delay chain to produce an activating signal; and a voltage down converter activated in response to activation of the activating signal from said decode circuitry, for adiusting a voltage level of an internal power supply voltage in accordance with a difference between said internal power supply voltage and a reference voltage, said decode circuitry including a circuit for producing a first activating signal activating said voltage down converter, and a second activating signal increasing an operation current of the comparison circuit of the voltage down converter for a predetermined period upon activation thereof, wherein said voltage down converter includes first and second internal voltage down converters producing the internal power supply voltages at different voltage levels, respectively, and the first and second activating signals are applied to said first and second internal voltage converters, respectively.

10. A semiconductor device comprising:

a delay chain including a plurality of delay stages connected in series, receiving an operation mode instructing signal for delaying;

decode circuitry for decoding signals on a plurality of predetermined nodes of said delay chain to produce an activating signal, said decode circuitry including a circuit for producing a first activating signal activating said voltage down converter, and a second activating signal increasing an operation current of the comparison circuit of the voltage down converter for a predetermined period upon activation thereof; and a voltage down converter activated in response to activation of the activating signal from said decode circuitry, for adjusting a voltage level of an internal power supply voltage in accordance with a difference between said internal power supply voltage and a reference voltage, said voltage down converter including first and second internal voltage down converters producing the internal power supply voltages at different voltage levels, respectively, and the first and second activating signals both being applied to said first internal voltage converter.

11. A semiconductor device comprising:

a current drive transistor coupled between an external power supply node receiving an external power supply voltage and an internal power supply line;

comparing circuitry for making a comparison between voltages corresponding to a reference voltage and an internal power supply voltage on said internal power supply line, respectively, to control a conductance of said current drive transistor in accordance with the result of said comparison when made active; and activating circuitry for activating said comparing circuitry in accordance with a level of said internal power supply voltage.

12. The semiconductor device according to claim 11, wherein said activating circuitry includes a circuit for activating said comparing circuitry in accordance with a difference between said internal power supply voltage and said reference voltage.

13. The semiconductor device according to claim 11, wherein said activating circuitry includes a circuit for activating said comparing circuitry in accordance with a difference between a criterion voltage other than said reference voltage and said internal power supply voltage.

14. The semiconductor device according to claim 11, wherein said activating circuitry includes a circuit for activating said comparing circuitry in accordance with a difference between said internal power supply voltage and said external power supply voltage.

15. The semiconductor device according to claim 11, wherein said activating circuit includes a circuitry for activating said comparing circuitry when a difference between said internal and external power supply voltages becomes not higher than a predetermined value.

* * * * *